US005293760A

United States Patent [19]

Tani et al.

[11] Patent Number: 5,293,760

[45] Date of Patent: Mar. 15, 1994

[54] WASHING MACHINE

[75] Inventors: Kazutoshi Tani, Tokyo; Kaichi Hatsukawa; Satoko Hasegawa, both of Kanagawa, all of Japan

[73] Assignee: Kabushiki Kaisha Toshiba, Kawasaki, Japan

[21] Appl. No.: 41,398

[22] Filed: Mar. 31, 1993

[30] Foreign Application Priority Data

Mar. 31, 1992 [JP] Japan ..... 4-077671

[51] Int. Cl.[5] ..... D06F 33/02

[52] U.S. Cl. ..... 68/12.02; 68/12.12

[58] Field of Search ..... 68/12.01, 12.02, 12.12

[56] References Cited

U.S. PATENT DOCUMENTS 5,075,613 12/1991 Fisher ..... 68/12.01 X 5,220,814 6/1993 Imai et al. ..... 68/12.02

FOREIGN PATENT DOCUMENTS 61-25592 2/1986 Japan ..... 68/12.01

63-143098 6/1988 Japan ..... 68/12.01

OTHER PUBLICATIONS

S. Abe et al, "Japanese Abstract No. 61-263487," Nov. 21, 1986.

*Primary Examiner*—Philip R. Coe

*Attorney, Agent, or Firm*—Foley & Lardner

[57] ABSTRACT

A washing machine has an entanglement detector. The detector detects forward load torque while a pulsator (water flow producing means) is being turned in a forward direction during one of the washing and rinsing operations as well as reverse load torque while the pulsator is being turned in a reverse direction. The detector calculates a difference between the forward load torque and the reverse load torque and determines that the washing are entangling with one another if the difference is greater than a reference value. The washing machine also has a disentangle unit for disentangling the washing if the entanglement detector determines that the washing are entangling.

14 Claims, 62 Drawing Sheets

| FIG.11A |
| --- |
| FIG.11B |

FIG.12a1
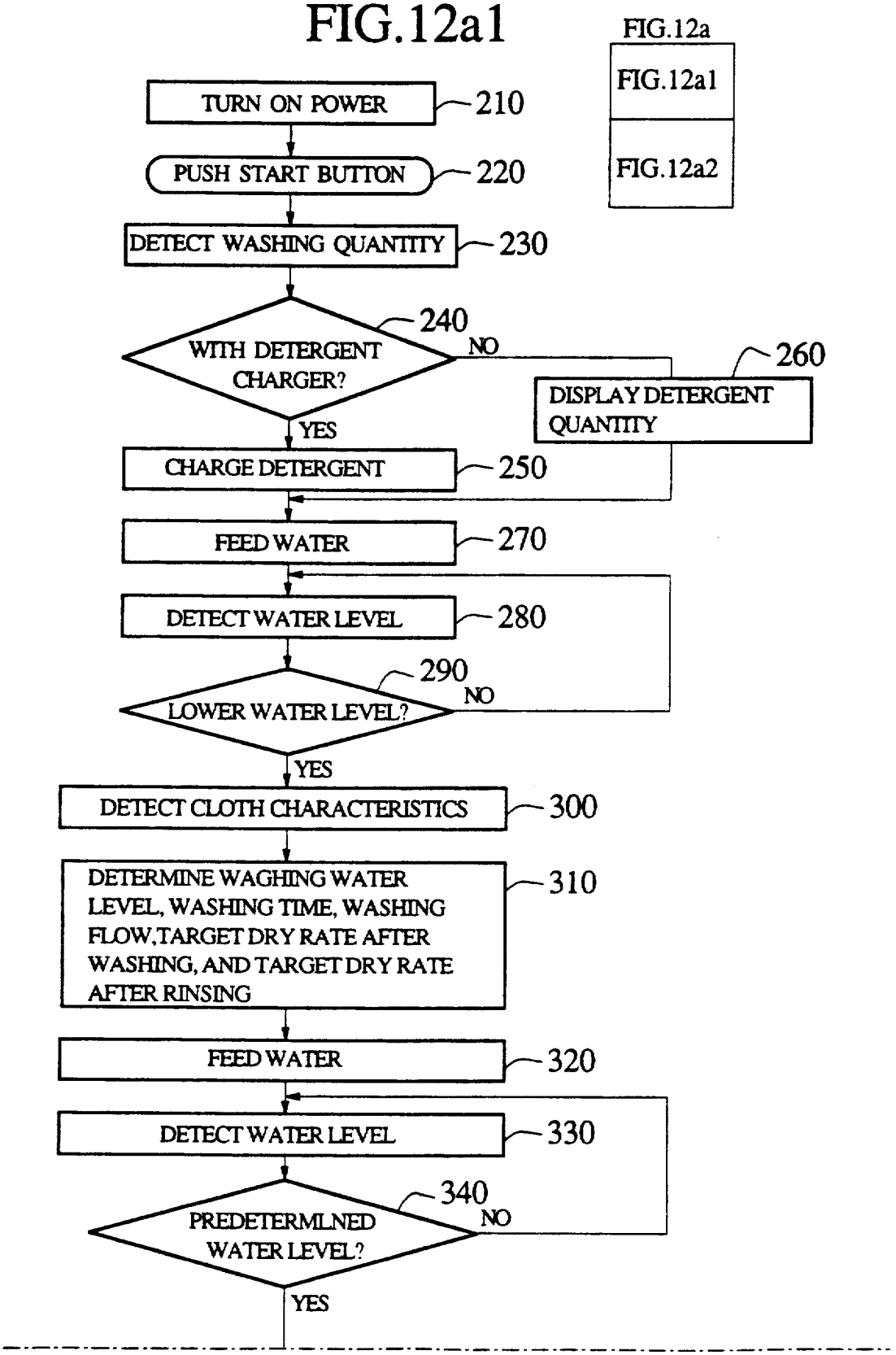

FIG.12a2
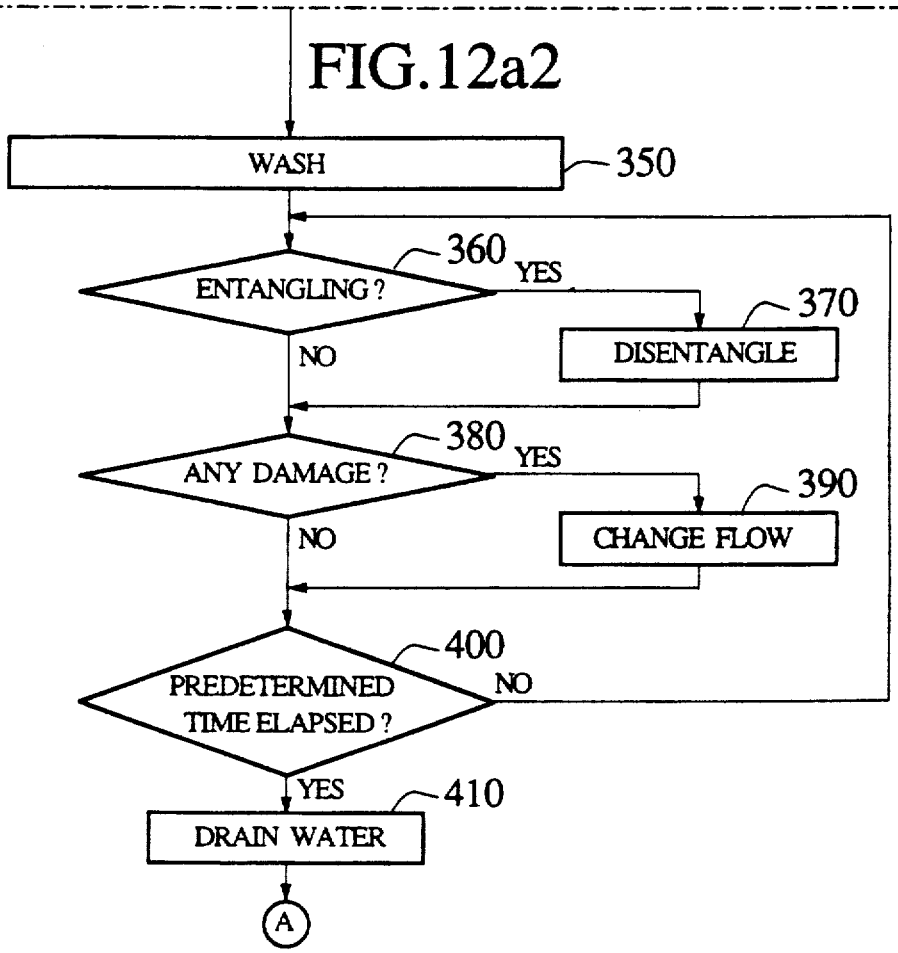

FIG.12b1
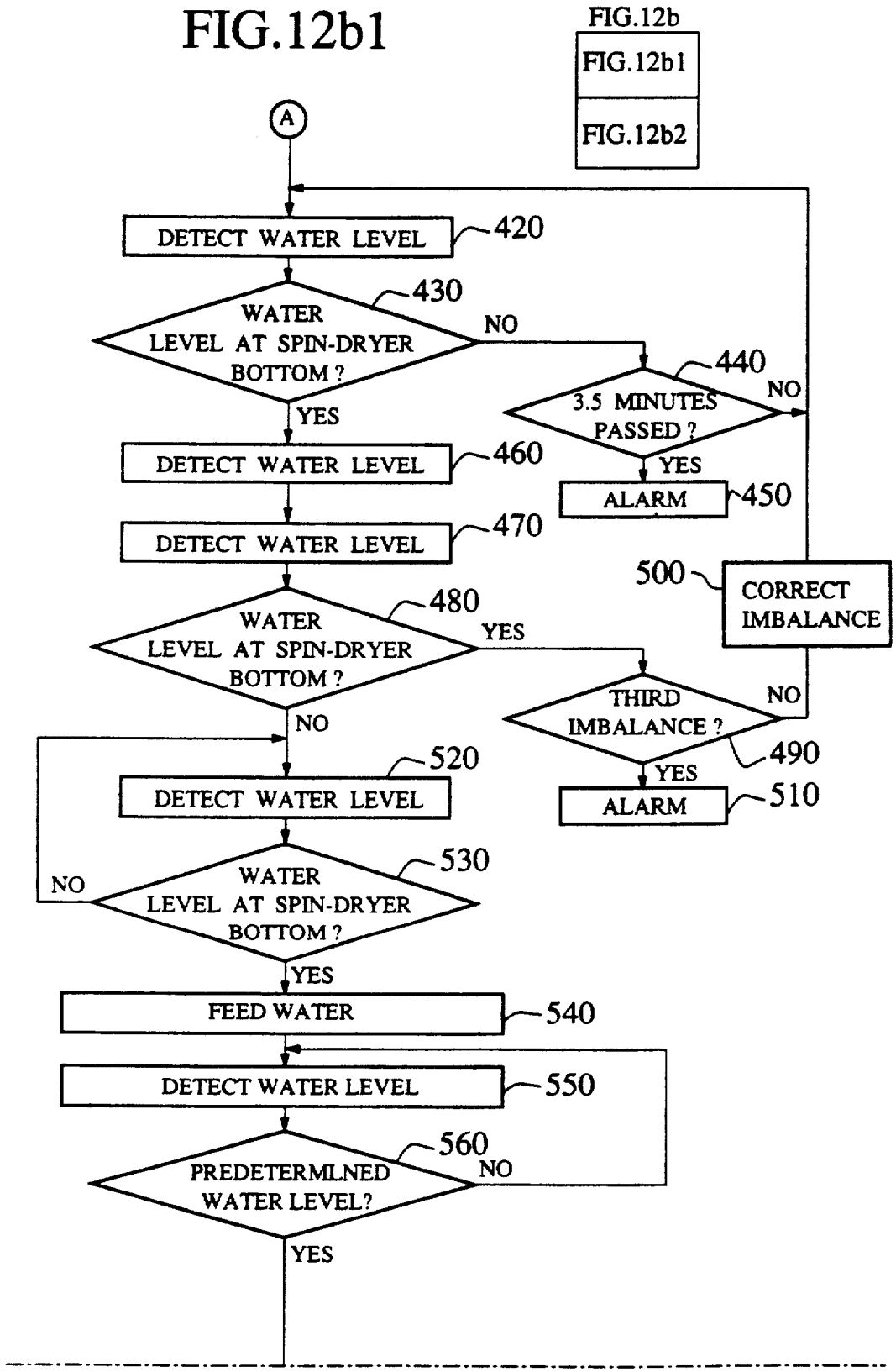

FIG.12b2
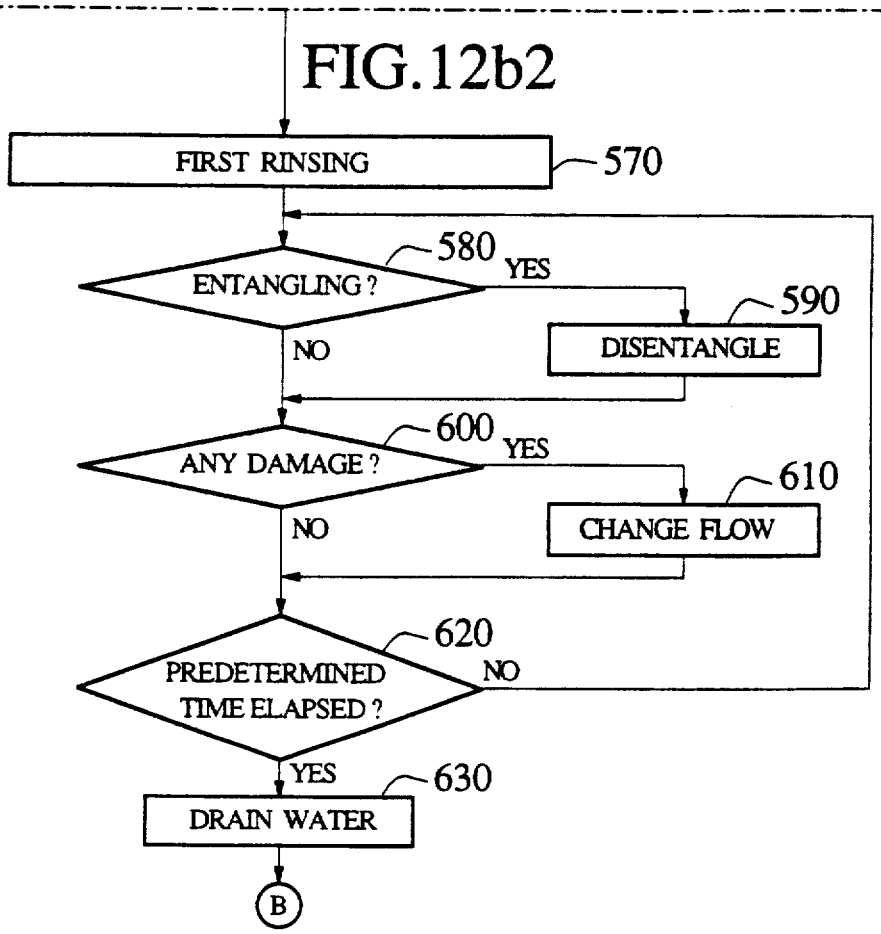

FIG.12c1
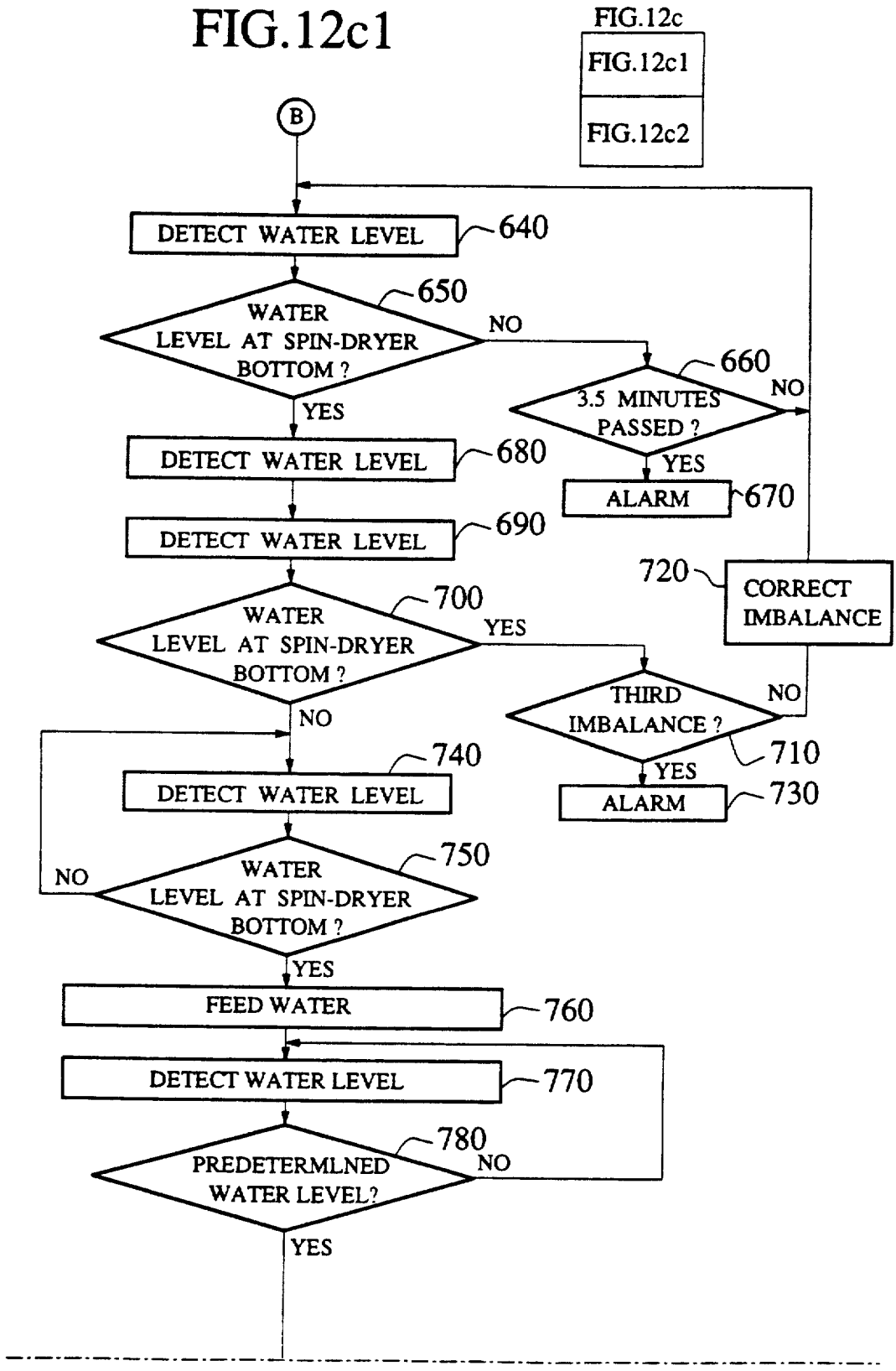

FIG.12c2
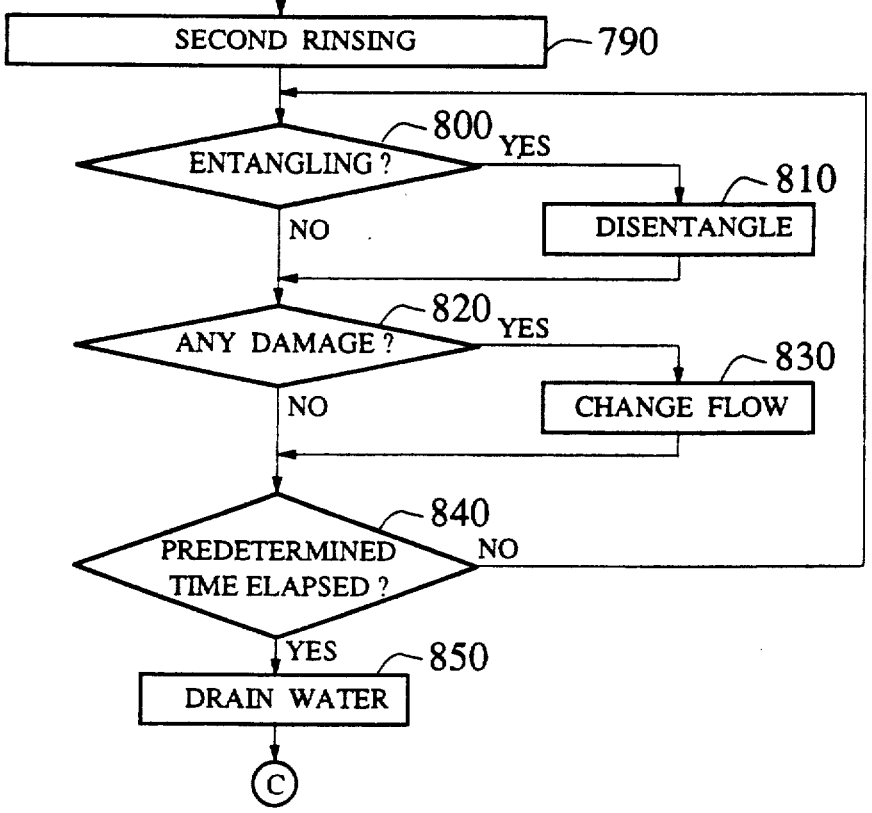

| CLOTH CHARACTERISTICS | SOFT | STANDARD | HARD |
|---|---|---|---|
| RESISTANCE ON PULSATOR | SMALL | MIDDLE | LARGE |
| TORQUE | SMALL | MIDDLE | LARGE |

FIG.20

| CLOTH CHARACTERISTICS / WASHING QUANTITY | SOFT | STANDARD | HARD |
|---|---|---|---|
| LITTLE | $T_{00}$ | $T_{01}$ | $T_{02}$ |
| MIDDLE | $T_{10}$ | $T_{11}$ | $T_{12}$ |
| MUCH | $T_{20}$ | $T_{21}$ | $T_{22}$ |

$$\begin{pmatrix} T_{i0}<T_{i1}<T_{i2} \\ T_{0j}<T_{1j}<T_{2j} \end{pmatrix}$$

FIG.21

| CLOTH CHARACTERISTICS / WASHING QUANTITY | SOFT | STANDARD | HARD |
|---|---|---|---|
| LITTLE | $V_{00}$ | $V_{01}$ | $V_{02}$ |
| MIDDLE | $V_{10}$ | $V_{11}$ | $V_{12}$ |
| MUCH | $V_{20}$ | $V_{21}$ | $V_{22}$ |

$$\begin{pmatrix} V_{i0}<V_{i1}<V_{i2} \\ V_{0j}<V_{1j}<V_{2j} \end{pmatrix}$$

INVERTER CURRENT

FIG.47a
FIG.47b
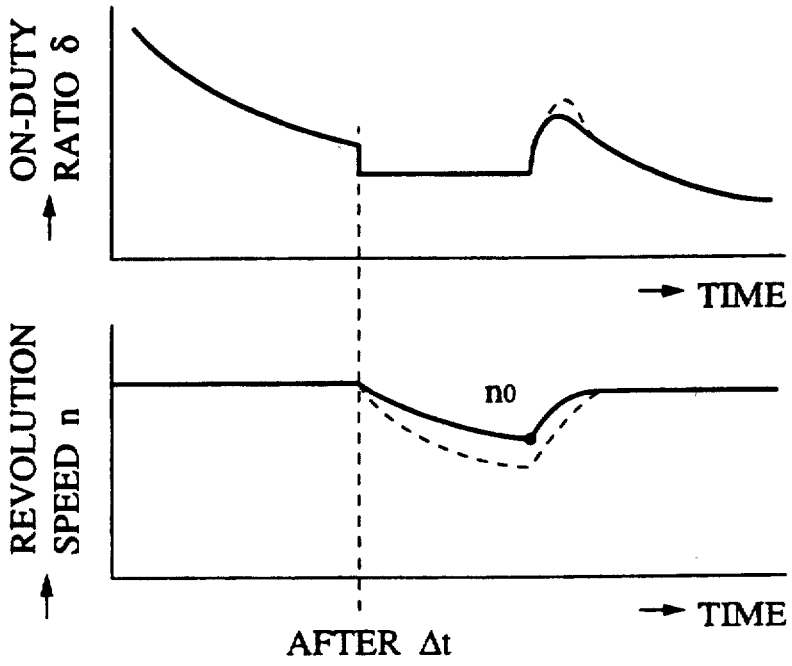
FIG.48
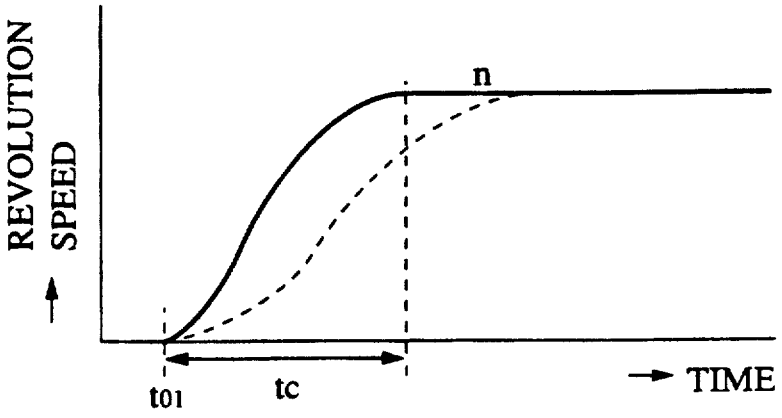

WASHING MACHINE

BACKGROUND OF THE INVENTION

1. Field of the Invention

The present invention relates to a washing machine capable of detecting entangled washing and disentangling the washing.

2. Description of the Prior Art

Washing in a washing machine frequently entangle with one another to hinder sufficient washing and rinsing. The entanglement causes a spin basket of the washing machine to turn irregularly and vibrate. The entanglement, therefore, must be avoided or properly detected and disentangled.

Recent full-automatic washing machines detect the quantity and characteristics of washing placed in a washing tub, determine the proper quantity and water flow, and wash, rinse, and dry the washing automatically. A user is only required to place washing in the washing machine and push a start button.

The full-automatic washing machines, however, cannot properly detect entanglement of washing nor disentangle the washing during washing and rinsing.

SUMMARY OF THE INVENTION

An object of the present invention is to provide a washing machine that properly detects entanglement of washing, disentangles them, and sufficiently washes and rinses them.

In order to accomplish the object, a washing machine according to a first aspect of the present invention employs a detector. The detector detects forward load torque produced while water flow producing means is being turned in a forward direction as well as reverse load torque produced while the water flow producing means is being turned in a reverse direction. The washing machine also employs a calculation unit for calculating a difference between the forward load torque and the reverse load torque,' an entanglement detector that determines the washing are entangling with one another if the difference is greater than a reference value, and a disentangle unit for disentangling the washing if the detector detects entanglement.

A washing machine according to a second aspect of the present invention has a detector for detecting load torque produced while water flow producing means is being turned at a fixed speed, a detector for detecting a change in the detected load torque, an entanglement detector that determines the washing are entangling with one another if the detected change is greater than a reference value, and a disentangle unit for disentangling the washing if the detector detects entanglement.

The first aspect of the present invention turns the water flow producing means in forward and reverse directions, detects forward load torque and reverse load torque, calculates a difference between the two pieces of torque, determines that washing are entangling with one another if the difference is greater than the reference value, and disentangles the washing.

The second aspect of the present invention turns the water flow producing means at a fixed speed, detects load torque, finds a change in the load torque, determines washing are entangling if the change is greater than the reference value, and disentangles the washing.

These and other objects, features and advantages of the present invention will be more apparent from the following detailed description of preferred embodiments in conjunction with the accompanying drawings.

BRIEF DESCRIPTION OF THE DRAWINGS

FIGS. 12*a* to 12*d* are flowcharts showing the details of the operations of the washing machine;

FIG. 20 is a table showing washing quantities, starting torque, and cloth characteristics according to the first cloth characteristics detection method;

FIG. 21 is a table showing washing quantities, voltages applied to the brushless DC motor, and cloth characteristics;

FIG. 47a shows a relationship between the ON-duty ratio of a PWM signal and a spin-dry period according to a third dry rate detection method;

FIG. 47b shows a relationship between the revolution speed of the brushless DC motor and a spin-dry period according to the third dry rate detection method;

FIG. 48 shows a relationship between a spin-dry period and the revolution speed of the motor according to a fourth dry rate detection method;

DETAILED DESCRIPTION OF THE EMBODIMENTS

Embodiments of the present invention will be explained with reference to the drawings.

Figure 1:
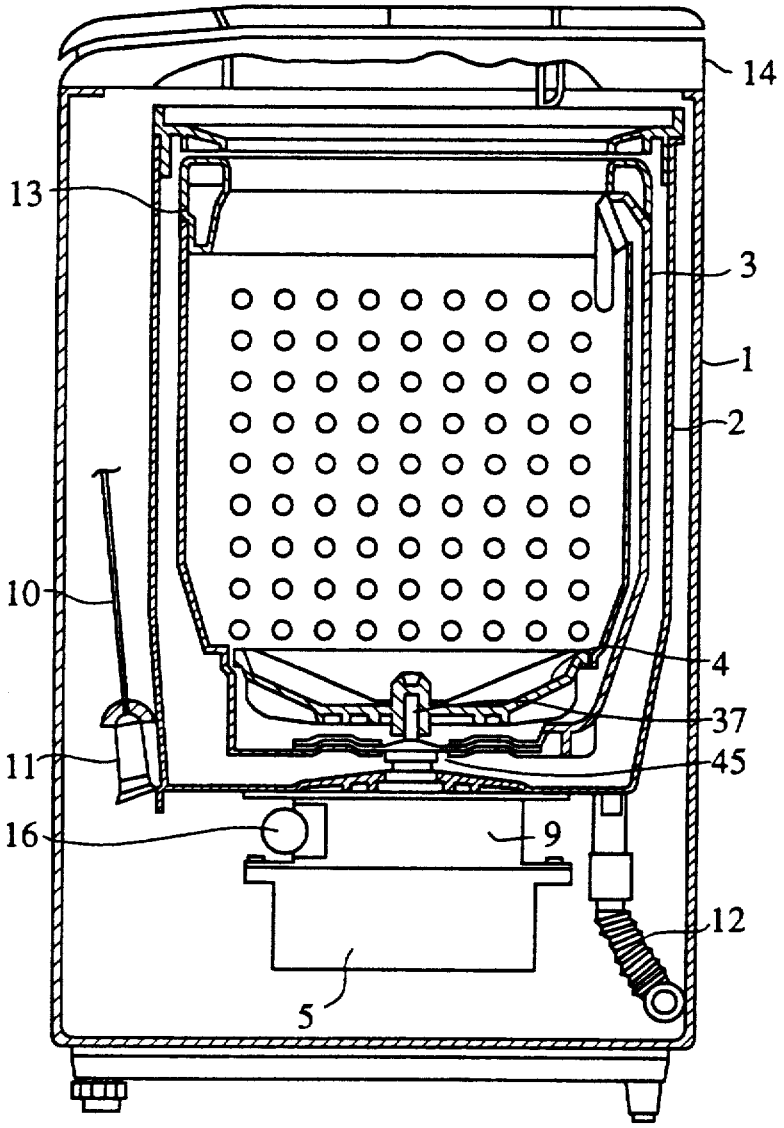
FIG. 1 shows the inside of a washing machine according to an embodiment of the present invention.

FIG. 1 is a partly broken sectional view showing the inside of a washing machine according to an embodiment of the present invention. The washing machine has a brushless DC motor 5 to directly drive a spin basket 3 and/or a pulsator 4. A washing tub 2, therefore, is compact and capable of accommodating a large amount of washing.

The present invention uses information provided by the motor 5, to automatically detect a washing quantity, cloth characteristics, and a water level, set a washing period and a water flow, sense entanglement, disentangle, protect washing, and achieve a required dry rate.

A user puts washing in the washing machine and pushes a start button, and the washing machine automatically washes the washing with a proper quantity of water and an optimum flow while preventing the entanglement of and damage to the washing, drains water, and dries the washing.

The washing machine has a body 1. The body 1 lid 14 to open and close the top of the body 1. The body 1 supports the washing tub 2 with four rods 10 and suspensions 11. The washing tub 2 accommodates the spin basket 3. The bottom of the washing tub 2 supports the brushless DC motor 5. The motor 5 turns the pulsator 4 and/or the spin basket 3 through a mechanism 9.

A drain hose 12 is attached to the bottom of the washing tub 2 and is guided to the outside of the body 1. A drain valve (not shown) is interposed between the washing tub 2 and the drain hose 12. The drain valve is opened to drain water from the washing tub 2. A feed valve (not shown) is attached to the top of the washing tub 2. The feed valve is opened to feed water into the washing tub 2.

The pulsator 4 generates a water flow in the spin basket 3. The pulsator 4 engages with a first transmission shaft 37 through splines. The shaft 37 joins with a drive shaft (not shown) of the motor 5 through the mechanism 9, so that the motor 5 may directly drive the pulsator 4.

The mechanism 9 includes a flat clutch 57 for connecting and disconnecting the motor 5 to and from the spin basket 3. The mechanism 9 also includes a brake for stopping the spin basket 3.

An actuator 16 is arranged beside the mechanism 9. The actuator 16 drives the clutch 57. The actuator 16 is used to transmit the torque of the motor 5 to the pulsator 4 and/or to the spin basket 3 and brake the spin basket 3.

A balancer 13 runs along the top periphery of the spin basket 3, to stabilize the rotation of the spin basket 3.

Figure 2:
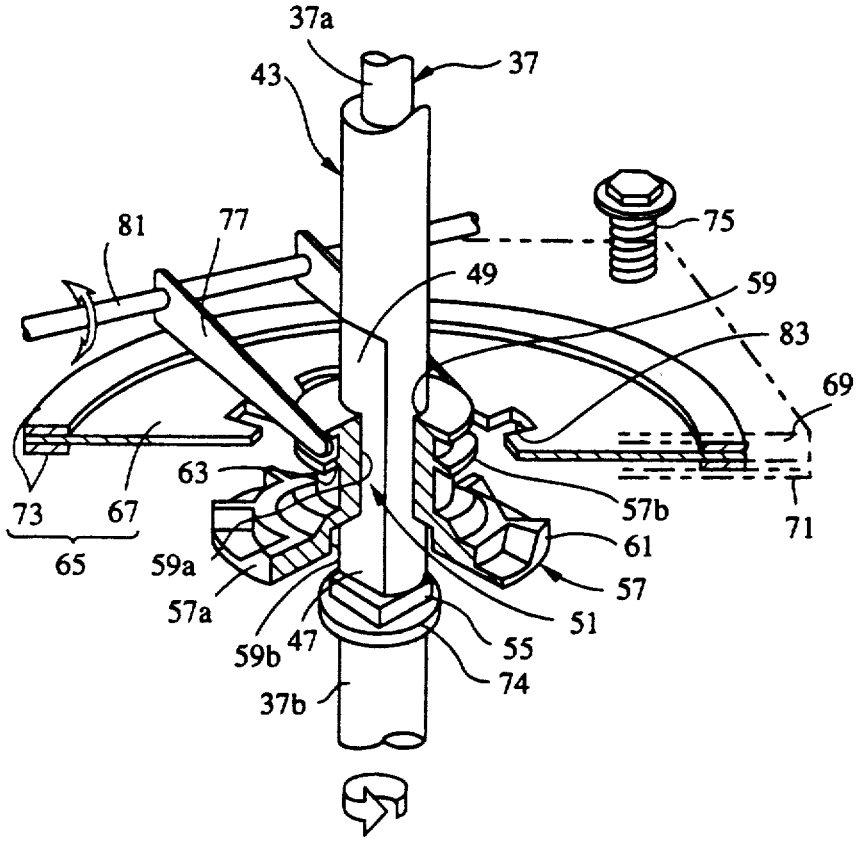
FIG. 2 shows the inside of a clutch mechanism of the washing machine.

FIG. 2 shows the details of the mechanism 9.

The first transmission shaft 37 has a thin part 37a to which a cylindrical second transmission shaft 43 is fitted. The shafts 37 and 43 are turnable relative to each other. The top of the shaft 43 is fitted to a flange 45

(FIG. 1), which is attached to the bottom of the spin basket 3.

The periphery of the shaft 43 has a cut face 51 having a predetermined length. The cut face 51 axially extends between a lower end 47 and an upper end 49. The lower end 47 is in contact with a rectangular part 55 formed at the top of a thick part 37*b* of the shaft 37.

The clutch 57 engages with the cut face 51 and rectangular part 55. The clutch 57 is movable for about several millimeters along the shaft 43, to connect and disconnect the shaft 37 to and from the shaft 43.

The clutch 57 has a lower disk 57*a*, an upper cylinder 57*b*, and a through hole 59 which the shaft 43 passes through. The through hole 59 has a part 59*a* corresponding to the cut face 51 of the shaft 43 and a part 59*b* corresponding to the rectangular part 55 of the shaft 37.

The disk 57*a* of the clutch 57 has upward projections 61 equidistantly arranged along the circumference of the disk 57*a*. The top periphery of the cylinder 57*b* of the clutch 57 has an annular groove 63.

A brake disk 65 for braking the spin basket 3 is arranged around the clutch 57. The brake disk 65 involves a rotary disk 67 and liners 73 fitted to circumferential edges on each face of the rotary disk 67. The liners 73 are disposed between the brake pads 69 and 71, which are immobile to the washing tub 2.

Four springs 75 always push the brake pads 69 and 71 against the liners 73. The brake pads 69 and 71 are fixed to a cover 41 of the mechanism 9 as shown in FIG. 3.

The first and second shafts 37 and 43 are rotatable through bearings (not shown).

The inner side of the rotary disk 67 of the brake 65 has recesses 83 that engage with the projections61 of the clutch 57, respectively.

The annular groove 63 of the clutch 57 receives a projection formed at a tip of a lever 77. The other end of the lever 77 is connected to a shaft 81, which is turned by the actuator 16 (FIG. 1). When the tip of the lever 77 is moved up, the projections 61 of the clutch 57 engage with the recesses 83 of the brake disk 67.

Operations of the mechanism 9 of the washing machine will be explained with reference to FIGS. 3*a* to 3*c*.

Figure 3A:
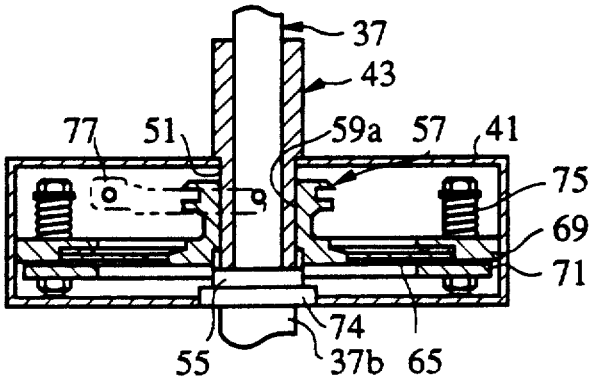
FIGS. 3*a*-3*c* show operations of the clutch mechanism.

In FIG. 3*a*, the lever 77 holds the clutch 57 at an upper position. The part 59*a* of the clutch 57 is in contact with the cut face 51 of the shaft 43, and the clutch 57 engages only with the shaft 43. Namely, the shafts 37 and 43 are disconnected from each other. Accordingly, the torque of the motor 5 is transmitted only to the pulsator 4 connected to the shaft 37.

Figure 3B:
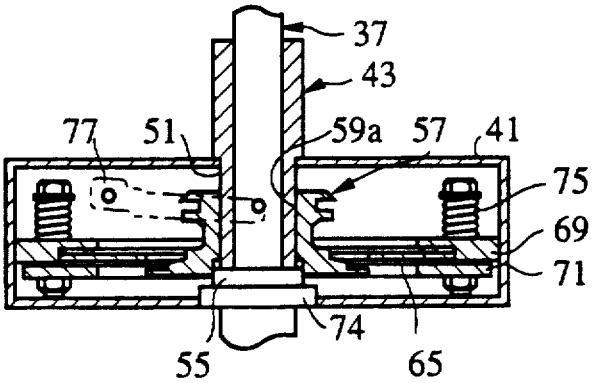
Figure 3C:
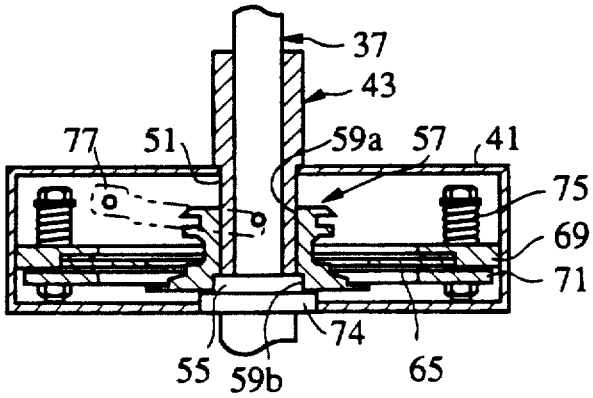

For a spin-dry operation, the lever 77 is moved down from FIG. 3*a* to FIG. 3*c* through FIG. 3*b*. The part 59*a* of the clutch 57 is in contact with the cut face 51 of the shaft 43, and the part 59*b* of the clutch 57 gets in contact with the rectangular part 55 of the shaft 37. Namely, the shafts 37 and 43 are connected to each other through the clutch 57. Then, the motor 5 drives the spin basket 3 and pulsator 4 together.

To stop the spin basket 3, the motor 5 connected to the shaft 37 is stopped, and the clutch 57 is moved to the upper position of FIG. 3*a* by the lever 77. Then, the clutch 57 engages only with the shaft 43, and the projections 61 of the clutch 57 engage with the recesses 83 of the brake disk 65. As a result, the shaft 43 turns the brake disk 65 through the clutch 57. Since the brake disk 65 is braked by the brake pads 69 and 71, the spin basket 3 connected to the shaft 43 is stopped.

In this way, slight vertical movements of the clutch 57 drive and brake the shaft 43 and the spin basket 3 connected to the shaft 43. This arrangement helps reduce the axial lengths of the clutch and brake mechanisms, to help enlarge the volume of the spin basket 3 without increasing the size of the body 1.

Figure 4:
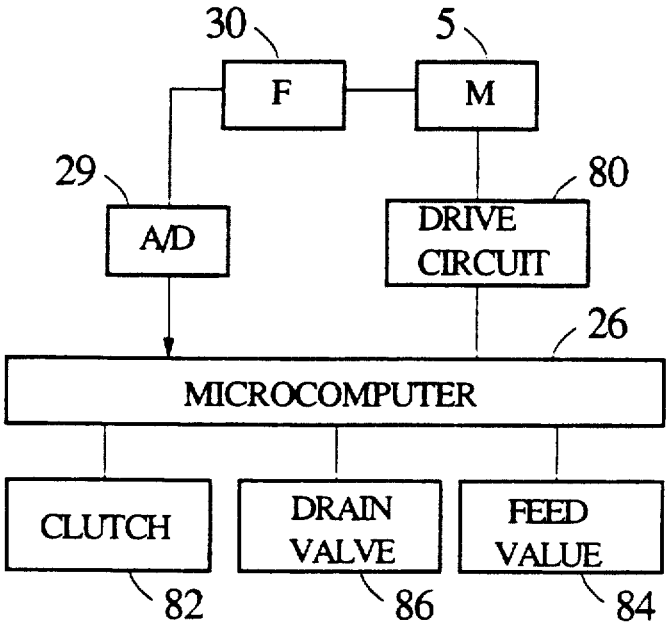
FIG. 4 shows control circuits of the washing machine.

FIG. 4 shows a circuit for controlling the mechanism 9, motor 5, feed valve, drain valve, etc., of the washing machine of FIG. 1.

This circuit includes a microcomputer 26 having a microprocessor, ROMs, RAMs, and interfaces. The microcomputer 26 controls the motor 5, detects a washing quantity, cloth characteristics, and water levels, sets a washing period and a water flow, finds entanglement, disentangles, protects washing, and manages a dry rate.

The microcomputer 26 controls the motor 5 through a drive circuit 80 and receives data such as a drive voltage and a drive current from the motor 5 through a filter 30 and an A/D converter 29. The microcomputer 26 also receives the revolution speed of the motor 5.

The microcomputer 26 also controls a clutch mechanism 82 involving the clutch 57 and actuator 16, the feed valve 84, and the drain valve 86.

Figure 5:
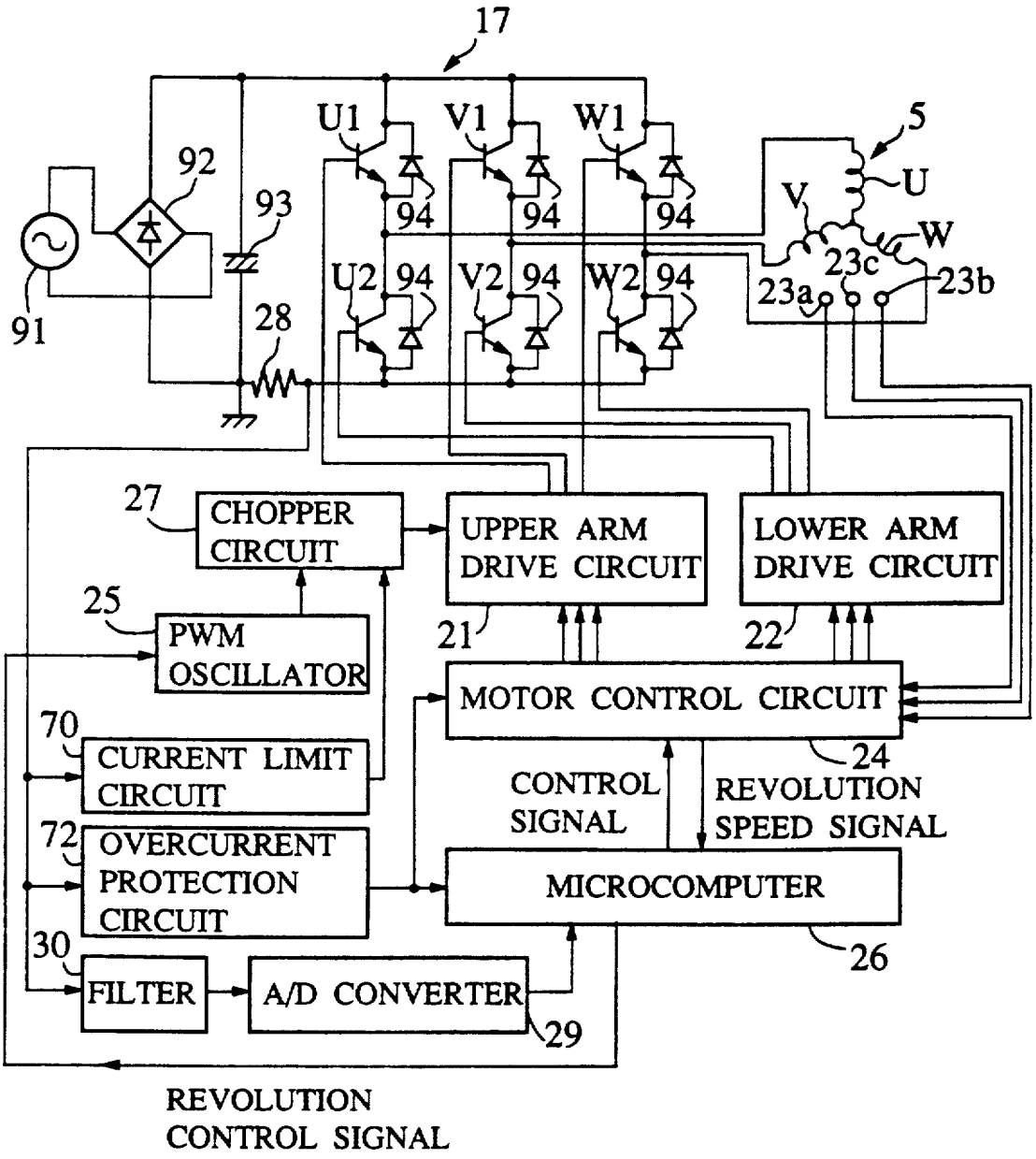
FIG. 5 shows drive circuits for the control circuits.

FIG. 5 shows the drive circuit 80 for driving the motor 5 according to an instruction from the microcomputer 26. All parts of FIG. 5 except the motor 5, microcomputer 26, filter 30, and A/D converter 29 form the drive circuit.

The brushless DC motor 5 has armature coils U, V, and W and is driven by a 3-phase full wave bridge type inverter circuit 17. The inverter circuit 17 includes a rectifying diode bridge 92 and a smoothing capacitor 93. The diode bridge 92 rectifies an AC voltage provided by a commercial AC power source 91. The smoothing capacitor 93 smooths the rectified voltage and provides a DC voltage. The DC voltage is converted by a 3-phase full wave bridge into a 3-phase alternating current.

The 3-phase full wave bridge includes three pairs of arms corresponding to three phases. The arms involve six transistors U1, U2, V1, V2, W1, and W2 serving as switching elements. For the sake of simplicity of explanation, the three arms to which the transistors U1, V1, and W1 are connected will be called upper arms, and the three arms to which the transistors U2, V2, and W2 are connected will be called lower arms. The six transistors are connected to free wheel diodes 94 in parallel, respectively. Three nodes between the upper and lower arms are connected to the armature coils U, V, and W of the motor 5, respectively.

The motor 5 also has a rotor (not shown) made of a permanent magnet and three Hall elements 23*a*, 23*b*, and 23*c* for detecting the rotational position of the rotor. The Hall elements provide a motor control circuit 24 with positional signals.

The motor control circuit 24 is connected to the microcomputer 26. The motor control circuit 24 provides the microcomputer 26 with a revolution speed signal according to the rotor positional signals. The microcomputer 26 provides the motor control circuit 24 with control signals such as start, stop, forward, and reverse signals for the motor 5.

The motor control circuit 24 drives the upper arm transistors U1, V1, and W1 through an upper arm drive circuit 21, and the lower arm transistors U2, V2, and W2 through a lower arm drive circuit 22. According to the positional signals provided by the Hall elements 23*a*, 23*b*, and 23*c*, the motor control circuit 24 controls the switching timing of the upper and lower arm transistors through the drive circuits 21 and 22.

More precisely, the motor control circuit 24 logically converts the positional signals from the Hall elements 23a, 23b, and 23c into drive signals that sequentially turn ON transistor combinations such as U1 and V2, V1 and W2, and W1 and U2. Such switching changes a DC voltage to a three-phase alternating current, which is successively supplied to the armature coils U-V, V-W, and W-U of the motor 5. As a result, the motor 5 is turned in a given direction.

The revolving direction of the motor 5 is reversible by changing the direction of the current supplied to the armature coils U, V, and W. The revolving direction of the motor 5 is controlled by the motor control circuit 24 according to a forward or reverse instruction provided by the microcomputer 26.

The circuit 24 generates a revolution speed signal according to the rotor positional signals provided by the Hall elements 23a, 23b, and 23c and sends the speed signal to the microcomputer 26. According to the speed signal, the microcomputer 26 prepares a rotation control signal, which is supplied to a PWM oscillator 25, to control the ON-duty ratio of a PWM signal provided by the PWM oscillator.

The revolution speed of the motor 5 varies according to an applied DC voltage, which is controlled and changed by the PWM oscillator 25. The PWM oscillator 25 receives an ON-duty ratio setting signal from the microcomputer 26. An output of the PWM oscillator 25 is supplied to the upper arm drive circuit 21 through a chopper circuit 27.

According to the ON-duty ratio setting signal, the PWM oscillator 25 provides, for example, a PWM signal having an ON-OFF duty factor of 15 KHz. The PWM signal is chopped by the chopper circuit 27 and an upper arm driving circuit 21 and supplied to the upper arm transistors U1, V1, and W1 through the upper arm drive circuit 21. The ON period of these transistors is changed according to the ON-duty ratio of the PWM signal, to change the DC voltage applied to the motor 5, thereby changing the revolution speed of the motor As the ON period of the upper arm transistors U1, V1, and W1 becomes shorter, the DC voltage applied to the motor 5 becomes smaller to slow the motor 5. On the other hand, as the ON period becomes longer, the DC voltage becomes larger to speed the motor 5.

To stop the motor 5, the microcomputer 26 provides the motor control circuit 24 with a stop signal, and the circuit 24 turns OFF all the transistors U1, V1, W1, U2, V2, and W2 of the inverter circuit 17.

In the inverter circuit 17, a resistor 28 is connected between an end of the smoothing capacitor 93 and commonly connected emitters of the lower arm transistors U2, V2, and W2. The resistor 28 detects, as a voltage, an inverter current of the inverter circuit 17. The detected voltage is a pulse wave turned ON and OFF at, for example, 15 KHz (frequency of PWM signal). The pulse wave is averaged by the filter 30 and converted into a digital signal by the A/D converter 29. The digital signal is sent to the microcomputer 26. According to the digital signal, the microcomputer 26 finds the value of the voltage applied to the motor 5.

The characteristics of the brushless DC motor 5 will be explained in detail.

Figure 6:
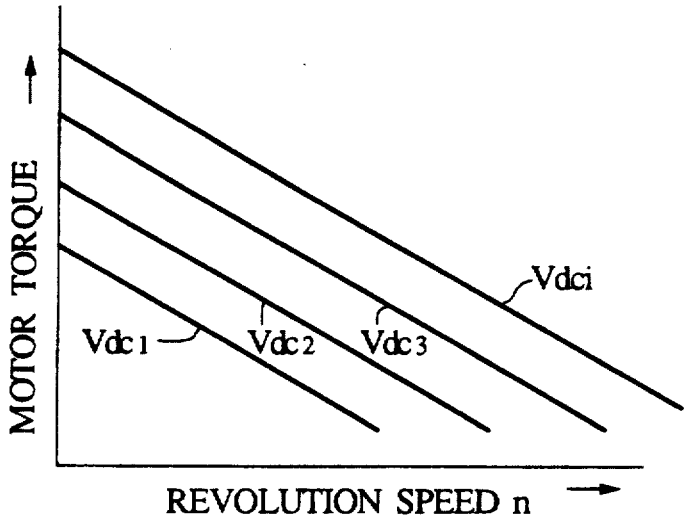
FIG. 6 shows a relationship between the torque and revolution speed of a brushless DC motor with a voltage applied to the motor being changed.

FIG. 6 shows a relationship between the torque and revolution speed of the motor 5. The torque is in inverse proportion to the revolution speed. Namely, when the speed increases, the torque decreases. This relationship shifts as shown in FIG. 6 in response to a change in a voltage Vdc applied to the motor 5.

Figure 7:
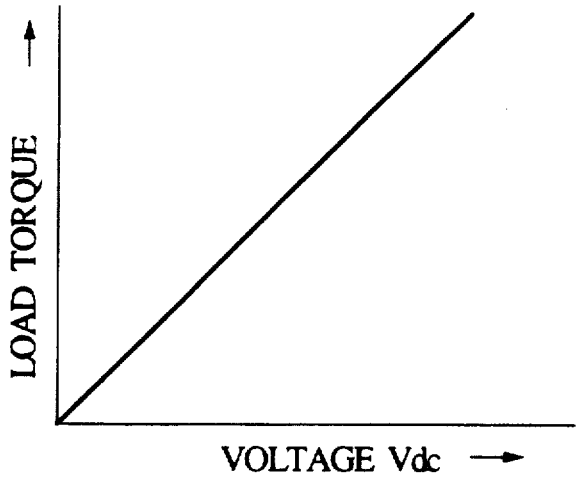
FIG. 7 shows a relationship between the load torque and voltage of the motor during a constant rotation.

FIG. 7 shows a relationship between the torque and applied voltage of the motor 5 with the revolution speed of the motor being unchanged. This figure tells that load (torque) on the motor 5 is proportional to a voltage applied to the motor 5 when the speed of the motor 5 is unchanged. Due to this proportionality, load applied by washing on the motor 5 is calculable from a voltage applied to the motor after the motor reaches a constant speed.

Figure 8:
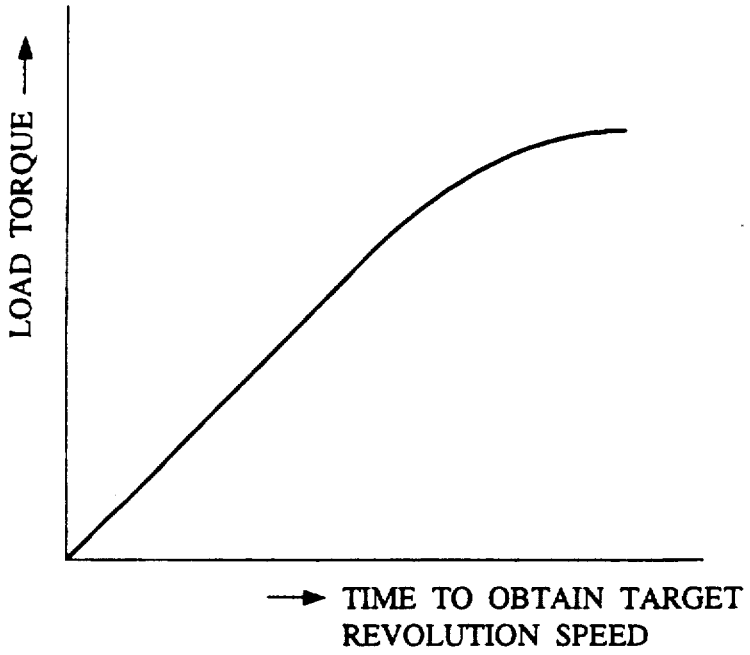
FIG. 8 shows a relationship between a period within which the motor reaches a target revolution speed and load torque with the performance of the motor being unchanged.

FIG. 8 shows a relationship between the torque and a target speed reaching period of the motor 5 with a voltage applied to the motor 5 being unchanged. This figure tells that energy needed by the motor 5 to reach a target revolution speed is dependent on load torque on the motor if the performance of the motor is unchanged. Namely, a period to reach a target speed for the motor 5 is substantially proportional to load torque imposed by washing on the motor. This means that washing load is calculable from a period for the motor 5 to reach a given revolution speed. FIG. 8 shows that load toque will be saturated if a period to reach a given speed is too long.

Figure 9:
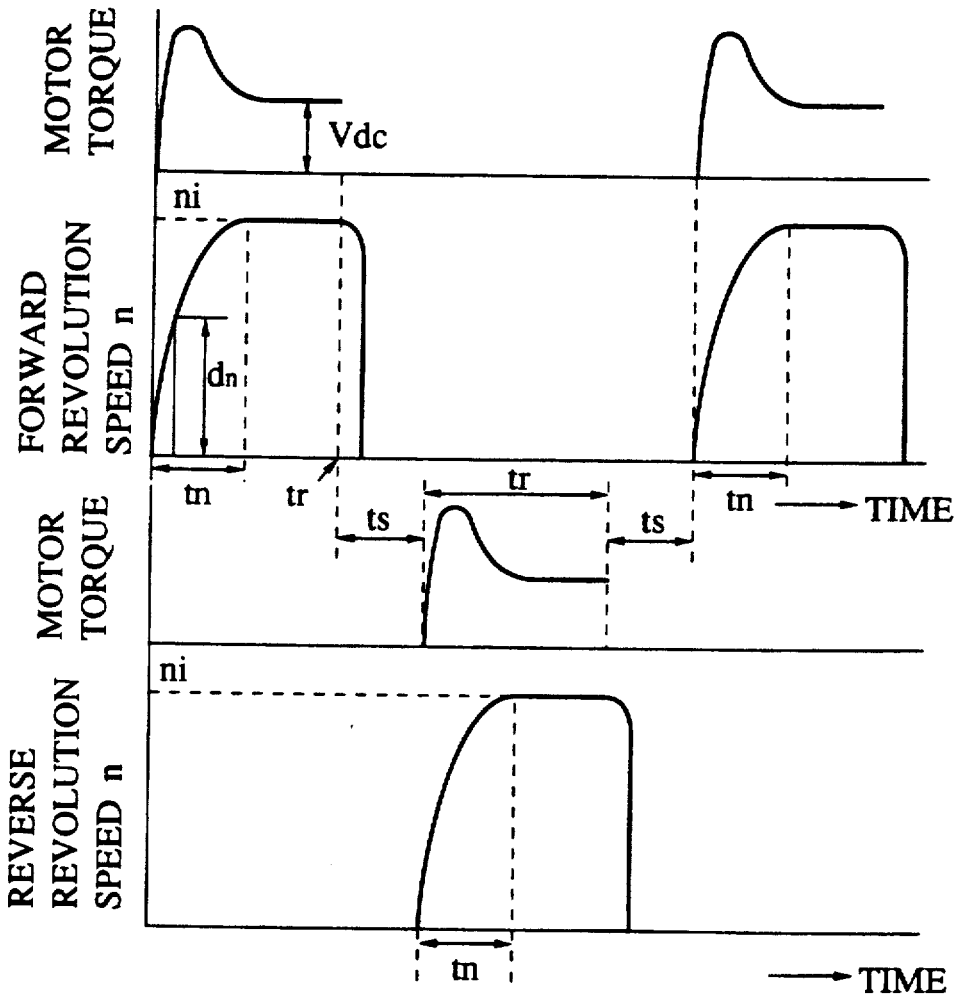
FIG. 9 shows the torque, revolution speed, and forward and reverse intervals of the motor driven in forward and reverse directions.

FIG. 9 shows changes in the torque and revolution speed of the motor 5 when the motor is intermittently turned in forward and reverse directions. After the motor 5 starts to turn in the forward or reverse direction, the revolution speed gradually increases to reach a target speed ni at time tn. This time tn depends on washing load. A change dn in the speed of the motor 5 in a given period from the start also depends on the washing load.

The torque of the motor 5 increases after the start. After the motor 5 reaches the constant target speed ni, the voltage Vdc applied to the motor 5 becomes constant.

During a period from the start to time tr, the motor 5 is driven in the forward or reverse direction. A period ts is an interval between adjacent forward and reverse turns.

The voltage Vdc applied to the motor 5 is proportional to an inverter current Idc flowing to the motor 5. Accordingly, it is possible to use the inverter current Idc instead of the voltage Vdc. The voltage Vdc and inverter current Idc are controlled by the ON-duty ratio $\delta$ of the PWM signal provided by the PWM oscillator 25 controlled by the microcomputer 26. Accordingly, the ON-duty ratio $\delta$ may be used instead of the voltage Vdc or the current Idc.

Figure 10:
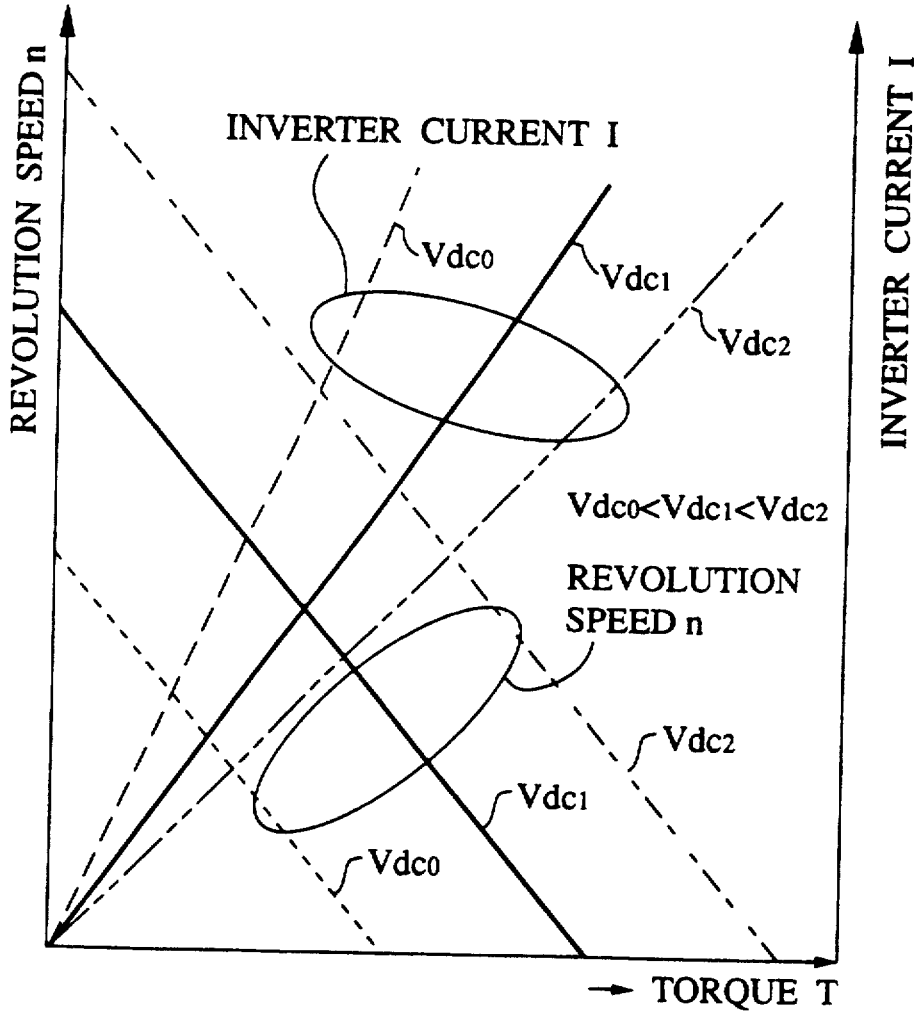
FIG. 10 shows a relationship between the torque, inverter current, and revolution speed of the motor with a voltage applied to the motor being changed.

FIG. 10 shows a relationship between the torque T and revolution speed n of the motor 5 with a voltage applied to the motor being varied. The figure also shows a relationship between the motor torque T and an inverter current I. The inverter current I is substantially proportional to the torque T.

Figures 11, 11A:
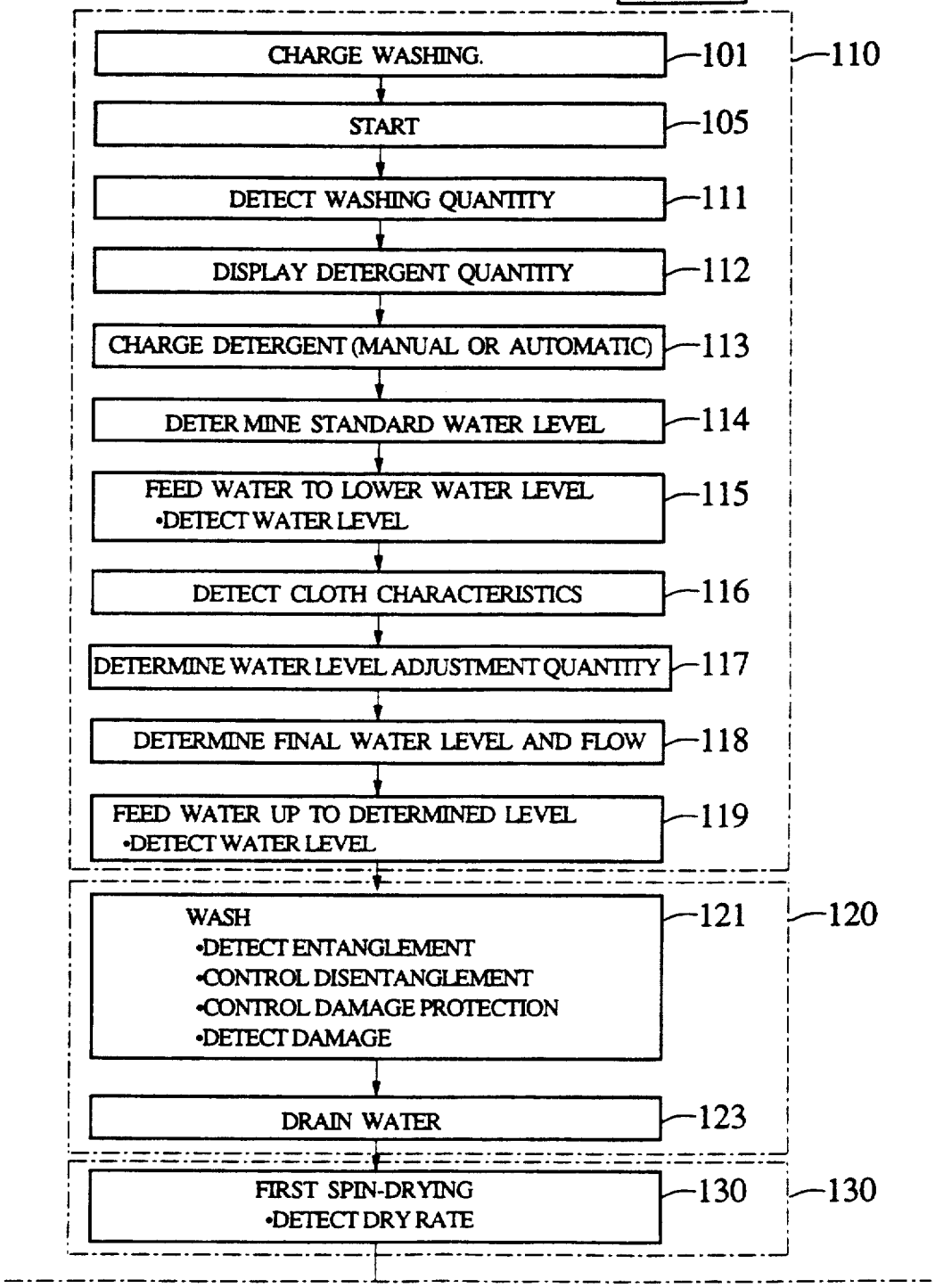
FIGS. 11*a*-11*b* make up a general flowchart showing the operations of the washing machine of FIG. 1.
Figure 11B:
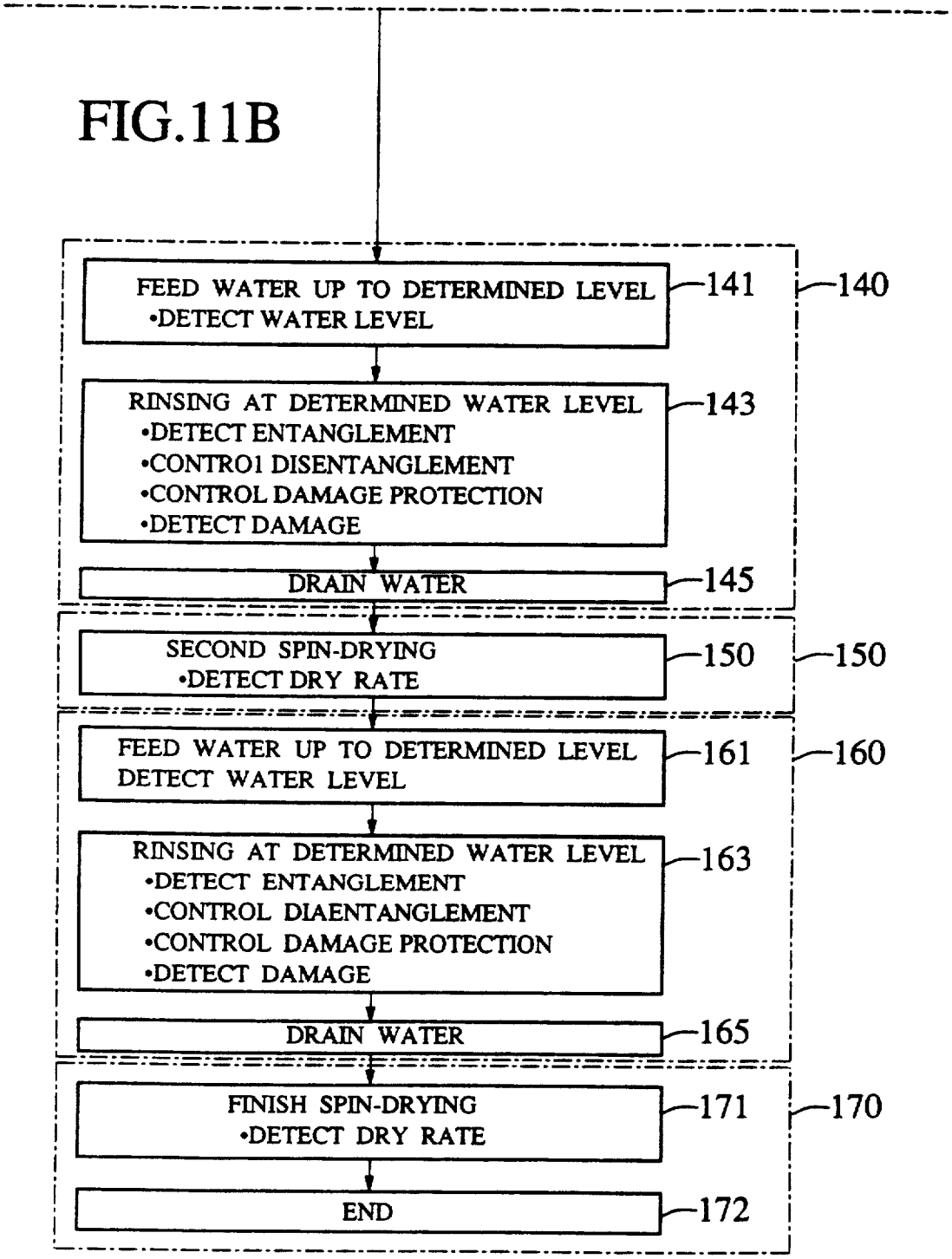

FIG. 11 is a flowchart generally showing operations of the washing machine according to the present invention.

The operations are classified into a preparation stage 110, a wash stage 121, a first spin-dry stage 130, a first rinse stage 140, a second spin-dry stage 150, a second rinse stage 160, and a finish spin-dry stage 170.

The preparation stage 110 will be explained.

A user puts washing into the washing machine in step 101 and pushes a start button in step 105. Step 111 detects the quantity of the washing. Step 112 displays the quantity of detergent appropriate for the detected washing quantity. In step 113, the user may put detergent into the washing machine according to the displayed quantity. If the washing machine has an automatic detergent charger, the charger automatically feed the detergent into the washing machine. Step 114 determines a standard water level according to the detected washing quantity. Step 115 feeds water up to a low level while detecting a water level. Step 116 detects cloth characteristics (the characteristics of the washing) at the low water level. Step 117 determines an adjusting water level according to the cloth characteristics. Step 118 corrects the standard water level according to the adjusting water level and provides a final water level. According to the final water level, washing quantity, and cloth characteristics, the step 118 determines a water flow, a washing period, a target dry rate, etc. Step 119 feeds water up to the final water level while detecting a water level. When water is filled up to the final water level, the wash stage 120 starts.

The wash stage 120 will be explained.

Step 121 controls the clutch 57 to disconnect the motor 5 from the spin basket 3 and connect the motor 5 to the pulsator 4, which generates a water flow in the washing tub 2. The step 121 washes the washing for the washing period while detecting entanglement, disentangling, sensing damage to the washing, and protecting the washing. Step 123 drains water from the washing tub 2.

The first spin-dry stage 130 will be explained.

Step 130 connects the motor 5 to the spin basket 3 and pulsator 4 through the clutch 57, to turn them together. The step 130 spin-dries the washing up to the target dry rate set in the step 118 while detecting a dry rate.

The first rinse stage 140 will be explained.

Step 141 feeds water up to the final water level set in the step 118 while detecting a water level. Step 143 drives only the pulsator 4 through the clutch 57, to rinse the washing for the predetermined period while detecting entanglement, disentangling, protecting the washing, and sensing damage to the washing. Step 145 drains water.

The second spin-dry stage 150 will be explained.

Step 150 turns the spin basket 3 and pulsator 4 together to spin-dry the washing up to the target dry rate set in the step 118 while detecting a dry rate.

The second rinse stage 160 will be explained.

Step 161 feeds water to the final water level while detecting a water level. Step 163 drives only the pulsator 4 to rinse the washing for the predetermined period while detecting entanglement, disentangling, protecting the washing, and sensing damage to the washing. Step 165 drains water.

The final spin-dry stage 170 will be explained.

Step 171 drives the spin basket 3 and pulsator 4 together to spin-dry the washing up to the target dry rate while detecting a dry rate. Step 172 is the completion of all the processes.

TABLE 1
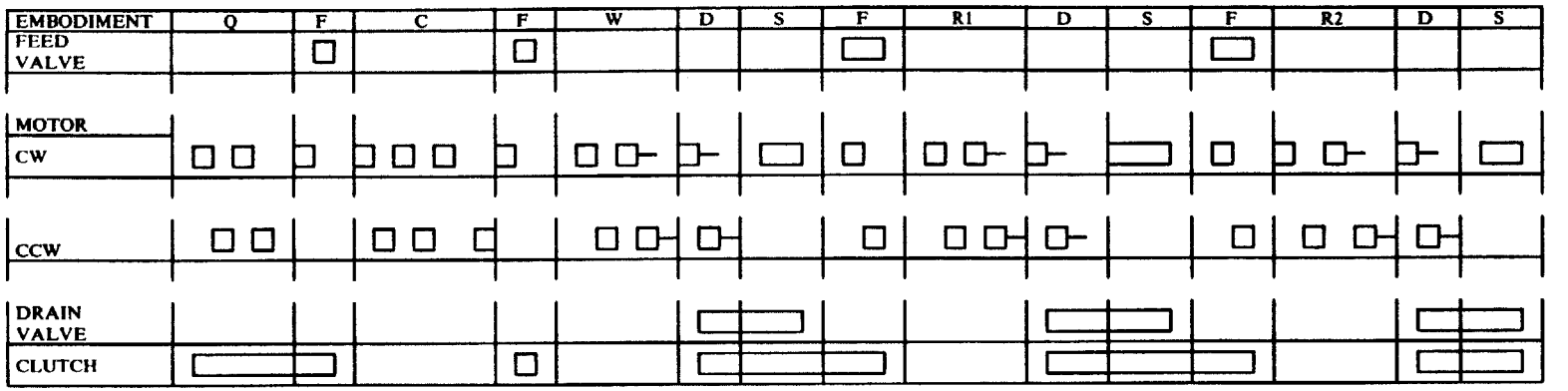
C: CLOTH CHARACTERISTICS DETECTION
D: DRAIN
F: FEED WATER
Q: WASHING QUANTITY DETECTION
R1: FIRST RINSING
R2: SECOND RINSING
S: SPIN-DRYING
W: WASHING Table 1 shows the operations of the feed valve 84, motor 5, drain valve 86, and clutch mechanism 82. Each thick line corresponds to an operating period. The motor 5 is driven in forward and reverse directions. Each thick line for the clutch mechanism 82 indicates that the clutch is connecting the motor 5 with the spin basket 3, to turn the spin basket 3 and pulsator 4 together.

The operations of the washing machine according to the present invention will be explained in more detail with reference to FIG. 12*a* onward.

A user puts washing into the spin basket 3 of the washing machine, turns ON a power source, and pushes a start button in steps 210 and 220. In step 230, the microcomputer 26 detects the quantity of the washing.

To detect the washing quantity, the microcomputer 26 controls the clutch 57 of the clutch mechanism 82 in the mechanism 9, so that the shafts 37 and 43 are connected to each other. The microcomputer 26 then drives the motor 5 to turn the spin basket 3 and pulsator 4 together. The washing quantity is detected before feeding water into the washing machine.

The detected washing quantity may be converted into the weight of the washing. The microcomputer 26 detects load torque (Tj) produced by the spin basket 3 and washing, according to a change in the torque of the motor 5 at the start of or during the operation of the spin basket 3, or according to an electromotive force produced in the motor 5 when the revolving spin basket 3 is braked. According to the load torque, the washing quantity is calculable.

Alternatively, the microcomputer 26 drives the spin basket 3 containing the washing at a given speed by the motor 5 and then electrically brakes the motor 5, to find electric power consumed by the electric braking. According to the consumed power, the washing quantity is computed.

Instead, the microcomputer 26 may drive the spin basket 3 containing the washing at a given speed, then lets the motor 5 freely run, and detects the moment of inertia of the spin basket 3. According to the magnitude of the moment of inertia, the washing quantity is computed.

A first washing quantity detection method according to the present invention will be explained.

This method drives the motor 5 at a given speed and then zeroes a drive voltage applied to the motor 5 so that the motor runs freely due to the moment of inertia. According to a decrease in the speed of the motor, the washing quantity is computed.

According to this method, washing are put in the spin basket 3 of the washing machine. The motor 5 is driven at a constant revolution speed np by controlling a voltage Vdc applied to the motor 5. The voltage Vdc is controllable by changing the ON-duty ratio of the PWM signal provided by the PWM oscillator 25.

A certain period after the motor 5 has reached the fixed speed np, the upper and lower arm transistors U1, V1, W1, U2, V2, and W2 are turned OFF. Then, the spin basket 3 containing the washing continuously turns due to inertia.

The speed of the spin basket 3 containing the washing gradually decreases depending on the quantity of the washing. Namely, the speed more slowly decreases if the washing quantity is large and more rapidly decreases if the washing quantity is small.

The microcomputer 26 measures a period T1 from the turning OFF of the upper and lower arm transistors at the revolution speed np to a time point when the revolution speed reaches n1. The period T1 is compared with preset data, to find the washing quantity.

Figure 13:
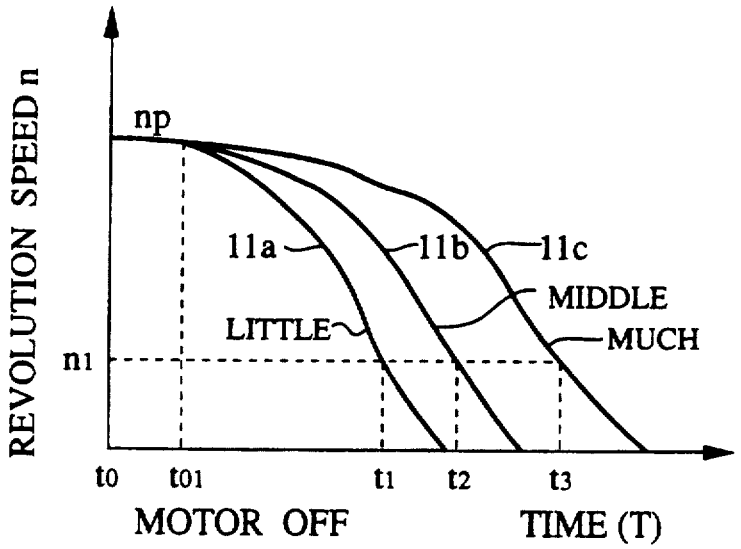
FIG. 13 shows temporal changes in a revolution speed according to a first washing quantity detection method.

FIG. 13 is a graph showing this method. The motor 5 operating at the constant speed np is stopped at time t01. The motor 5 then freely turns and decreases its speed depending on the quantity of the washing contained in the spin basket 3. In the figure, a curve 11*a* represents a small washing quantity with which the revolution speed quickly decreases. A curve 11*b* represents an intermediate washing quantity with which the revolution speed intermediately decreases. A curve 11*c* represents a large washing quantity with which the revolution speed slowly decreases. In this way, a washing quantity is identifiable according to periods t1, t2, and t3 during which the revolution speed np decreases to n1.

Figure 14:
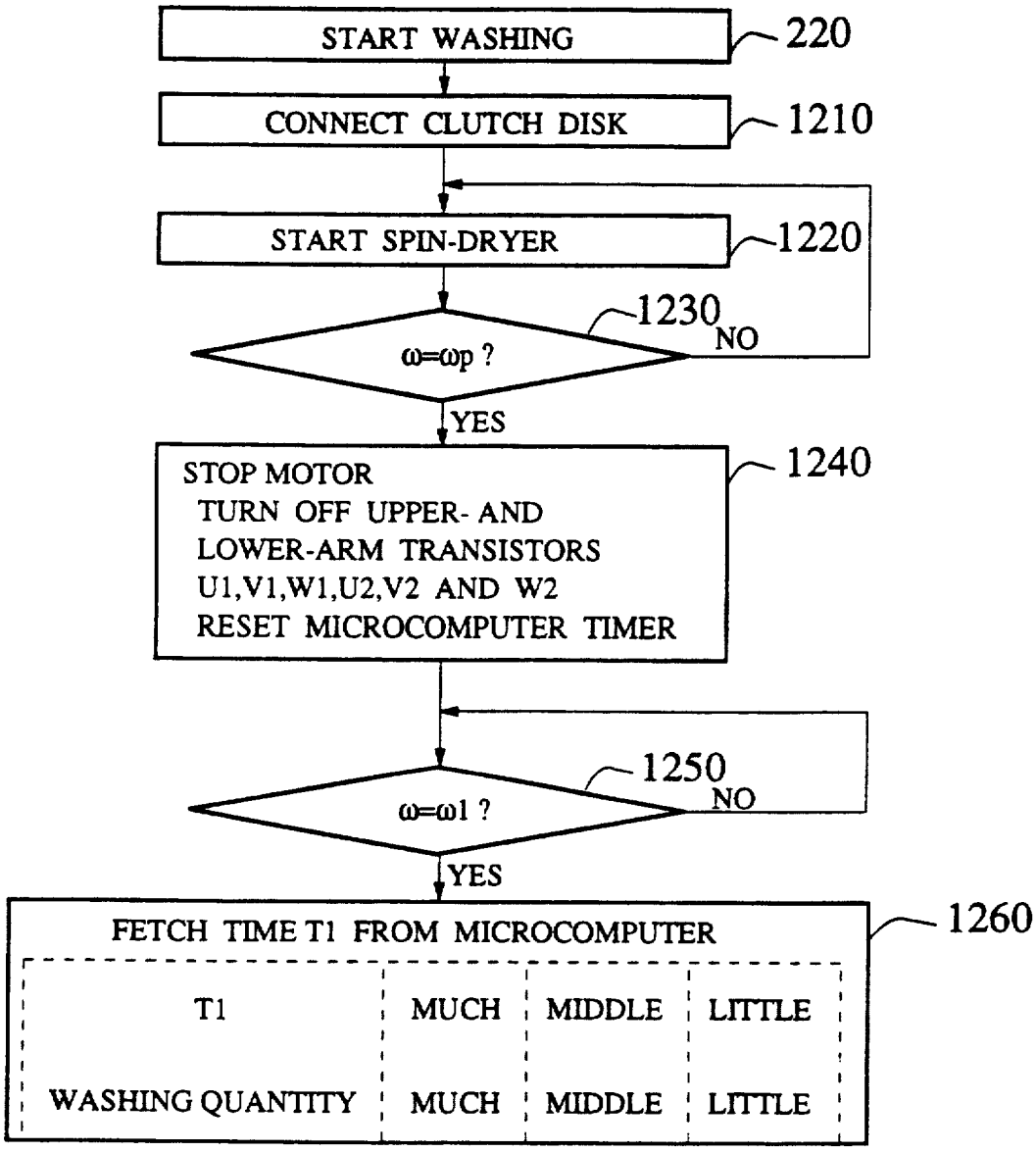
FIG. 14 is a flowchart showing the first washing quantity detection method.

FIG. 14 is a flowchart showing the first washing quantity detection method.

In step 220, a user pushes the start button of the washing machine. Step 1210 operates the clutch 57 so that the motor 5 drives the spin basket 3 and pulsator 4 together in step 1220. Step 1230 tests whether or not the revolution speed, i.e., angular speed $\omega$ of the motor 5 has reached a set value $\omega p$. If the speed $\omega p$ is attained, step 1240 turns OFF the upper and lower arm transistors U1, V1, W1, U2, V2, and W2 of the inverter circuit 17, to stop a drive voltage to the motor 5. Then, the motor 5 freely turns due to inertia. At the same time, the step 1240 resets and starts a soft timer in the microcomputer 26.

Step 1250 sees whether or not the motor 5 has reached a set angular speed $\omega 1$. If YES, step 1260 fetches time T1 counted by the soft timer of the microcomputer 26 and looks up a table set in a memory of the microcomputer 26, to determine a washing quantity according to the time T1. An example of the table is shown in the step 1260 in FIG. 14. The washing quantity will be determined as one of the "much," "middle," and "little" depending on whether the time T1 is "much," "middle," or "little."

A second washing quantity detection method according to the present invention will be explained.

This method drives the motor 5 up to a given constant speed, lets the motor freely run by inertia, measures a current generated by a counter electromotive force produced in the coils of the motor 5, and counts a period from the start of the free run of the motor 5 up to a disappearance of the current. According to the measured period, the method computes a washing quantity.

A third washing quantity detection method according to the present invention will be explained.

This method turns the motor 5 in a first direction at a given speed and then suddenly turns the motor 5 in the opposite direction at the same speed. The motor 5 tries to turn in the first direction due to inertia, and therefore, produces a counter electromotive force. The method measures a combination of a current due to the counter electromotive force and a control current for the opposite rotation. The method then measures a period from the start of the opposite rotation of the motor 5 up to when the combined current reaches a steady current. According to the measured period, a washing quantity is computed.

Returning to FIG. 12*a*, the step 230 determines, after determining the washing quantity, a water level LWs appropriate to the washing quantity according to a table stored in the microcomputer 26. Table 2 shows an example of the table showing a relationship among load torque Tj (or the measured time T1), a washing quantity, and a water level LWs.

TABLE 2

| Tj | Washing qty. | Water level (LWs) |
|---|---|---|
| Small | Little | Low |
| Middle | Middle | Middle |
| Large | Much | High |

Once the step 230 determines the water level LWs according to the detected washing quantity, the microcomputer 26 determines whether or not the washing machine has an optional detergent charger in step 240.

If it has, step 250 automatically charges detergent into the spin basket 3 according to the washing quantity and water level LWs.

If there is no detergent charger, the step 260 displays a quantity of detergent appropriate to the washing quantity and water level LWs, and a user puts detergent of the displayed quantity into the washing machine.

In step 270, the microcomputer 26 opens the feed valve 84 to feed water into the washing machine. During this period, the motor 5 continuously or intermittently turns the spin basket 3 at low speed. The microcomputer 26 monitors the torque of the motor 5 during the water feeding and measures a water feeding period with the soft timer.

Water is filled at first on the bottom of the washing tub 2 under the spin basket 3. Until water reaches the bottom of the spin basket 3, load on the motor 5, i.e., the torque of the motor 5 is relatively small. When water in the washing tub 2 reaches the bottom of the spin basket 3, the torque of the motor 5 suddenly increases. Using this phenomenon, the microcomputer 26 monitors the torque of the motor 5 and detects, in step 280, the time when water reaches the bottom of the spin basket 3.

Alternatively, a sudden increase in the ON-duty ratio of the PWM signal provided by the PWM oscillator 25 may be used to detect that water has reached the bottom of the spin basket 3. When water reaches the bottom of the spin basket 3, the load, i.e., torque of the motor 5 increases. To compensate this increase and maintain the revolution speed of the motor 5, the microcomputer 26 changes a voltage applied to the motor 5 by changing the ON-duty ratio of the PWM signal. Accordingly, detecting a sudden change in the ON-duty ratio of the PWM signal is effective to detect the time when water reaches the bottom of the spin basket 3.

Figure 15:
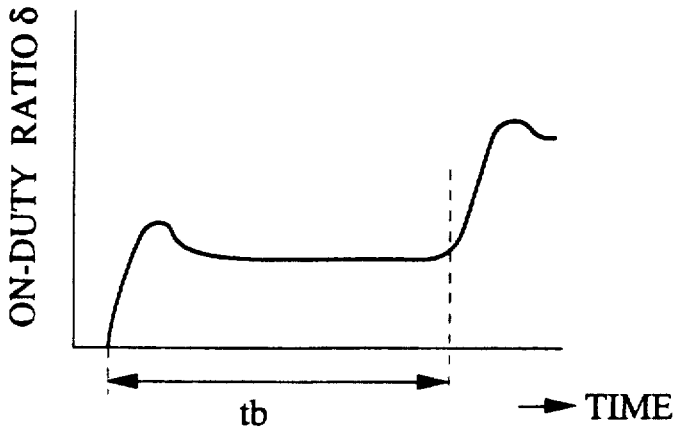
FIG. 15 shows the ON-duty ratio $\delta$ of a PWM signal that suddenly increases when a water level reaches the bottom of a spin basket of the washing machine.

FIG. 15 shows such change in the ON-duty ratio of the PWM signal. During a period tb, the level of water in the washing tub 2 continuously rises and finally reaches the bottom of the spin basket 3, and then the ON-duty ratio of the PWM signal sharply rises.

The period tb from the start of feeding water until water reaches the bottom of the spin basket 3 is measured by the soft timer of the microcomputer 26. A water quantity Wb up to the bottom of the spin basket 3 in the washing tub 2 is known from the design data of the washing machine. A water feed speed Sw is calculated as follows:

$$Sw = Wb/tb$$

When water reaches the bottom of the spin basket 3, the microcomputer 26 stops the spin basket 3 and continuously feeds water to a low level LW1 at which the microcomputer 26 detects cloth characteristics. Namely, the microcomputer 26 calculates a difference dW between the bottom of the spin basket 3 and the low water level LW1 and then computes a period Tr necessary for feeding water up to the low water level LW1 as follows:

$$Tr = dW/Sw$$

According to the period Tr, steps 280 and 290 feed water up to the water level LW1 at which the cloth characteristics are detected.

Generally, the cloth characteristics are detectable if the washing are partly or completely soaked in water. This embodiment of the present invention tests the cloth characteristics at the low water level LW1.

When water reaches the level LW1, step 300 closes the feed valve and starts the cloth characteristics detection.

The spin basket 3 is stopped, and only the pulsator 4 is turned. The cloth characteristics are then found according to the load torque or revolution speed of the motor 5 and the washing quantity obtained in the step 230.

The torque of the motor 5 used here may be starting torque occurring when the motor 5 is driven in a forward or reverse direction, torque obtained at a given time point during forward and reverse rotations, or mean torque of a given period during forward and reverse rotations.

The revolution speed of the motor 5 used here may be a motor speed at given time after the start of the motor with a voltage applied to the motor being unchanged, or a final revolution speed. The revolution speed is used to measure load torque Tq in the washing tub 2. According to the washing quantity and load torque Tq, cloth characteristics are found in Table 3.

TABLE 3

| | Small qty. | Medium qty. | Large qty. |
|---|---|---|---|
| Small Tq | | | Soft |
| Medium Tq | | Standard | |
| Large Tq | Hard | | |

A first cloth characteristics detection method according to the present invention will be explained.

This method fills water up to the low level LW1 in the spin basket 3 containing the washing. The method measures a starting voltage of starting torque of the motor 5 for driving only the pulsator 4, and according to the starting voltage or torque and the washing quantity previously obtained, finds the cloth characteristics.

The cloth characteristics are expressed as "soft,""standard,""hard," etc. When the cloth characteristics are soft, the pulsator 4 receives little resistance. Accordingly, the torque of the motor 5 for driving the pulsator 4 may be small. When the cloth characteristics are hard, the pulsator 4 receives large resistance, so that the torque of the motor 5 must be large.

Figures 16, 17:
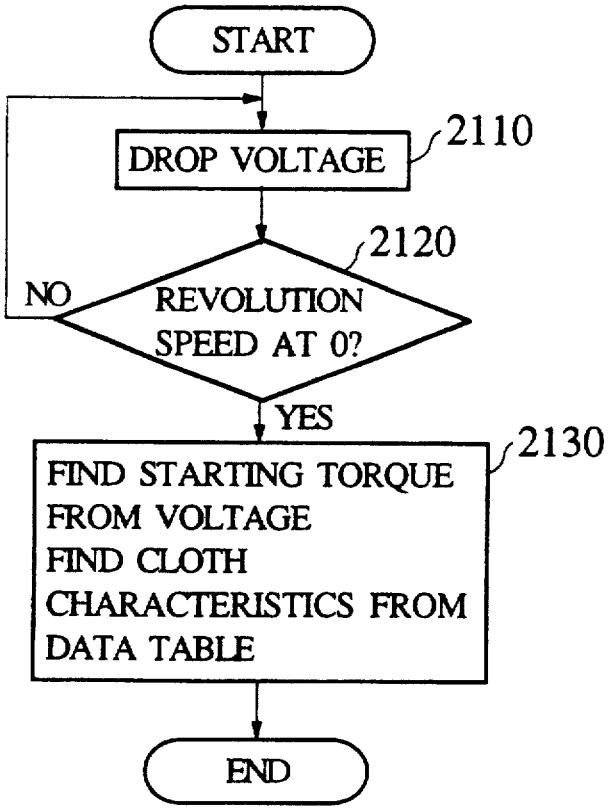
FIG. 16 is a table showing a relationship among cloth characteristics, resistance on a pulsator, and the torque of the motor.
FIG. 17 is a flowchart showing a first cloth characteristics detection method.

FIG. 16 is a table showing a relationship among the cloth characteristics, resistance on the pulsator 4, and the torque of the motor 5. The resistance involves friction among the washing, pulsator 4, and spin basket 3. As the cloth characteristics become harder, the pulsator 4 receives larger resistance. Accordingly, the torque of the motor 5 must be larger. The resistance of the pulsator 4 momentarily reaches a highest value when the pulsator 4 starts to turn.

In this way, the cloth characteristics are identifiable according to the resistance of the pulsator 4, and this resistance is measurable from the torque of, a current flowing to, a voltage applied to, and the revolution speed of the motor 5.

FIG. 17 is a flowchart showing the first cloth characteristics detection method.

With the spin basket 3 containing the washing and water up to the low level LW1, step 2110 gradually increases a voltage applied to the motor 5 to turn only the pulsator 4. Step 2120 detects the revolution speed of the motor 5. When the motor 5 starts to turn, step 2130 measures the voltage presently applied to the motor, calculates starting torque according to the voltage, and looks up the Table 3 to find cloth characteristics corresponding to the starting torque and washing quantity.

Figure 18:
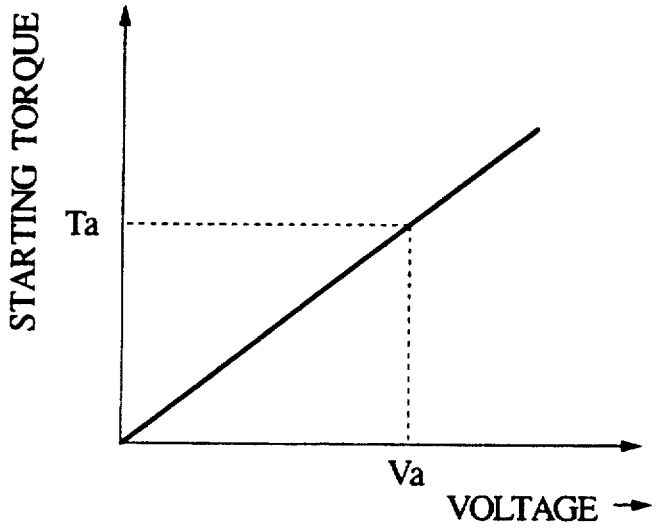
FIG. 18 shows a relationship between the voltage and starting torque of the brushless DC motor.

FIG. 18 is a graph showing a relationship between a voltage applied to the motor 5 and starting torque. This graph will change depending on the characteristics of the motor 5. The graph tells that starting torque is obtainable according to a measured voltage, if the characteristics of the motor are known.

Figure 19:
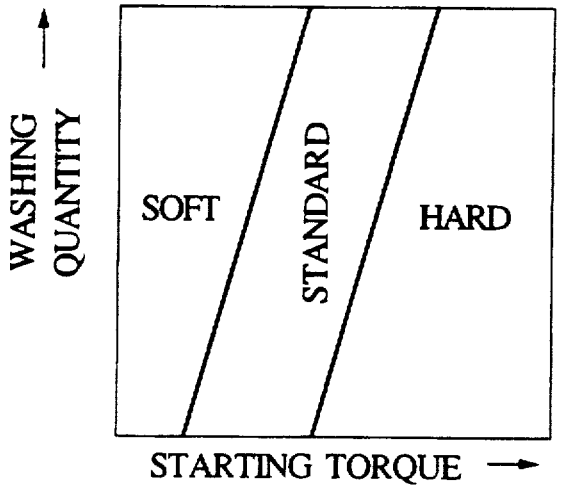
FIG. 19 shows relationships among a washing quantity, starting torque, and cloth characteristics.

FIG. 19 shows a relationship among a washing quantity, starting torque, and cloth characteristics. When the cloth characteristics are soft, the starting torque is small, and when they are hard (stiff), the starting torque is large. The relationship between the cloth characteristics and the starting torque differs depending on the washing quantity. Namely, when the cloth characteristics are unchanged, the starting torque will change according to the washing quantity.

FIG. 20 is a table showing a relationship among a washing quantity, starting torque, and cloth characteristics. In the table, T00 to T22 indicate different pieces of starting torque.

According to the starting torque obtained in the step 2130 of FIG. 17, the washing quantity, and the data table of FIG. 20, cloth characteristics are determined. For example, when the motor 5 starts to turn with an applied voltage of Va, the starting torque of the motor is obtained as Ta from FIG. 18. If the starting torque Ta is close to T12 in the table of FIG. 20 and if the washing quantity is an intermediate one, the cloth characteristics are determined to be hard (stiff).

FIG. 21 shows a table similar to that of FIG. 20 but employs a voltage applied to the motor 5 instead of the starting torque of the motor 5. Namely, FIG. 21 shows a relationship among a washing quantity, a voltage applied to the motor 5, and cloth characteristics. The cloth characteristics of the washing are determined according to this table, a voltage with which the motor 5 starts to turn, and the detected washing quantity. For example, if the motor 5 starts to rotate with a voltage of Va, which may be close to a voltage V12 in the table of FIG. 21, and if the washing quantity is an intermediate one, the cloth characteristics will be determined to be hard (stiff).

Second to fourth cloth characteristics detection methods according to the present invention will be explained.

The second cloth characteristics detection method finds a starting current of the motor 5, and according to the starting current and the washing quantity previously obtained, determines the cloth characteristics.

The third cloth characteristics detection method applies a predetermined voltage to the motor 5 and measures after a given period the revolution speed of the motor 5 that drives the pulsator 4. According to the revolution speed, or torque corresponding to the revolution speed, this method determines the cloth characteristics.

The fourth cloth characteristics detection method applies a predetermined voltage to the motor 5 and measures a period during which the revolution speed of the motor 5 that drives the pulsator 4 reaches a set value. According to the period, this method determines the close characteristics.

Referring again to FIG. 12a, step 310 determines an optimum water level according to the washing quantity and cloth characteristics detected. At the same time, the step 310 determines a washing period, a water quantity, a target dry rate at the end of washing, and a target dry rate at the end of rinsing.

As explained before, the step 230 determines the water level LWs corresponding to the washing quantity. On the other hand, a correction level LWa or a correction coefficient LWc is determined according to the cloth characteristics. The washing level LWs is corrected according to the LWa or LWc, to provide a final washing water level LWo as follows:

$$LWo = LWs + LWa, \text{ or}$$

$$LWo = LWs \times LWc$$

Tables 4 and 5 show a relationship among a washing quantity, cloth characteristics, and a correction level LWa, and a relationship among a washing quantity, cloth characteristics, and a correction coefficient LWc.

TABLE 4(a)

| | Small qty. | Middle qty. | Small qty. |
|---|---|---|---|
| Soft | Small LWa | | |
| Standard | | Medium LWa | |
| Hard | | | Large LWa |

TABLE 4(b)

| | Small qty. | Large qty. |
|---|---|---|
| Soft | Little Wo | Large Wo |
| Hard | Very little Wo | Medium Wo |

TABLE 5

| | Small qty. | Medium qty. | Large qty. |
|---|---|---|---|
| Soft | Small LWc | | |
| Standard | | Medium LWc | |
| Hard | | | Large LWc |

The Table 4(a) indicates that the correction level LWa increases as the washing quantity increases and as the cloth characteristics change from soft to hard.

The Table 4(b) shows a relationship among a final washing water level LWo obtained by correcting the water level LWs by the correction water level LWa, a washing quantity, and cloth characteristics. In the Table 4(b), "Wo" is a final washing water quantity corresponding to the final washing level LWo.

The Table 5 indicates that the correction coefficient LWc increases as the washing quantity increases and as the cloth characteristics change from soft to hard.

Once the final water level LWo is determined, step 320 feeds water up to the water level LWo. To surely feed water up to the level LWo, steps 330 and 340 regularly detect a water level.

The water level may be detected according to a water feed speed and the quantity of fed water, or according to load torque produced by the spin basket 3 that varies according to the water level. Here, the load torque may be detected as the starting torque of the motor 5, the torque of the motor 5 running at a given speed, the revolution speed of the motor 5 driven at fixed torque, or a period from the start of free run at a fixed speed to a given reduced speed or to a stoppage of the motor 5.

A first water level detection method according to the present invention will be explained. This method finds a water level according to a water feed speed and the quantity of fed water.

As explained before, the step 290 feeds water up to the low level LW1 to detect the cloth characteristics. Accordingly, steps 320 to 340 may feed water of a remaining quantity dWr corresponding to a difference between the final water level LWo and the low water level LW1. This remaining quantity dWr is obtained by deducting the low quantity W1 from the final quantity Wo.

The step 290 calculates the water feed speed Sw to feed water up to the low level LW1. Water of the remaining quantity dWr is fed at this speed Sw, and a water feed period tro for the quantity dWr is calculated as follows:

$$tro = dWr/Sw$$

Namely, water is filled in the spin basket 3 up to the final level LWo at the feed speed Sw for the period tro while the period is being monitored.

Figure 22A:
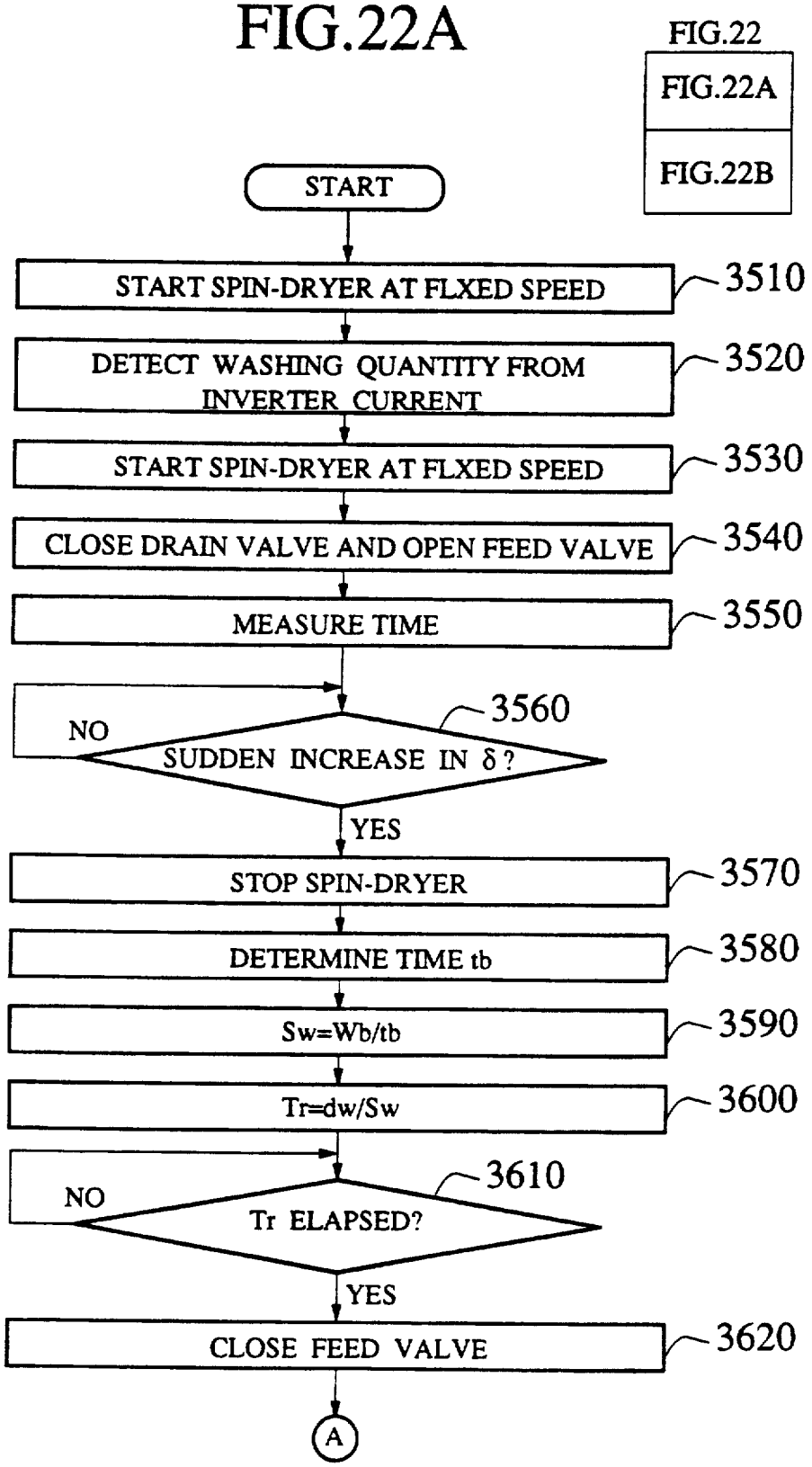
FIGS. 22*a*-22*b* make up a flowchart showing water feeding and level detecting processes.
Figure 22B:
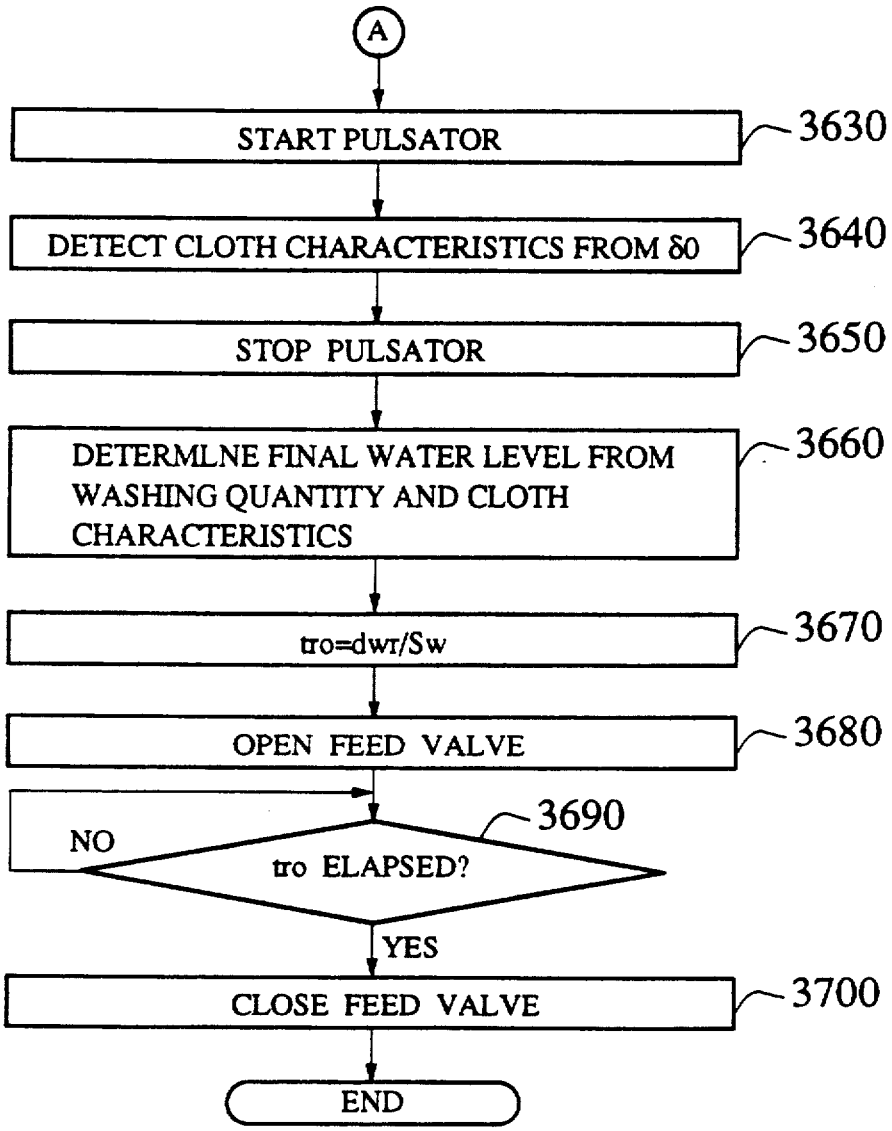

FIG. 22 is a flowchart showing the details of the first water level detection method.

Step 3510 and 3520 turn the spin basket 3 at a given speed, detect an inverter current to the motor 5, and compute a washing quantity according to the current.

Steps 3530 to 3620 feed water into the washing tub 2 and stop the spin basket 3 upon detecting a steep increase in the ON-duty ratio of the PWM signal (FIG. 15) as a sign that water has been filled up to the bottom of the spin basket 3. Thereafter, water is continuously filled at a speed of Sw for a period Tr up to the low level LW1 and then the feed valve is closed.

Steps 3630 to 3650 detect cloth characteristics at the low water level LW1 according to the ON-duty ratio of the PWM signal at the start of the motor 5.

Steps 3660 to 3700 find the final level LWo according to the washing quantity and cloth characteristics, feed water up to the level LWo at the speed of Sw for the period tro, and close the feed valve.

Second to sixth water level detection methods according to the present invention will be explained.

The second water level detection method detects a water level according to the load torque of the basket 3.

The third water level detection method detects, at predetermined intervals, the torque of the motor 5 for starting the spin basket 3 while feeding water. According to a change in the starting torque, this method detects a water level.

The fourth water level detection method always applies a predetermined voltage to the motor 5 to turn the spin basket 3 while feeding water, and according to a change in the revolution speed of the motor 5, detects a water level.

The fifth water level detection method turns the spin basket 3 at a predetermined speed at predetermined intervals while feeding water, freely runs the motor 5, measures a period tw during which the speed of the motor 5 decreases to a predetermined value, and according to a change in the period tw, computes a water level.

The sixth water level detection method employs a diaphragm to detect a water pressure, and according to the water pressure, detects a water level.

Once water is filled to the final water level LWo, a washing period is found in Table 6 according to the washing quantity and cloth characteristics.

TABLE 6

| | Small qty. | Medium qty. | Large qty. |
|---|---|---|---|
| Soft | Short washing | | |
| Standard | | | |
| Hard | | | Long washing |

As shown in the table, the washing period is short when the washing quantity is small and the cloth characteristics are soft. The washing period is long when the washing quantity is large and the cloth characteristics are hard (stiff).

A water flow for washing in the spin basket 3 will be explained.

The water flow is determined according to a period tr for turning the pulsator 4 by the motor 5 in a forward or reverse direction and the speed n of the motor 5. The flow is also determined according to the washing quantity and cloth characteristics, as shown in Table 7.

TABLE 7

| | Small qty. | Medium qty. | Large qty. |
|---|---|---|---|
| Soft | Weak flow | | |
| Standard | | | |
| Hard | | | Strong flow |

A weak water flow is selected when the washing quantity is little and the cloth characteristics are soft, and a strong flow is selected when the washing quantity is large and the cloth characteristics are hard, according to the Table 7.

The period tr for turning the pulsator 4 in a forward or reverse direction and the revolution speed n of the motor 5 are determined according to the washing quantity and cloth characteristics as shown in Tables 8 and 9.

TABLE 8

| | |
|---|---|
| Small qty. | Short tr |
| Medium qty. | ↓ |
| Large qty. | Long tr |

TABLE 9

| | |
|---|---|
| Soft | Slow n |
| Medium | ↓ |
| Hard | Fast n |

The strength of a water flow is determined according to a combination of the turning period tr and revolution speed n of the motor 5 as shown in Table 10.

TABLE 10

| | Short tr | Medium tr | Long tr |
|---|---|---|---|
| Slow n | Weak flow | | |
| Medium n | | | |
| Fast n | | | Strong flow |

FIG. 9 shows the turning period tr, speed n, and torque of the motor 5. In the figure, "ts" is an interval between adjacent forward and reverse turning periods.

Returning to FIG. 12a, step 310 sets a target dry rate for the end of washing and a target dry rate for the end of rinsing, in addition to the final water level LWo, washing period, and water flow. This enables a user to optionally set dry rates depending on the kind of laundry before starting a washing operation. This prevents excessive spin-drying and wrinkles on the laundry.

In this way, the steps 310 to 340 determine the final water level LWo, washing period, water flow, target dry rates and feed water up to the final water level LWo.

Step 350 starts washing. The microcomputer 26 controls the clutch 57 of the clutch mechanism 82, to disconnect the motor 5 from the spin basket 3. At the same time, the microcomputer 26 drives the motor 5 at the determined revolution speed n for the determined period tr in forward and reverse directions alternately through the motor control circuit 24, upper arm drive circuit 21, lower arm drive circuit 22, and inverter circuit 17. The torque of the motor 5 is transmitted only to the pulsator 4. As a result, a flow determined by the speed n and period tr is generated in the spin basket 3, to wash the washing in the spin basket 3 for the wash period.

As shown in the step 121 of FIG. 11, the washing operation is carried out while detecting entanglement of the washing, disentangling the washing, detecting damage to the washing, and protecting the washing. These entangle detection, disentangling, damage detection, and damage prevention are also carried out during the first and second rinse stages.

Step 360 of FIG. 12a detects whether or not the washing are entangling with one another. If the they are entangling, step 370 disentangles the washing.

When the motor is driven at the speed n to wash and rinse the washing, the washing may entangle with one another. The entanglement (twist) of the washing differs load on the motor 5 in the entangling (twisting) direction from that in the disentangling (untwisting) direction. Namely, load on the motor 5 in the entangling direction is greater than in the disentangling direction. Accordingly, the entanglement is detectable according to a change in load on the motor 5 in opposite rotations.

The microcomputer 26 tries to drive the motor 5 at the revolution speed n even if the load fluctuates, by changing a voltage applied to the motor 5, i.e., by changing the ON-duty ratio of the PWM signal according to changes in the load, i.e., torque. While the motor 5 is being driven at the speed n, the condition and direction of entanglement of the washing are detectable by detecting a change in the torque, voltage, inverter current, or ON-duty ratio of the motor 5 in opposite rotations.

A first entanglement detection method according to the present invention will be explained with reference to FIGS. 23a and 23b.

This method measures a maximum torque Tmax(CW) of the motor 5 in a forward rotation (CW) and a maximum torque Tmax(CCW) in a reverse rotation (CCW). The method then finds the condition and direction of entanglement according to a difference DTmax between the Tmax(CW) and Tmax(CCW).

To measure the maximum torque values Tmax(CW) and Tmax(CCW), the microcomputer 26 drives the motor 5 at the given speed n and computes a maximum ON-duty ratio δmax(CW) of the PWM signal for a forward rotation and a maximum ON-duty ratio δmax(CCW) for a reverse rotation. The microcomputer 26 updates and holds a largest maximum δmax(CW)max among the maximum values δmax(CW) and a largest maximum δmax(CCW)max among the maximum values δmax(CW). These largest maximum values are used to detect the condition and direction of entanglement.

Figure 23A:
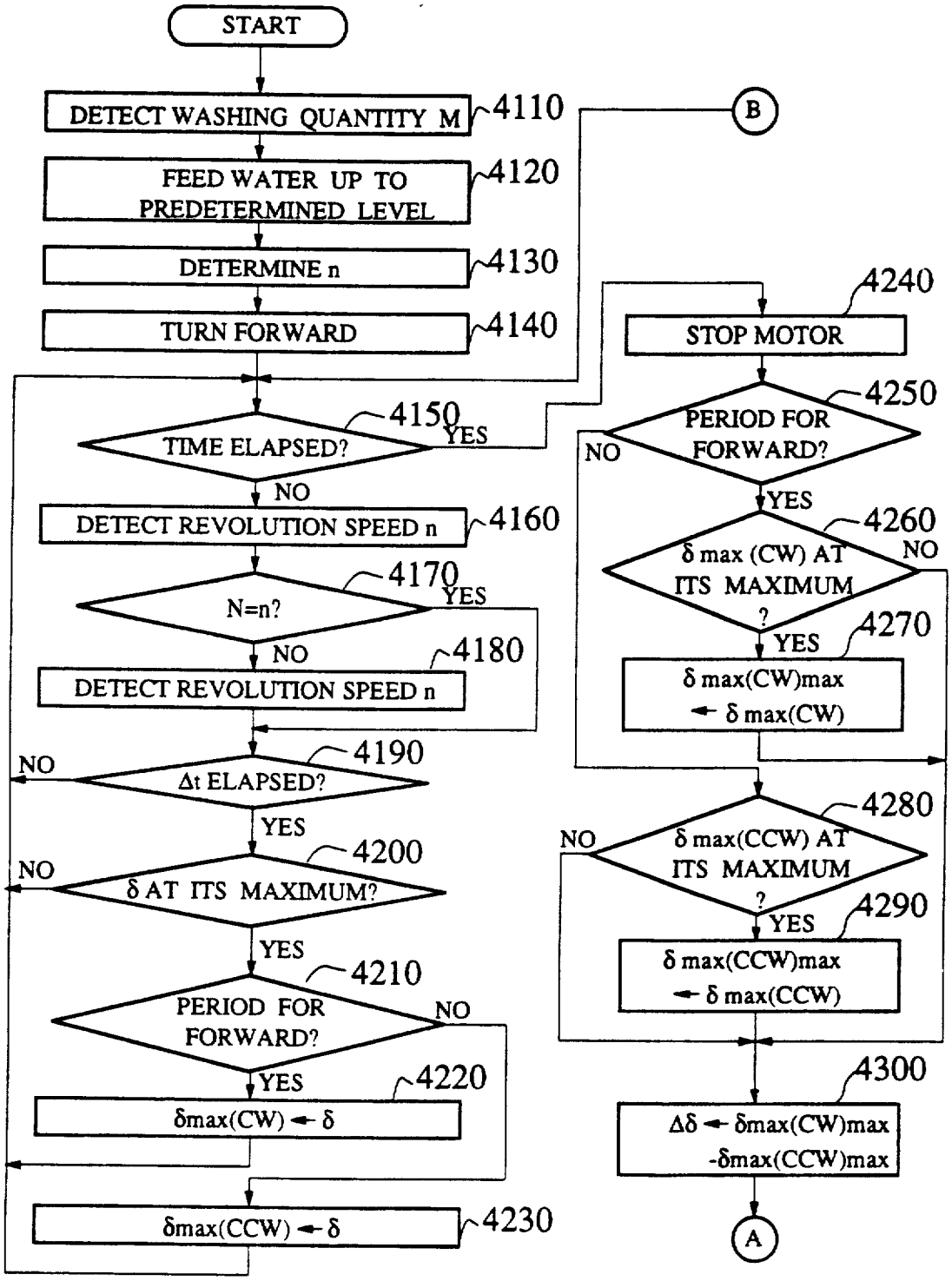
FIGS. 23*a* and 23*b* are flowcharts showing a first entanglement detection method.

Steps 4110 to 4130 in FIG. 23a detect a washing quantity, feeds water up to a final level LWo, and determine a water flow and a speed n, as explained before. A washing period, a forward/reverse operation period tr, etc., are also determined as explained before.

In step 4140, the microcomputer 26 provides the motor control circuit 24 with a start signal and a forward rotation signal. To drive the motor 5 at the speed n, the microcomputer 26 lets the PWM oscillator 25 provide a PWM signal of proper ON-duty ratio δ, which is supplied to the motor 5 through the chopper circuit 27, upper arm drive circuit 21, and inverter circuit 17. As a result, the motor 5 runs at the speed n in the forward direction.

Step 4150 determines whether or not the forward operation period has elapsed. Step 4160 detects the revolution speed N of the motor 5. Step 4170 determines if the speed N is equal to the given speed n. If they are not equal, step 4180 changes the ON-duty ratio δ of the PWM signal through the microcomputer 26, to equalize them.

When the speeds N and n are equalized, step 4190 sees whether a period Δt has elapsed. If not, the flow returns to the step 4150. If the period has elapsed, step 4200 tests if the ON-duty ratio δ of the PWM signal is maximum. If not, the flow returns to the step 4150. If it is maximum, step 4210 tests if it is a forward period.

If it is the forward period, step 4220 sets the ON-duty ratio δ detected in the step 4200 as the maximum δmax(CW). If it is not the forward period, it must be a reverse period so that step 4230 sets the ON-duty ratio δ as the maximum δmax(CCW). The flow returns to the step 4150. During the forward period, these steps are repeated to detect the maximum δmax(CW) for this forward period.

In the above explanation, the steps 4150 to 4230 detect the maximum value δmax(CW) for a forward period. When the steps 4150 to 4230 are started after step 4410 of FIG. 23b, these steps detect the maximum value δmax(CCW) for a reverse period.

Consequently, the steps 4150 to 4230 detect and update the maximum values δmax(CW) and δmax(CCW) for forward and reverse periods.

When the forward or reverse period ends, step 4240 stops the motor 5. Step 4250 sees whether it was a forward period. If it was, step 4260 checks to see whether the maximum value δmax(CW) updated in the step 4220 is largest. If it is largest, step 4270 sets the value as the largest maximum value δmax(CW)max.

If the step 4250 determines that it was a reverse period, step 4280 checks to see whether the maximum value δmax(CCW) updated in the step 4230 is largest. If it is largest, step 4290 sets the value as the largest maximum value δmax(CCW)max.

In this way, the largest maximum values δmax(CW-)max and δmax(CCW)max are determined. Step 4300 calculates a difference Δδ between them as follows:

$$\Delta\delta = \delta max(CW)max - \delta max(CCW)max$$

Figure 24:
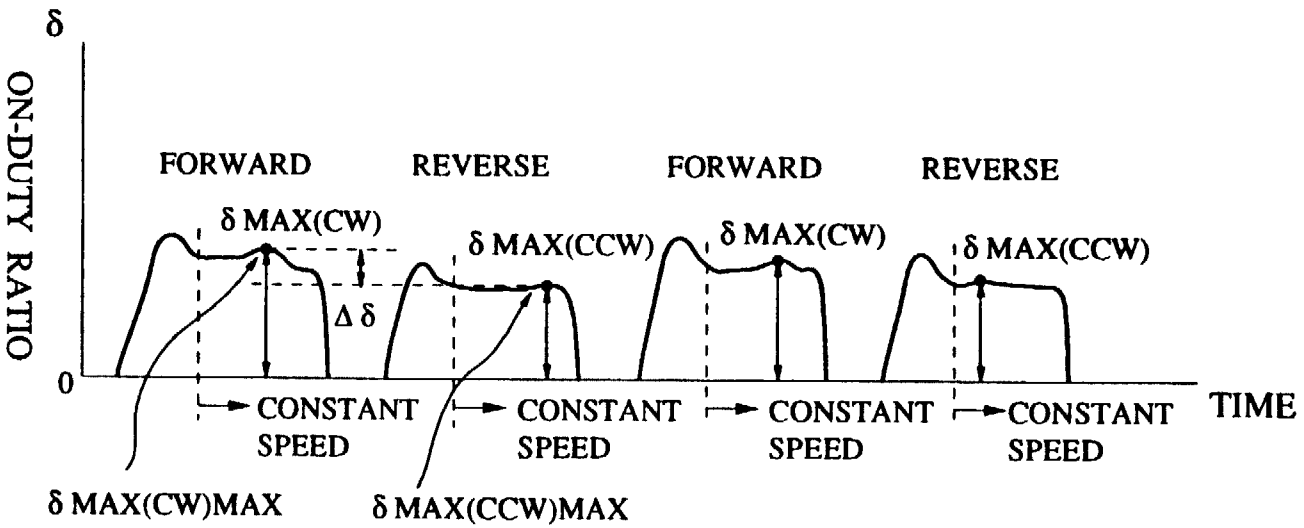
FIG. 24 shows changes in the ON-duty ratio $\delta$ of a PWM signal for forward and reverse rotations according to the first entanglement detection method.

FIG. 24 shows changes in the ON-duty ratio δ in both rotational directions, δmax(CW)max, δmax(CCW)max, and Δδ.

Figure 23B:
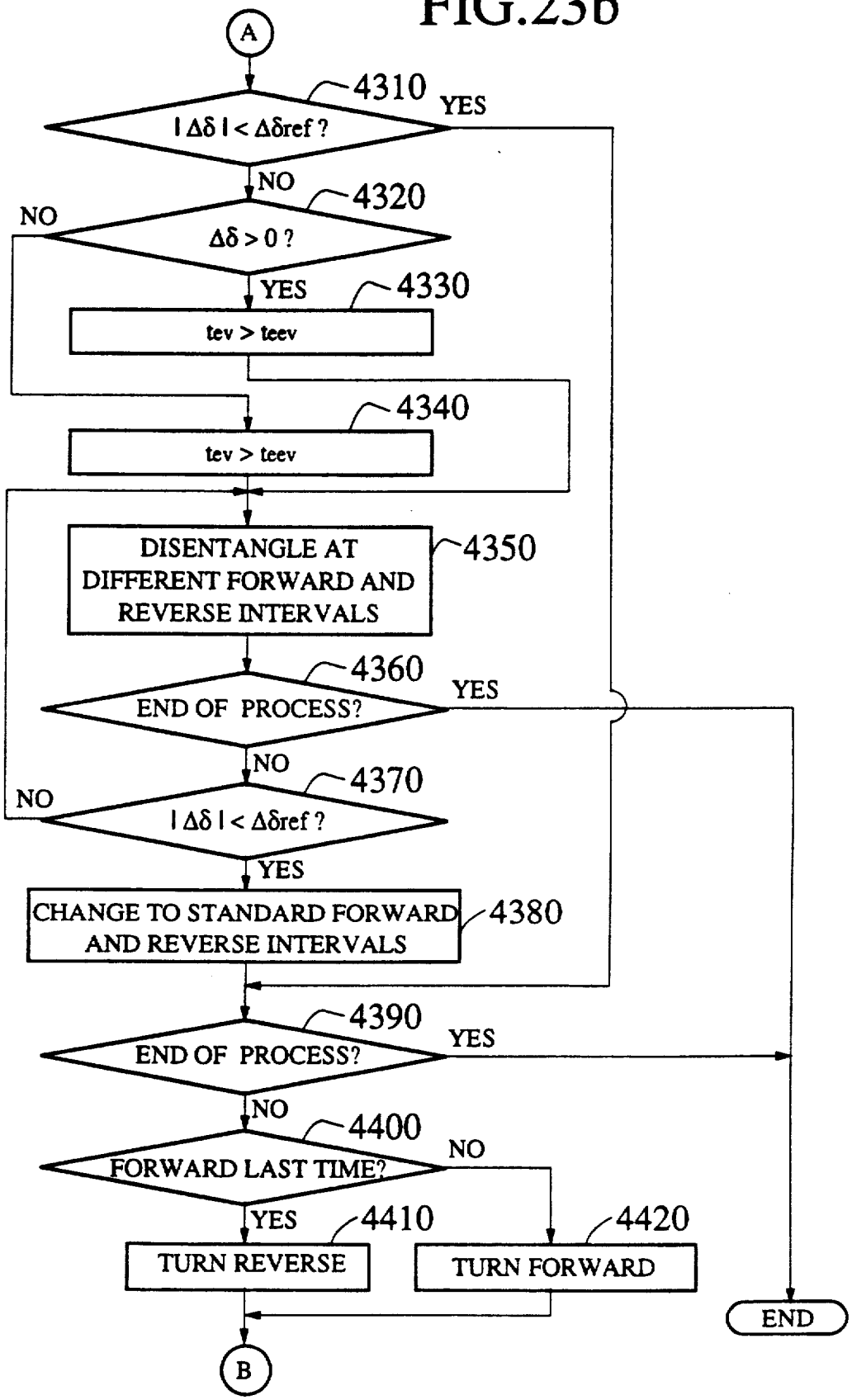

Step 4310 of FIG. 23*b* sees if the absolute value of the difference Δδ is smaller than a reference value Δδref.

If it is smaller than the reference value, there will be no entanglement. Then, step 4390 determines if the entanglement detection process has been completed. If not, step 4400 checks to see if the last rotation was forward. If it was forward, step 4410 starts to drive the motor 5 in the reverse direction, and the flow returns to the step 4150 of FIG. 23*a* to repeat the above operations.

If the absolute difference Δδ is greater than the reference value Δδref, there will be entanglement. Step 4320 determines if the difference Δδ is greater than zero to determine the direction of the entanglement. If the difference Δδ is greater than zero, i.e., if the difference is positive, the entanglement is forward entanglement. Accordingly, a reverse period tccw of the motor 5 is set to be longer than a forward period tcw of the motor 5, to disentangle the washing in steps 4330 and 4350.

If the difference Δδ is smaller than zero, i.e., negative, the entanglement is in the reverse direction. Accordingly, the positive period tcw of the motor 5 is set to be longer than the reverse period tccw, to disentangle the washing in steps 4340 and 4350.

Step 4360 sees whether the disentanglement process has been completed. If not, step 4370 continues the disentangling operation of the step 4350 until the absolute value of the difference Δδ becomes smaller than the reference value Δδref.

When the absolute difference Δδ becomes smaller than the reference value Δδref, step 4380 returns the forward and reverse periods to normal ones. If the entanglement detection process is not complete, step 4400 checks to see whether the last rotation was forward. If it was, step 4410 starts a reverse rotation. If it was not forward, step 4420 starts a forward rotation. Then, the flow goes to the step 4150 of FIG. 23*a* to repeat the above steps.

A second entanglement detection method according to the present invention will be explained.

This method employs an inverter current flowing to the motor 5 instead of the ON-duty ratio δ of the PWM signal employed by the first entanglement detection method.

Figure 25A:
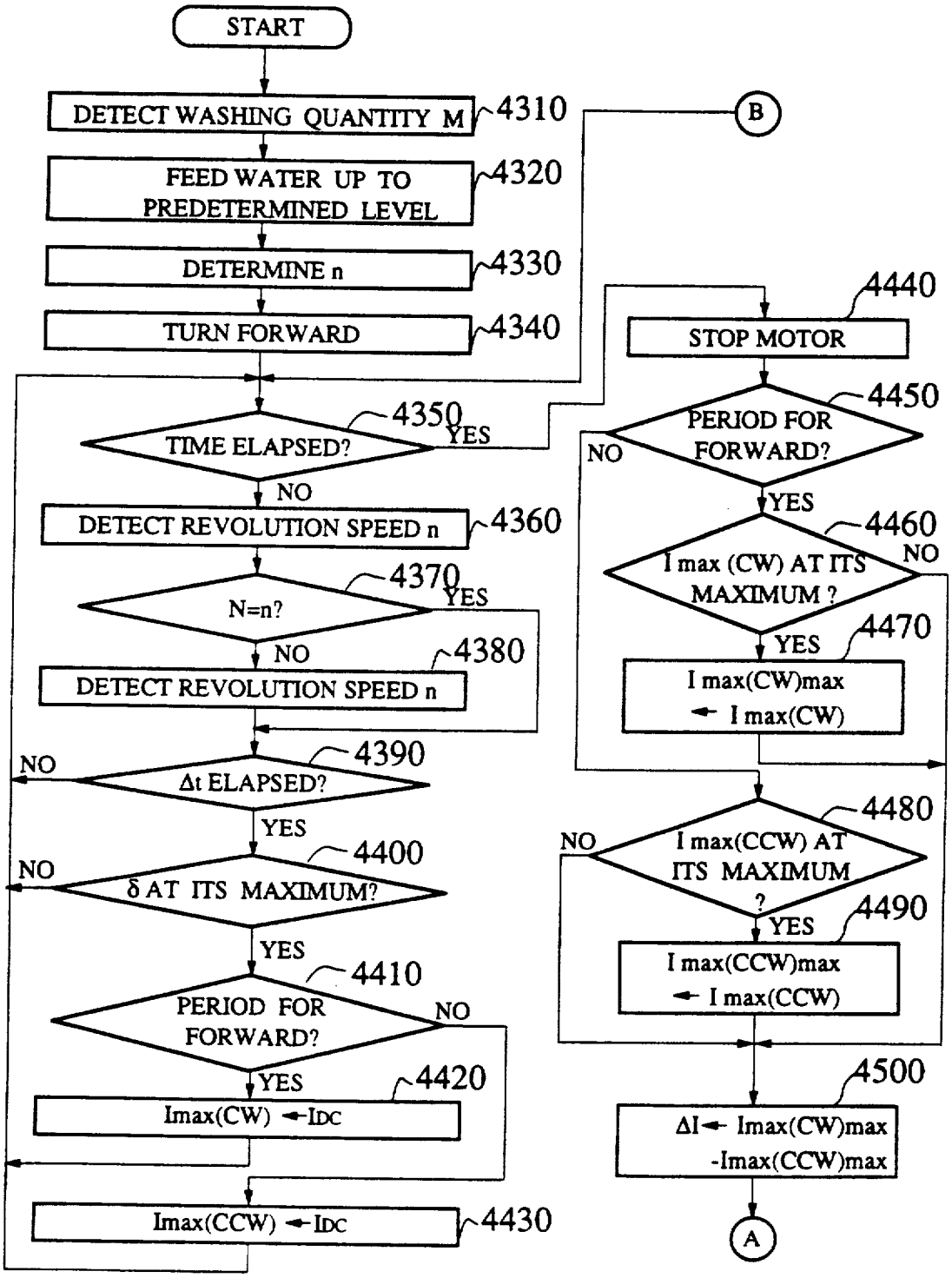
FIGS. 25*a* and 25*b* are flowcharts showing a second entanglement detection method.
Figure 25B:
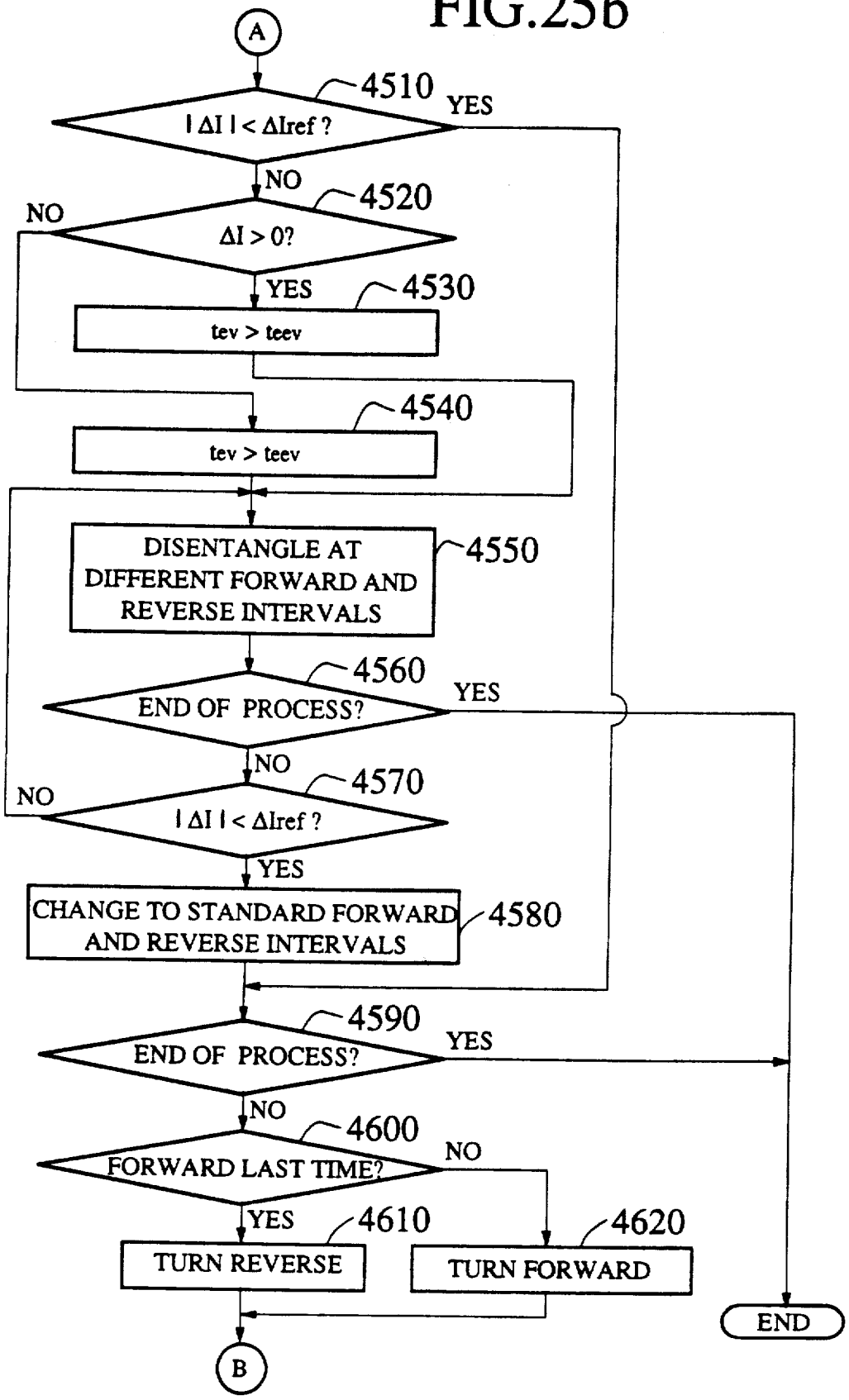

FIGS. 25*a* and 25*b* are flowcharts showing the second entanglement detection method. Operational steps of the second method are basically the same as those of the first method FIGS. 23*a* and 23*b* except that the second method employs the inverter current I instead of the ON-duty ratio δ of the PWM signal. Accordingly, the detailed explanation of the second method will be omitted.

In FIGS. 25*a* and 25*b*, maximum inverter currents Imax(CW) and Imax(CCW) correspond to the maximum torque values δmax(CW) and δmax(CCW), respectively. Similarly, largest maximum inverter currents Imax(CW)max and Imax(CCW)max correspond to the largest maximum torque values δmax(CW)max and δmax(CCW)max, respectively.

Figure 26:
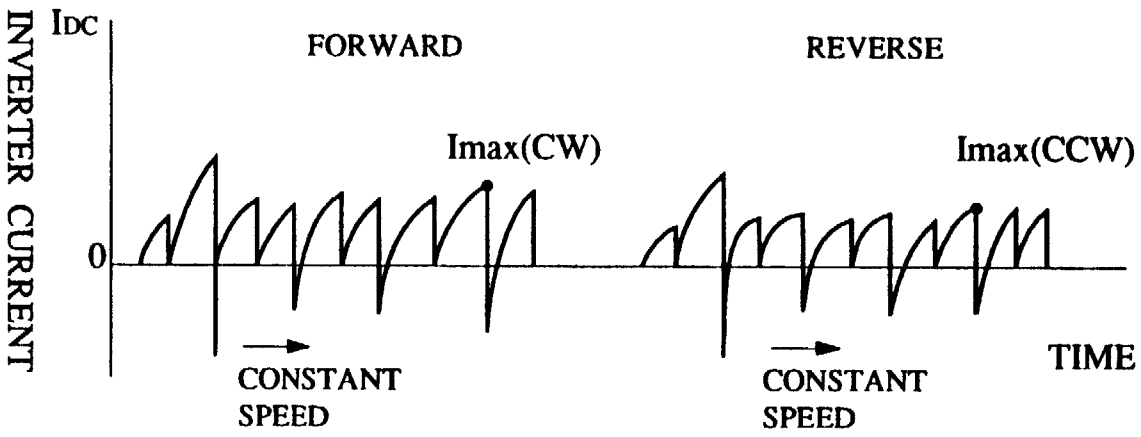
FIG. 26 shows changes in an inverter current applied to the brushless DC motor for forward and reverse rotations according to the second entanglement detection method.

FIG. 26 shows the maximum inverter currents Imax(CW)max and Imax(CCW)max, a difference ΔI between them, and changes in the inverter current I in forward and reverse rotations.

A third entanglement detection method according to the present invention will be explained.

This method employs average ON-duty ratios δave(CW) and δave(CCW) in forward and reverse rotation periods instead of the maximum ON-duty ratios δmax(CW) and δmax(CCW) of the first entanglement detection method. Other details of the third method are the same as those of the first method.

A fourth entanglement detection method according to the present invention will be explained.

This method employs average inverter current values Iave(CW) and Iave(CCW) in forward and reverse rotation periods instead of the maximum inverter current values Imax(CW) and Imax(CCW) of the second entanglement detection method. Other details of the fourth method are the same as those of the second method.

As explained above, the first to fourth entanglement detection methods disentangle the washing by shortening an operation period in an entangled direction. The washing may be disentangled by changing the revolution speed of the motor 5. Namely, the speed is decreased in an entangled direction and increased in a disentangling direction. The motor 5 may be turned only in the disentangling direction until the washing are completely disentangled without alternating the forward and reverse rotations.

A fifth entanglement detection method according to the present invention will be explained.

This method detects a peak-to-peak value ΔTp-p of the temporally changing torque of the motor 5 during a forward or reverse turn. In practice, this method detects, instead of the peak-to-peak value ΔTp-p, a peak-to-peak value Δδp-p of the temporally changing ON-duty ratio of the PWM signal. According to the magnitude of the peak-to-peak value Δδp-p of the ON-duty ratio, the method finds entanglement.

The method drives the motor 5 at the given speed n. If the washing quantity is unchanged, load on the motor 5 changes according to friction between the washing and the spin basket 3 or the pulsator 4.

Figure 27A:
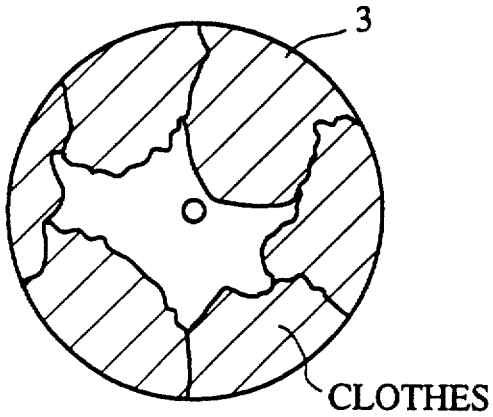
FIG. 27a shows unentangled washing in a spin basket.
Figure 27B:
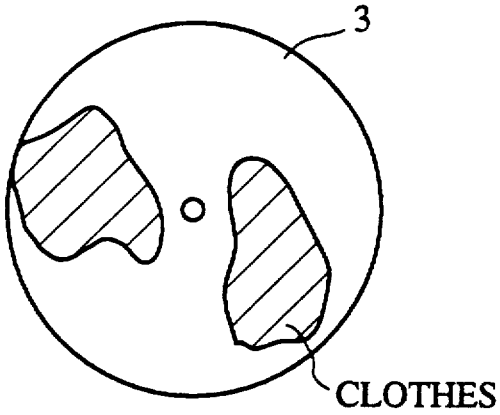
FIG. 27b shows entangled washing in a spin basket.

FIG. 27*a* shows a section of the spin basket 3 with the washing therein being unentangled, and FIG. 27*b* shows the same with the washing therein entangling.

When the washing are unentangled as shown in FIG. 27*a*, the washing uniformly spread in the spin basket 3, so that temporal changes in friction between the washing and the spin basket 3 or the pulsator 4 are small.

On the other hand, when the washing are entangling with one another as shown in FIG. 27*b*, the washing are not uniformly spread in the spin basket 3. Accordingly, friction between the washing and the spin basket 3 or the pulsator 4 temporally fluctuates depending on the positions of the washing in the spin basket 3. Namely, load torque T on the motor 5 fluctuates during washing and rinsing.

The microcomputer 26 maintains the revolution speed n of the motor 5 irrespective of fluctuations in the load torque of the motor 5, by changing the ON-duty ratio of the PWM signal in response to the load torque T, to change a voltage Vdc applied to the motor 5. Namely, entanglement of the washing is detectable by measuring temporal changes in the load torque of the motor 5, i.e., the voltage Vdc or the inverter current Idc applied to the motor 5 while the motor 5 is being driven at the given speed n.

Figure 28A:
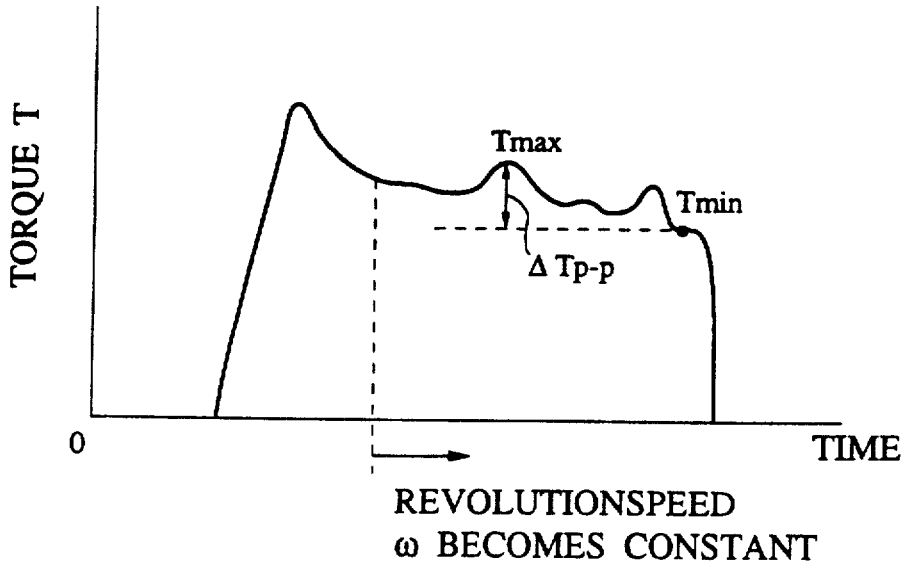
FIG. 28a shows temporal changes in the torque of the brushless DC motor according to a fifth entanglement detection method.
Figure 28B:
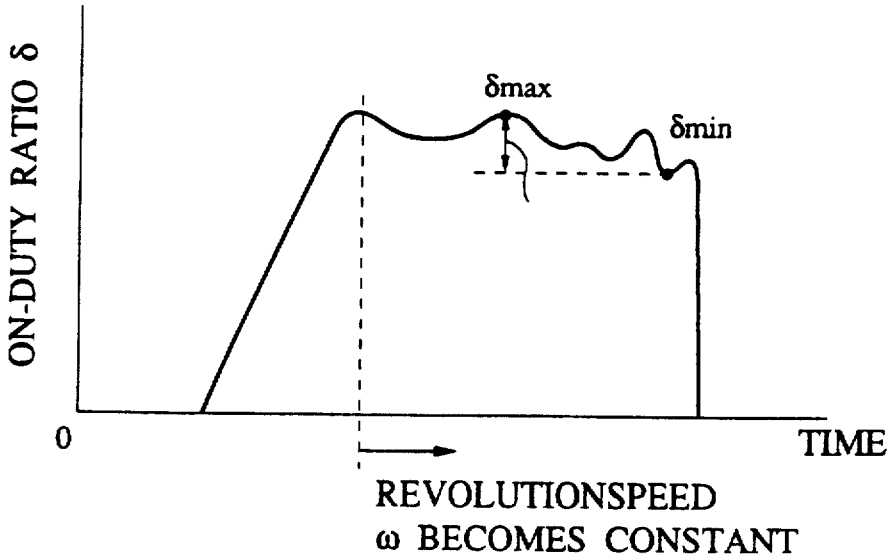
FIG. 28b shows temporal changes in the ON-duty ratio of a PWM signal according to the fifth entanglement detection method.

FIG. 28*a* shows fluctuations in the load torque of the motor 5 during a forward or reverse turn. The fifth entanglement detection method indirectly detects a peak-to-peak value ΔTp-p of the load torque shown in FIG. 28*a* from a peak-to-peak value Δδp-p of the temporally changing ON-duty ratio of the PWM signal shown in FIG. 28*b*. According to the peak-to-peak value Δδp-p, the fifth method tests if the washing are entangling with one another.

Figure 29:
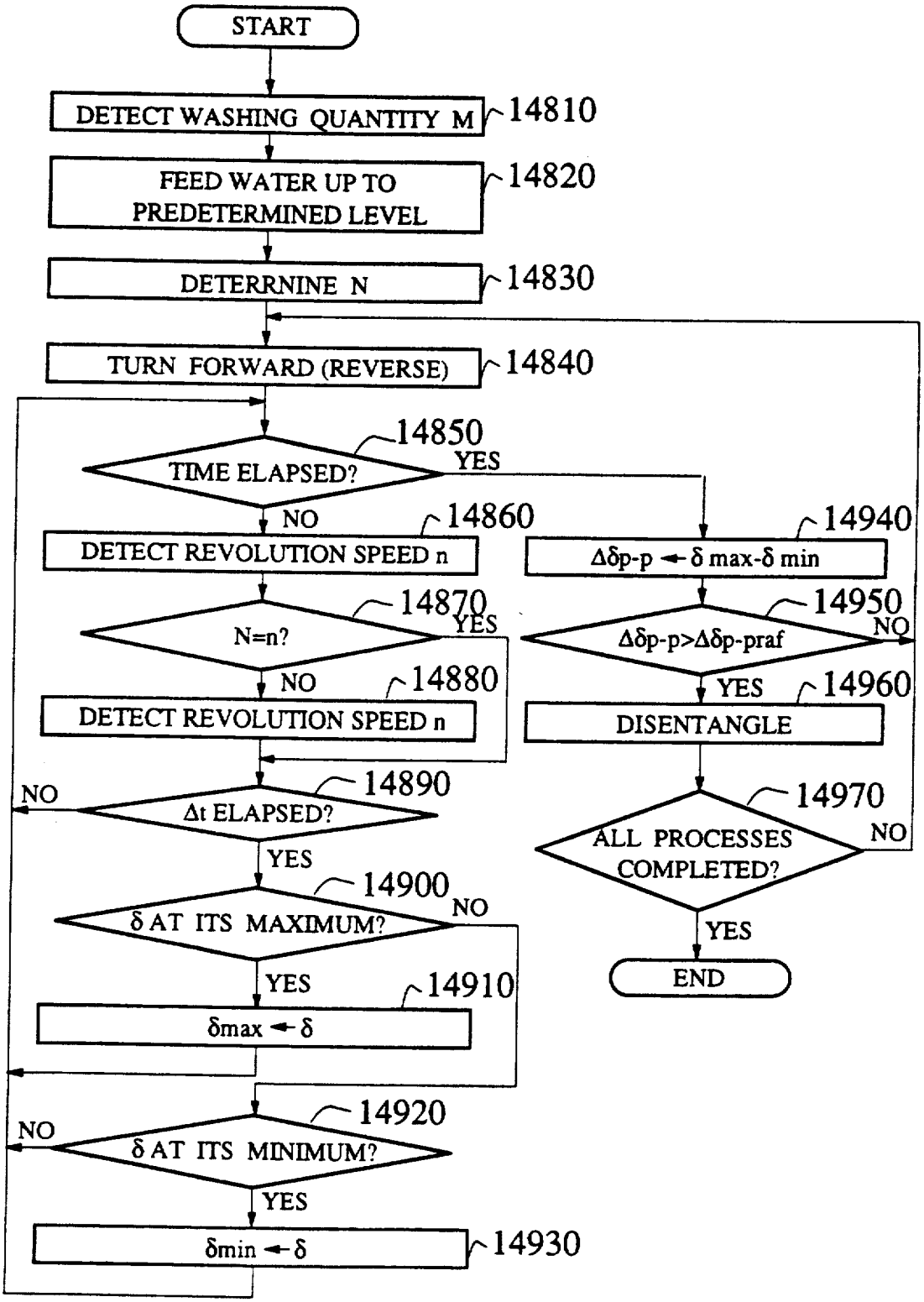
FIG. 29 is a flowchart showing the fifth entanglement detection method.

FIG. 29 is a flowchart showing the fifth entanglement detection method.

Steps 14810 to 14900 of FIG. 29 are the same as the steps 4110 to 4200 of FIGS. 23*a* and 23*b* of the first method. When the step 14890 determines that a period Dt has elapsed, the step 14900 checks to see whether or not the ON-duty ratio δ of the PWM signal is maximum. If it is maximum, the ON-duty ratio δ is set as a maximum value δmax. If it is not maximum, step 14920 tests if it is minimum. If it is minimum, step 14930 sets the ON-duty ratio δ as a minimum value δmin. Then, the flow returns to the step 14850 to repeat the above steps during a forward or reverse period, to detect the maximum value δmax and minimum value δmin for the period.

After the forward or reverse period, the step 14850 goes to step 14940, which calculates a difference Δδp-p by deducting the minimum ON-duty ratio δmin from the maximum ON-duty ratio δmax. Step 14950 compares the difference Δδp-p with a reference value Δδp-pref. If the difference Δδp-p is smaller than the reference value, there will be no entanglement, and the flow returns to the step 14840 to start the next forward or reverse cycle.

If the difference Δδp-p is greater than the reference value Δδp-pref, step 14960 disentangles the washing. If the processes are not completed in step 14970, the flow returns to the step 14840 to start the next forward or reverse cycle. The disentanglement of the step 14960 is carried out by, for example, frequently driving the pulsator 4 in both directions.

A sixth entanglement detection method according to the present invention will be explained.

This method adjusts the reference value Δδp-pref used in the fifth method according to the washing quantity. Temporal changes in friction caused by entanglement become larger as the washing quantity increases and smaller as the washing quantity decreases. This method, therefore, increases the reference value Δδp-pref if the washing quantity is large and decreases the same if the washing quantity is small.

Figure 30:
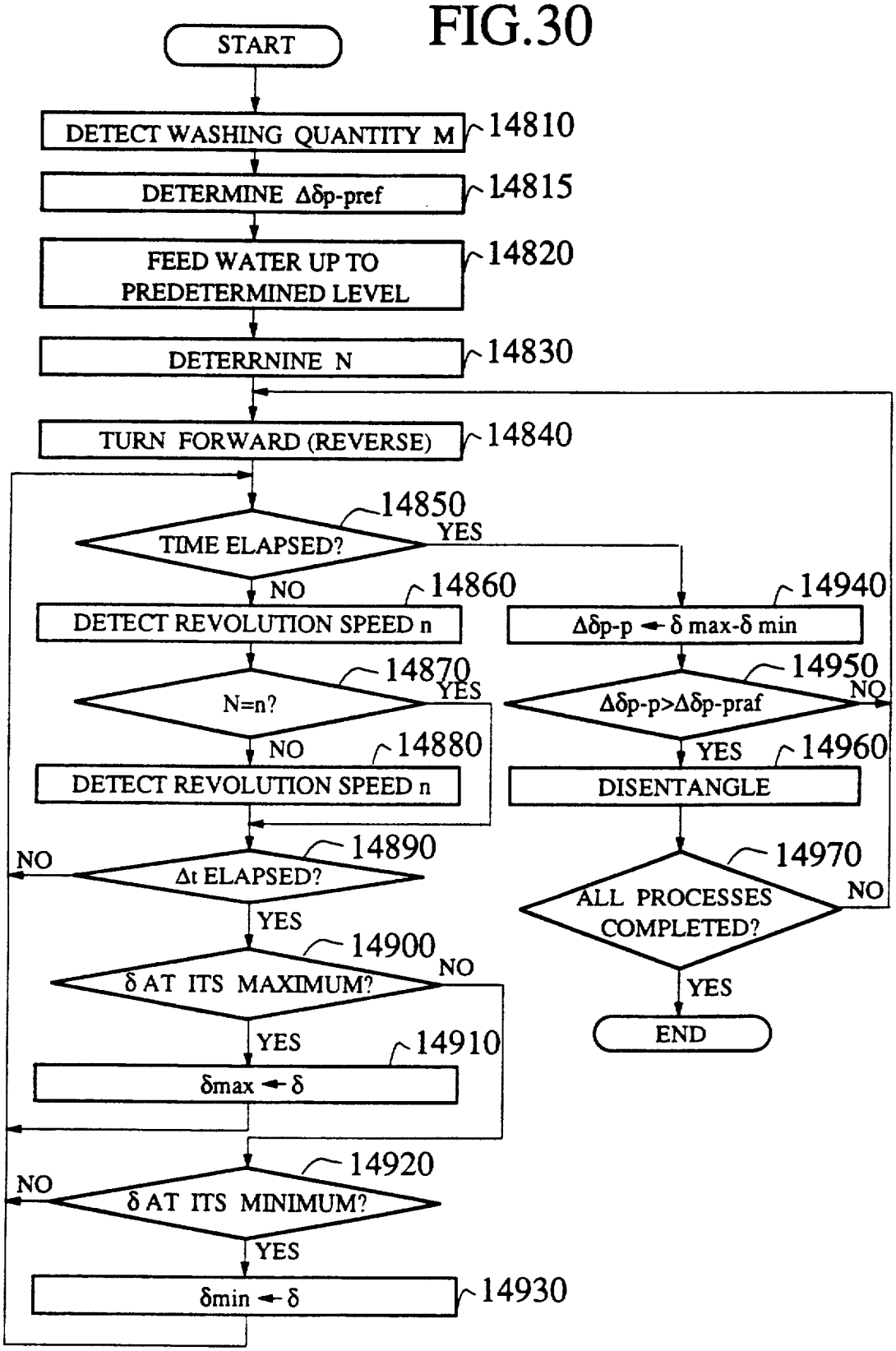
FIG. 30 a flowchart showing a sixth entanglement detection method.

FIG. 30 is a flowchart showing the sixth entanglement detection method. This method is characterized by step 14815 interposed between the steps 14810 and 14820 of the fifth method of FIG. 29. The step 14815 sets the reference value Δδp-pref according to the washing quantity. Other details of the sixth method are the same as those of the fifth method.

A seventh entanglement detection method according to the present invention will be explained.

This method monitors extreme torque values Text0, Text1, . . . , Texti of the motor 5 during a forward or reverse period, and according to differences ΔTexti = | Texti − Texti − 1 |, detects entanglement.

The microcomputer 26 controls the motor 5 to rotate at the given speed n and detects temporal changes in the ON-duty ratio δ of the PWM signal at predetermined intervals Δt, to find extreme values δext0, δext1, . . . , δexti. The microcomputer 26 calculates differences Δδexti = | δexti − δexti − 1 |. Each of differences is compared with a reference value Δδextref, and the number of differences that are greater than the reference value is counted as m. When the number m is greater then a reference number k, it is determined that there is entanglement.

Figure 31A:
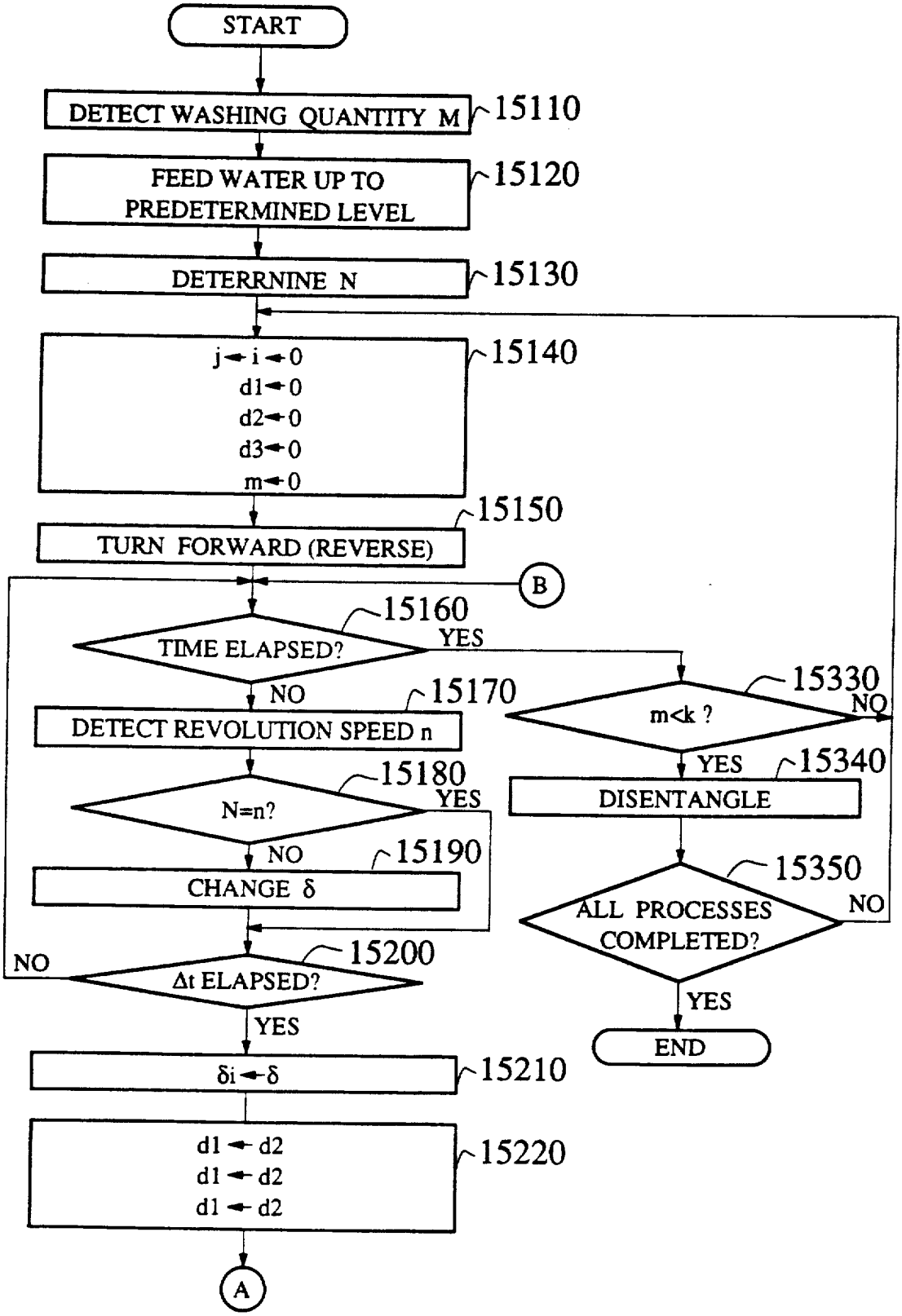
FIGS. 31a and 31b are flowcharts showing a seventh entanglement detection method.
Figure 31B:
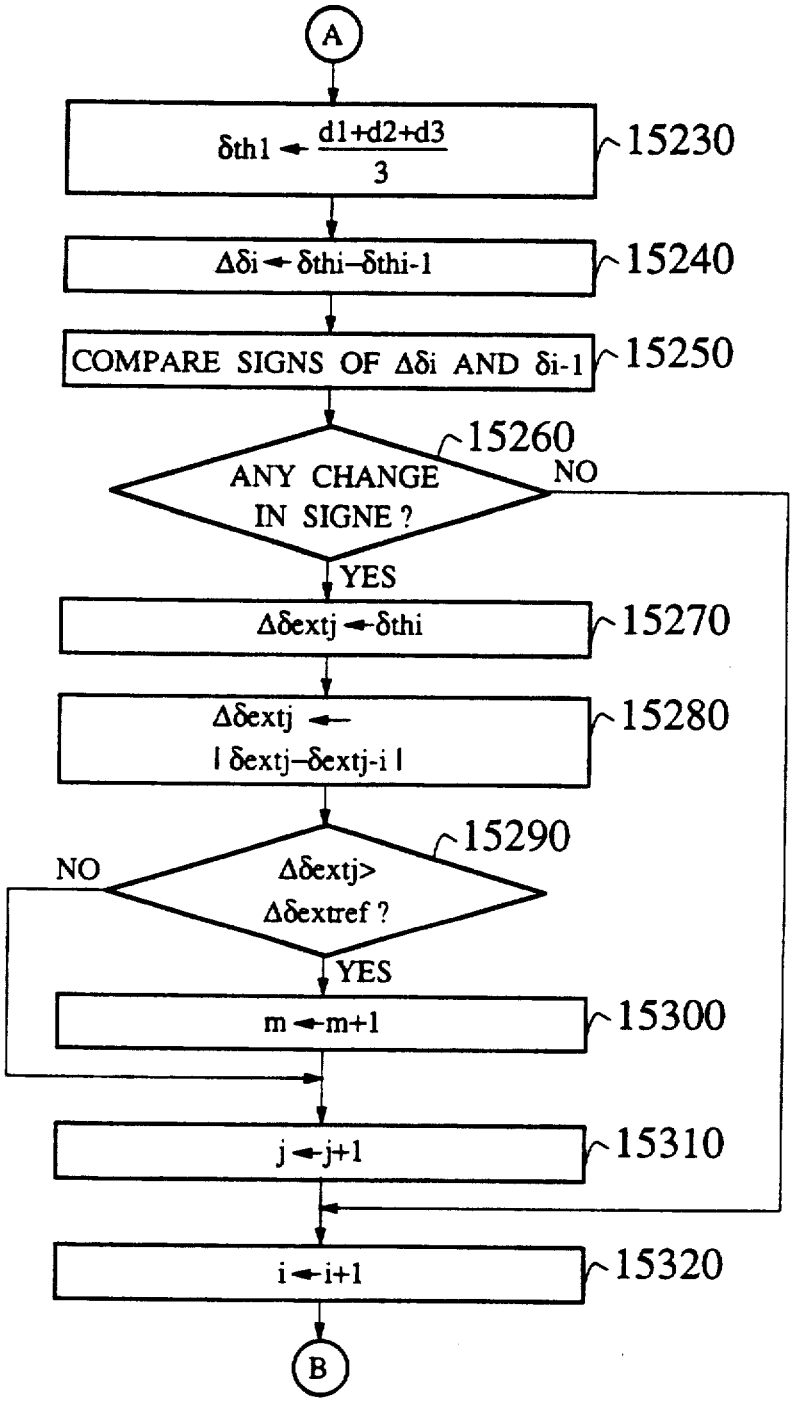

The seventh entanglement detection method will be explained with reference to FIGS. 31*a*, 31*b*, and 32.

Steps 15110 to 15130 detect a washing quantity, feed water to a predetermined level, and determines a revolution speed n for the motor 5. Step 15140 initializes variables i, j, d1, d2, d3, and m.

In step 15150, the microcomputer 26 provides the motor control circuit 24 with a start signal and a forward or reverse control signal. The microcomputer 26 makes the PWM oscillator 25 provide a PWM signal having an ON-duty ratio δ to turn the motor 5 at the speed n. The PWM signal is provided to the motor 5 through the chopper circuit 27, upper arm drive circuit 21, and inverter circuit 17. As a result, the motor 5 is turned at the speed n in the forward or reverse direction.

Step 15170 checks to see whether a forward or reverse period has ended. Step 15170 detects the revolution speed N of the motor 5. Step 15180 determines if the speed N is equal to the given speed n.

If the speed N is not equal to the speed n, step 15190 controls the microcomputer 26 to change the ON-duty ratio δ of the PWM signal to equalize the speeds N and n.

When the speeds N and n are equalized, step 15200 checks to see whether a period Δt has elapsed. If not, the flow returns to the step 15160. If the period has elapsed, step 15210 sets the ON-duty ratio δ of the PWM signal at this moment as δi. Step 15220 sets the ON-duty ratio δi as the variable d3, and shifts a value of the variable d2 to d1 and that of d3 to d2.

In this way, ON-duty ratios δ0, δ1, . . . , δi sampled at intervals of Δt for a forward or reverse period are set in the variables d1, d2, and d3.

Step 15230 smooths these ON-duty ratios, to provide a new ON-duty ratio δthi as follows:

$$\delta thi = (\delta i + \delta i - 1 + \delta i - 2)/3$$

Step 15240 calculates a difference Δδi of the ON-duty ratios δthi as follows:

$$\Delta\delta i = \delta thi - \delta thi - 1$$

Figure 32A:
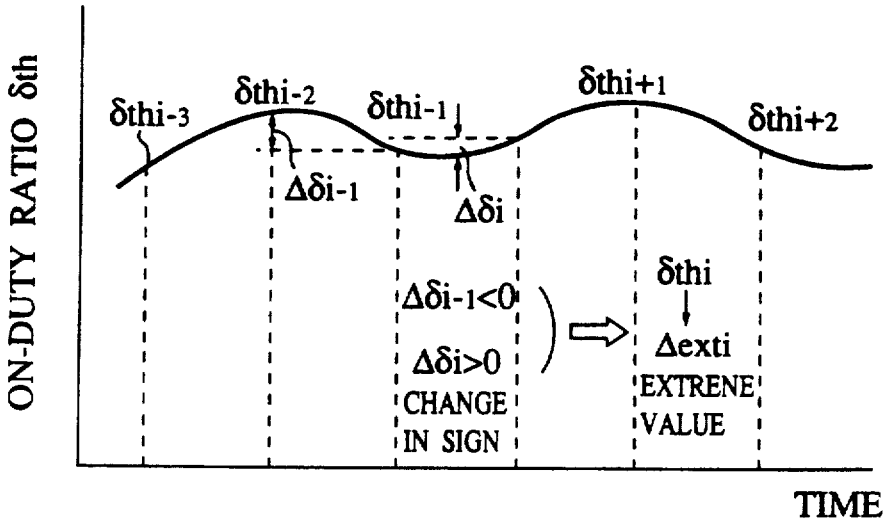
FIGS. 32a and 32b show temporal changes in the ON-duty ratio of a PWM signal according to the seventh entanglement detection method.

FIG. 32(*a*) shows the differences Δδi and ON-duty ratios δthi.

Figure 32B:
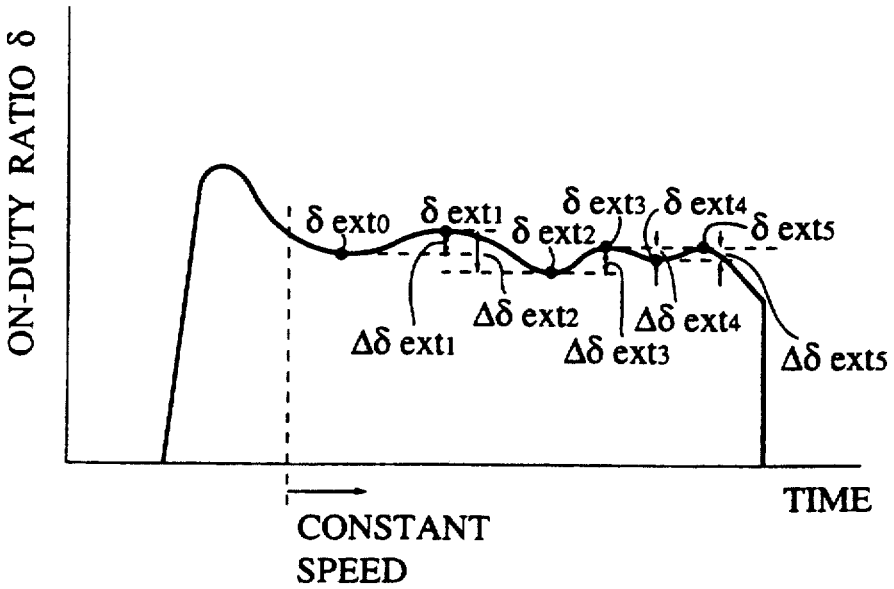

The differences Δδi are successively sampled. Step 15250 compares adjacent ones of the differences with each other, and step 15260 checks to see whether or not the adjacent ones have different signs. If they have different signs, step 15270 sets the ON-duty ratio δthi as an extreme value δext. In this way, a series of extreme values δext0, δext1, . . . , δextj are found as shown in FIG. 32*b*.

Step 15280 calculates differences Δδextj of the extreme values as follows:

$$\Delta\delta extj = |\delta extj - \delta extj - 1|$$

Step 15290 tests if each difference Δδextj is greater than a reference value Δδextref. If the difference is greater than the reference value, step 15300 increments the variable m by one. Steps 15310 and 15320 increment the variables i and j by one each. Then, the flow returns to the step 15160.

The above steps are repeated for one forward or reverse period. Step 15330 determines whether or not the variable m is smaller than a reference value k. If YES, there will be no entanglement, and the flow returns to the step 15140 for the next forward or reverse period.

If the m is greater than the k, it is determined that the washing are entangling with one another, and step 15340 disentangles the washing. Step 15350 tests if the processes are completed. If not, the flow returns to the step 15140 to start the next forward or reverse period.

An eighth entanglement detection method according to the present invention will be explained.

This method adjusts the reference value Δδextref according to the washing quantity, to correct temporal changes in friction due to a difference in the washing quantity. A change in the Δδextj caused by entanglement becomes larger as the washing quantity increases and smaller as the washing quantity decreases. Accordingly, the reference value Δδextref is increased if the washing quantity is large and decreased if it is small.

The fifth to eighth entanglement detection methods use the ON-duty ratio δ of the PWM signal for changing a voltage applied to the motor 5. Instead of the ON-duty ratio, an inverter current Idc to the motor 5 may be used.

In this case, the peak-to-peak value Δδp-p of the temporally changing ON-duty ratio δ of the PWM signal of the fifth and sixth methods is substituted by a peak-to-peak value DIp-p of the temporally changing inverter current Idc. The extreme values dextj of the temporally changing ON-duty ratio δ of the PWM signal of the seventh and eighth methods are substituted by extreme values Iextj of the inverter current Idc.

A ninth entanglement detection method according to the present invention will be explained.

This method detects entanglement according to fluctuations in maximum torque values Tmax during a forward or reverse period of washing or rinsing. To detect the maximum torque values Tmax, the motor 5 is driven at a given revolution speed n, and a maximum ON-duty ratio δmax of the PWM signal is obtained in a turn. A series of maximum ON-duty ratios δmax1, δmax2, . . . , δmaxi are obtained for a forward or reverse period. If these maximum values δmaxi fluctuate widely, it is determined that the maximum torque values Tmax fluctuate widely and that the degree of entanglement is large.

Figure 33A:
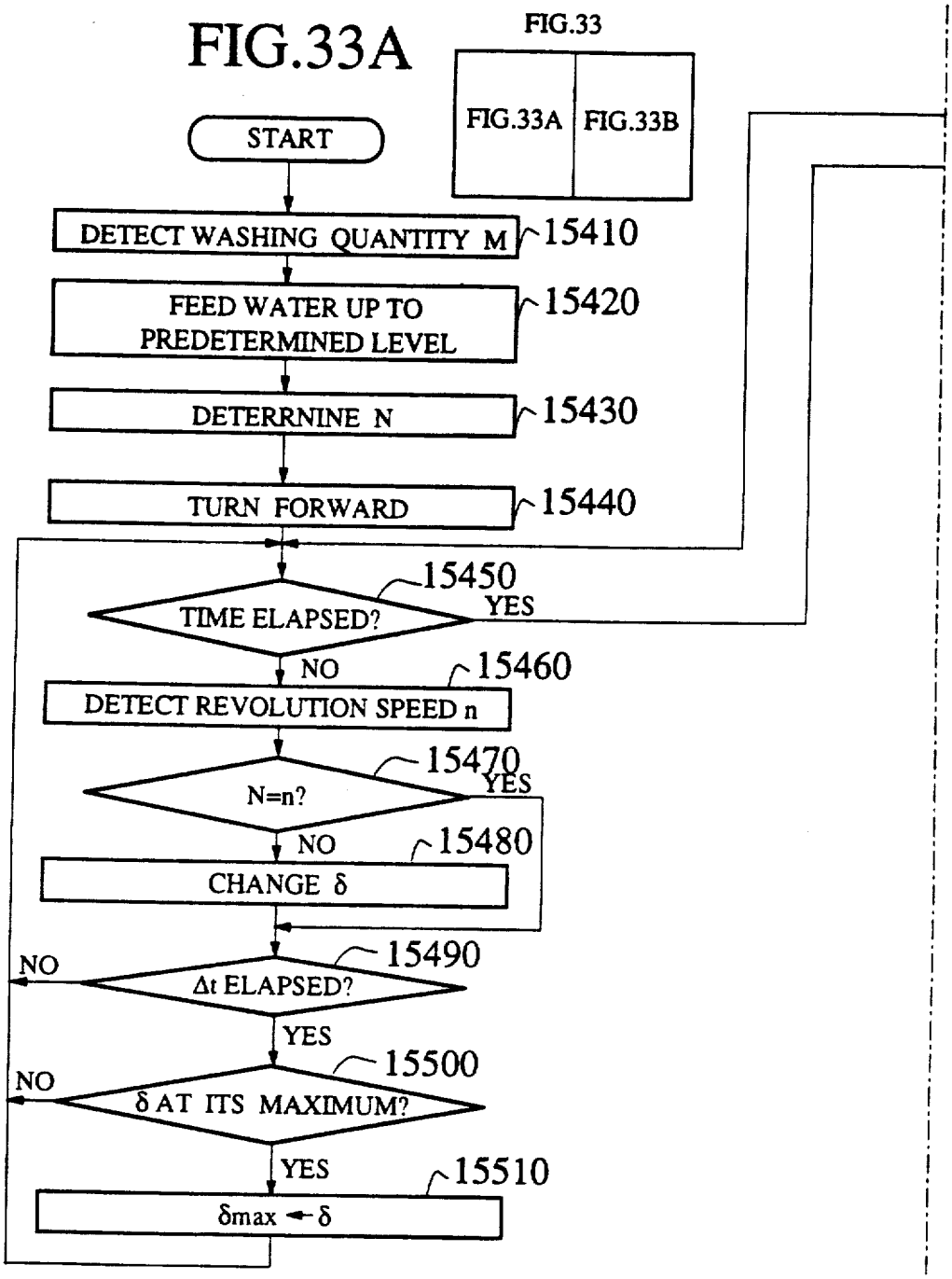
FIGS. 33a-33b make up a flowchart showing a ninth entanglement detection method.
Figure 33B:
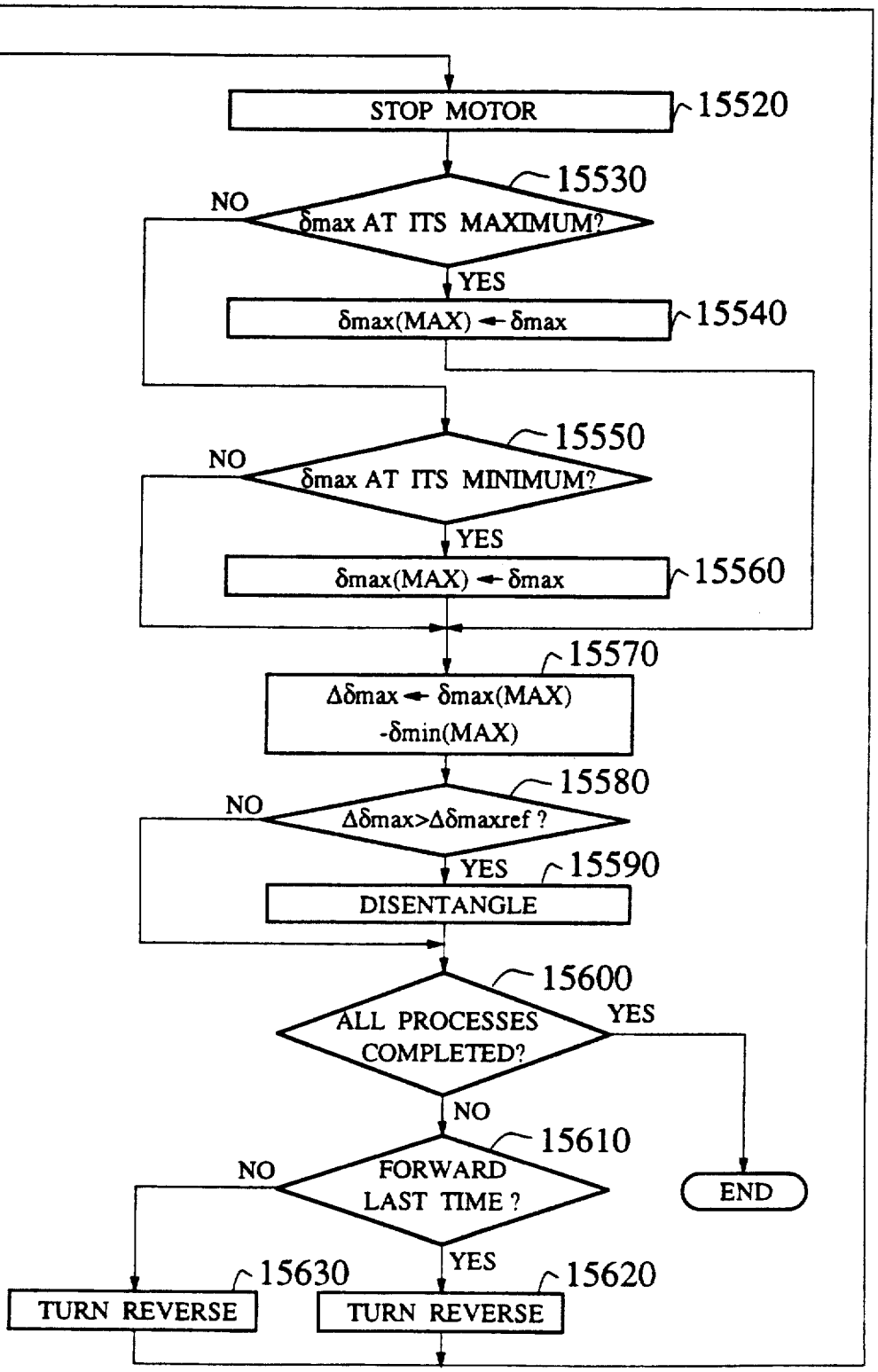

The ninth entanglement detection method will be explained with reference to a flowchart of FIG. 33.

Steps 15410 to 1550 are the same as the steps 4110 to 4200 of the first method of FIG. 23*a*. If the step 15490 detects that a period Δt has elapsed, the step 15500 checks to see whether or not the ON-duty ratio δ of the PWM signal is maximum. If it is maximum, step 15510 holds the ON-duty ratio δ as a maximum value δmax. If it is not maximum, the flow returns to the step 15450. These steps are repeated for a forward or reverse period, to find the maximum ON-duty ratio δmax for the period.

When the step 15450 determines that the forward or reverse period ended, step 15520 stops the motor 5. Step 15530 determines whether or not the maximum value δmax obtained in the step 15510 is largest. If it is largest, step 15540 sets the maximum value δmax as a largest maximum δmax(MAX). If the step 15530 determines that the value is not largest, step 15550 checks to see if it is minimum. If it is minimum, step 15560 sets the maximum value δmax as a smallest maximum δmax(MIN).

Step 15570 calculates a difference Δδmax between the δmax(MAX) and δmax(MIN) as follows:

$$\Delta\delta max = \delta max(MAX) - \delta max(MIN)$$

Figure 34:
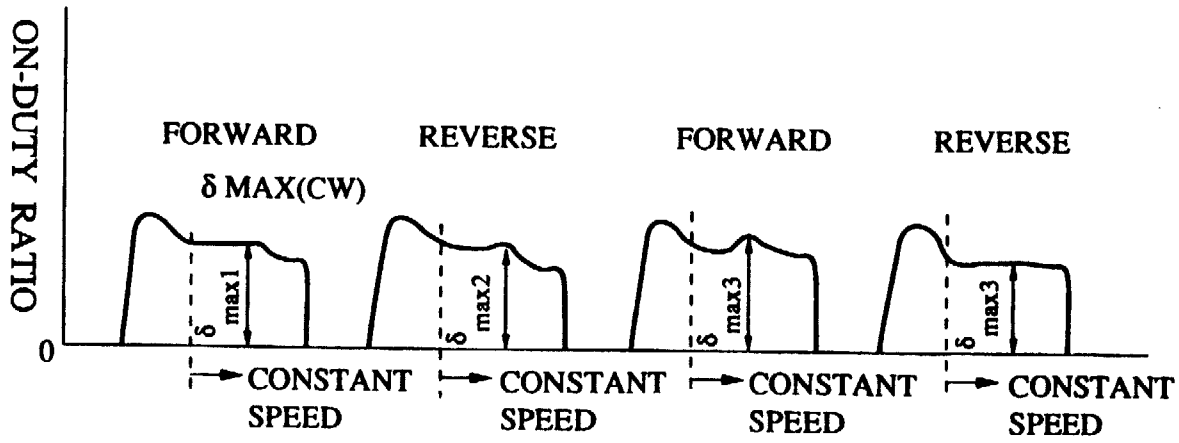
FIG. 34 shows temporal changes in the ON-duty ratio of a PWM signal according to the ninth entanglement detection method.

FIG. 34 shows a relationship between these values. After the measurement of the fourth ON-duty ratio δ shown in the figure, there will be δmax(MAX)=δmax3, δmax(MIN)=δmax4, and Δδmax=δmax(MAX)−δmax(MIN).

Step 15580 compares the difference Δδmax with a reference value Δδmaxref. If the Δδmax is greater than the Δδmaxref, there will be entanglement, and step 15590 disentangles the washing. Step 15600 tests if the process has been completed. If not, step 15610 sees if the last rotation has been forward. If it has been forward, step 15620 starts a reverse period. If it has not been forward, step 15630 starts a forward period. Then, the flow returns to the step 15450 to repeat the above steps.

A tenth entanglement detection method according to the present invention will be explained.

This method employs an inverter current Idc instead of the ON-duty ratio δ of the PWM signal of the ninth method.

Figure 35A:
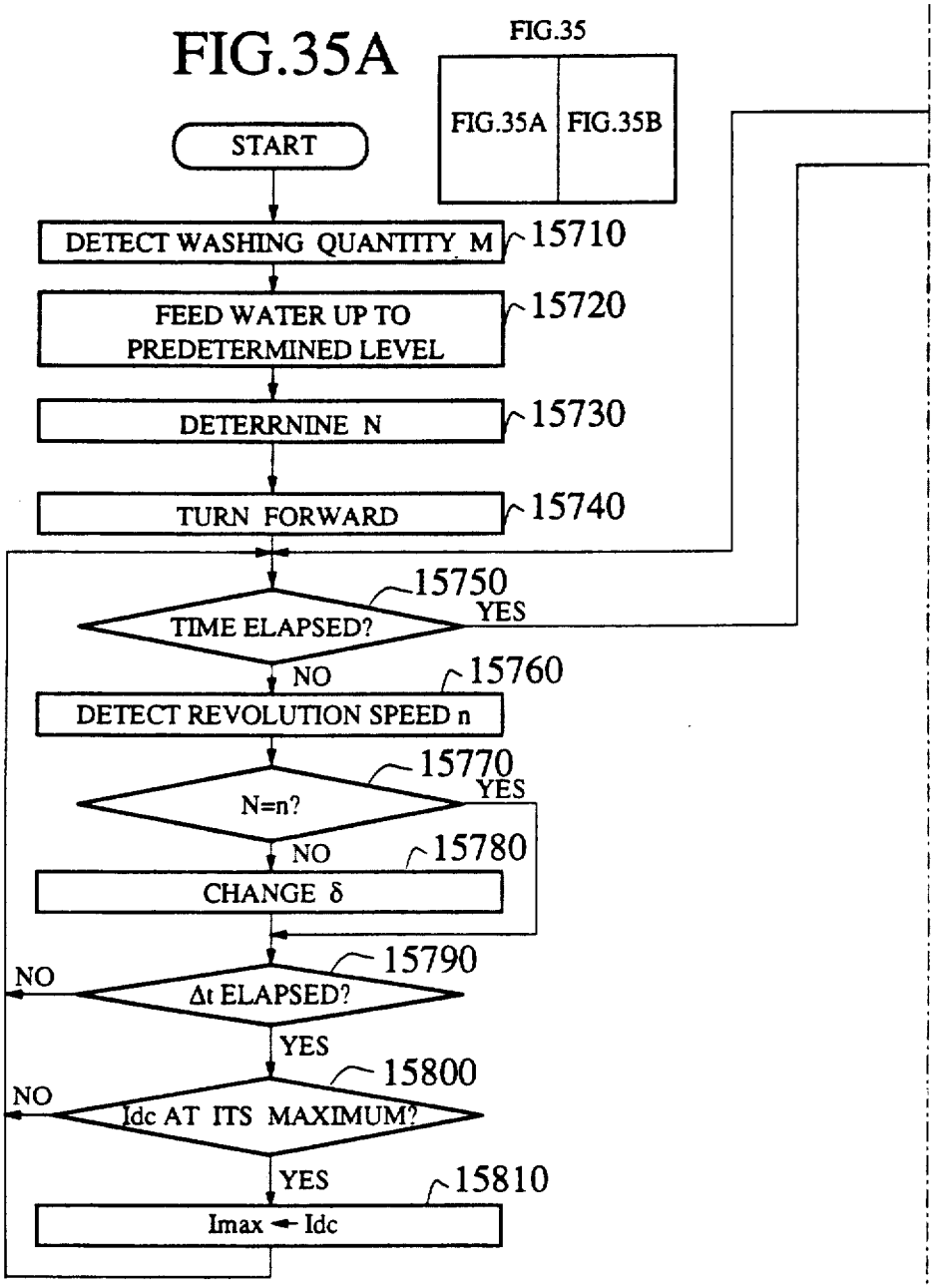
FIGS. 35a-35b make up a flowchart showing a tenth entanglement detection method.
Figure 35B:
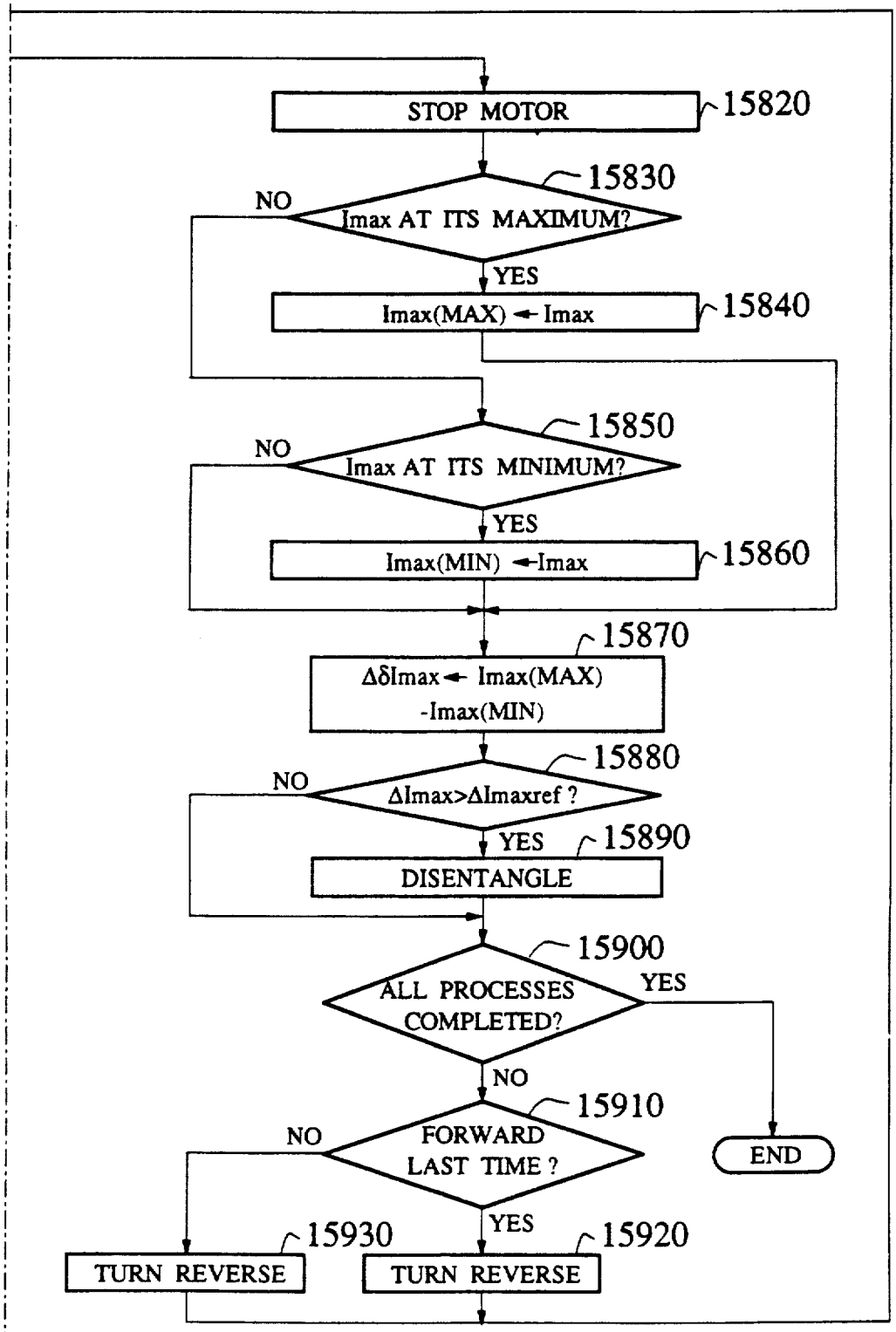

FIG. 35 is a flowchart of the tenth method. Compared with the ninth method of FIG. 33, this method employs the inverter current Idc instead of the ON-duty ratio δ, a maximum inverter current value Imax instead of the maximum ON-duty ratio δmax, a largest maximum inverter value Imax(MAX) instead of the largest maximum ON-duty ratio δmax(MAX), a smallest inverter current Imax(MIN) instead of the smallest ON-duty ratio δmax(MIN), a difference ΔImax instead of the difference Δδmax, and a reference value ΔImaxref instead of the reference value Δδmaxref. Other details of the tenth method are the same as those of the ninth method.

Figure 36:
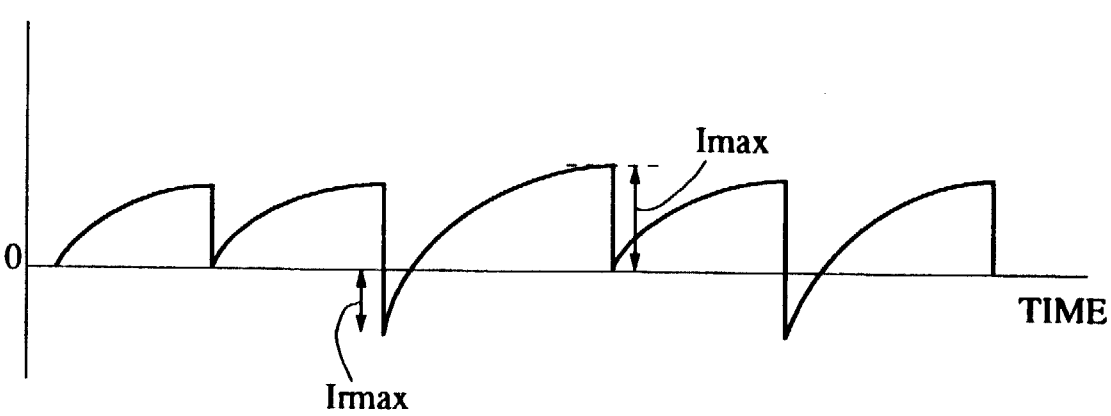
FIG. 36 shows an inverter current according to the tenth entanglement detection method and a regenerative current according to an eleventh entanglement detection method.

FIG. 36 shows maximum inverter currents Imax.

An eleventh entanglement detection method according to the present invention will be explained.

This embodiment employs a regenerative current Ir momentarily flows when the upper and lower arm transistors U1, V1, W1, U2, V2, and W2 of the inverter circuit 17 are switched, instead of the ON-duty ratios δmax and inverter currents Imax of the ninth and tenth methods, to detect the maximum torque Tmax.

More precisely, the microcomputer 26 drives the motor 5 at the given revolution speed n, detects a regenerative current Ir for each forward or reverse turn, holds a maximum regenerative current Irmax for the forward or reverse turn, and obtains a series of maximum regenerative currents Irmax1, Irmax2, . . . , Irmaxi for the forward or reverse period. When the maximum regenerative currents Irmaxi fluctuate widely, the torque Tmax also fluctuates widely. This means that there is large entanglement.

Figure 37A:
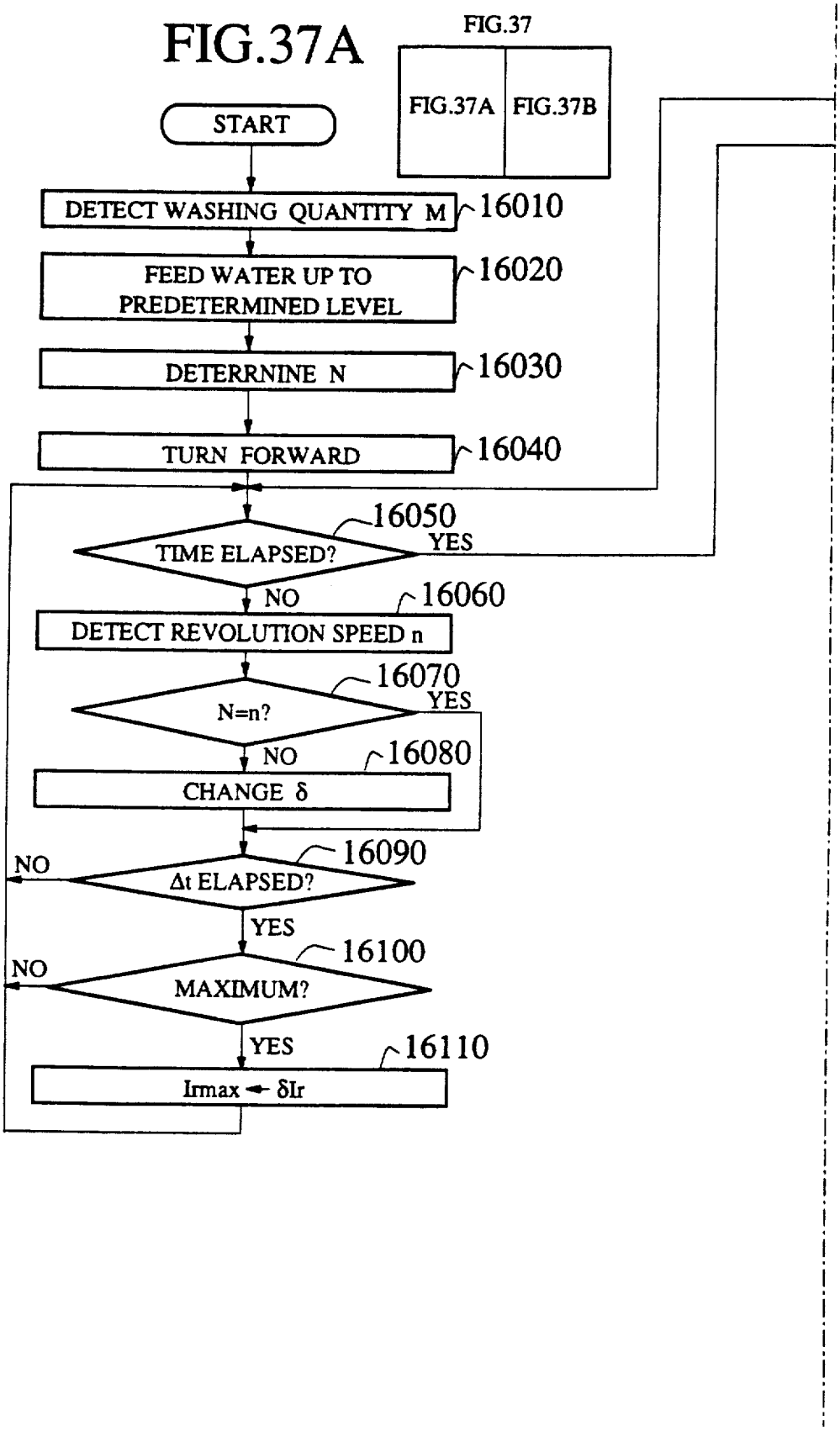
FIGS. 37a-37b a flowchart showing the eleventh entanglement detection method.
Figure 37B:
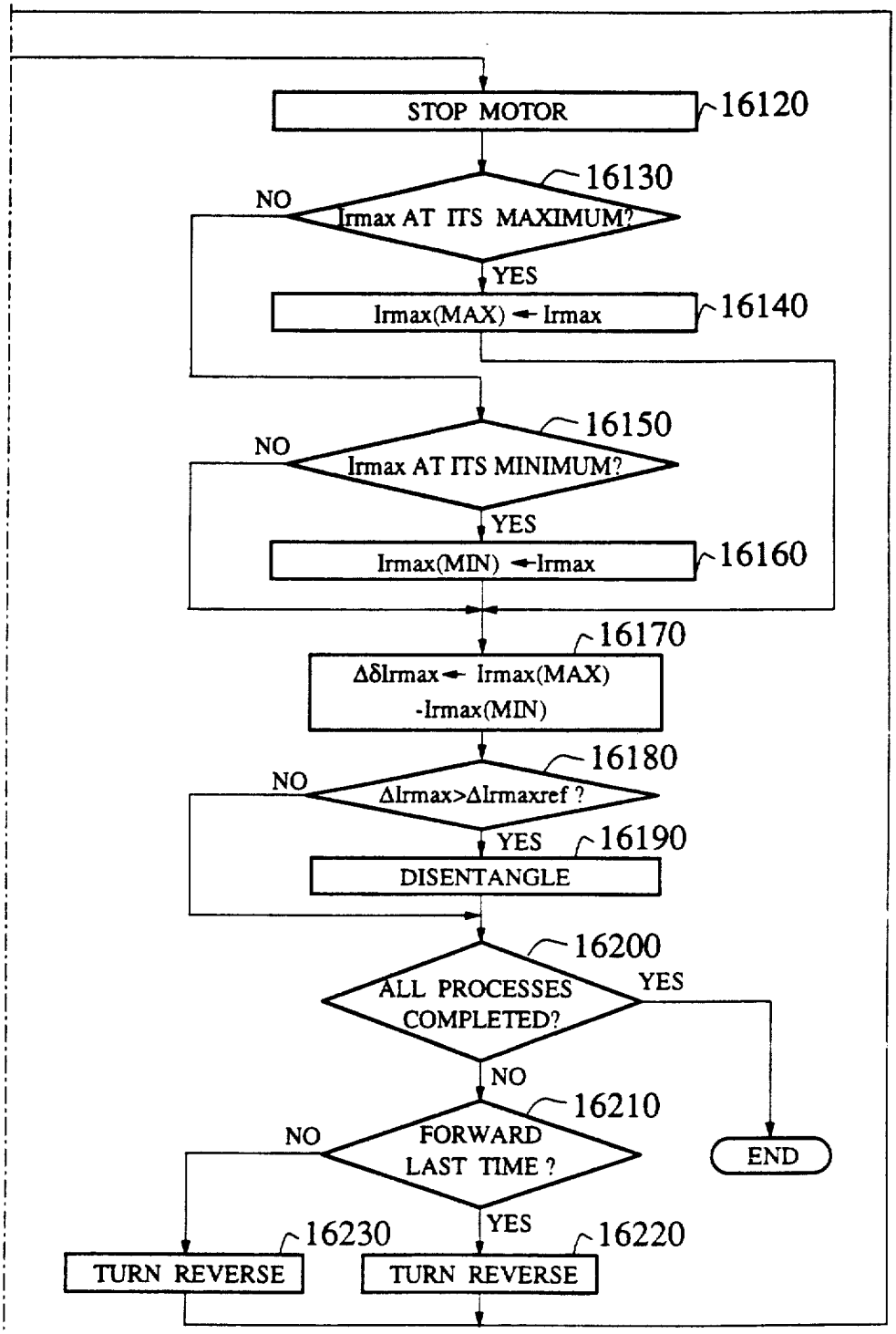

The eleventh entanglement detection method will be explained with reference to a flowchart of FIG. 37.

Steps 16010 to 16090 are the same as the steps 4110 to 4190 of the first entanglement detection method of FIG. 23a. When the step 16090 detects that a period Δt has elapsed, step 16100 determines whether a regenerative current Ir of this time is maximum. If it is maximum, step 16110 holds the current Ir as a maximum value Irmax. If it is not maximum, the flow returns to the step 16050. These steps are repeated for a forward or reverse period, to obtain a maximum regenerative current Irmax of this period.

When the step 16050 determines that the forward or reverse period has ended, step 16120 stops the motor 5. Step 16130 checks to see whether or not the maximum value Irmax obtained in the step 16110 is the largest. If it is, step 16140 sets the maximum value Irmax as a largest maximum current Irmax(MAX). If it is not the largest, step 16150 checks to see if the Irmax is the smallest. If it is smallest, step 16160 sets the Irmax as a smallest maximum value Irmax(MIN).

Step 16170 finds a difference ΔIrmax between the Irmax (MAX) and Irmax(MIN) as follows:

$$\Delta Irmax = Irmax(MAX) - Irmax(MIN)$$

Step 16180 compares the ΔIrmax with a reference value ΔIrmaxref. If the difference is greater than the reference value, it is determined that there is entanglement, and step 16190 disentangles the washing. Step 16200 determines whether or not the process has been completed. If it has not been completed, step 16210 checks to see whether or not the last rotation has been forward. If it has been forward, step 16220 starts a reverse rotation. If it has not been forward, step 16230 starts a forward rotation, and the flow returns to the step 16050 to repeat the steps.

The ninth to eleventh methods fix the reference values Δδmaxref, ΔImaxref, and ΔIrmaxref. These reference values may be adjusted according to the washing quantity, to correct fluctuations in friction caused by entanglement. Namely, friction due to entanglement fluctuates more widely when the washing quantity is large, and it fluctuates little when the washing quantity is small. Accordingly, the reference values are set larger if the washing quantity is large and smaller if the washing quantity is small.

In this way, the steps 360 and 370 of the entanglement detection and disentangle processes of FIG. 12a are completed. Then, step 380 detects damage to the washing and step 390 changes a flow of water to protect the washing.

If the washing are soft, they must be washed with a weak flow, i.e., at slow speed to avoid damage. If they are washed with a strong flow, i.e., at high speed, they must be damaged. Accordingly, the present invention monitors whether the clothes are washed at a proper speed according to the characteristics and quantity of the clothes, and if the speed is not appropriate, changes the flow by changing speed, to prevent damage to the washing.

Figure 38A:
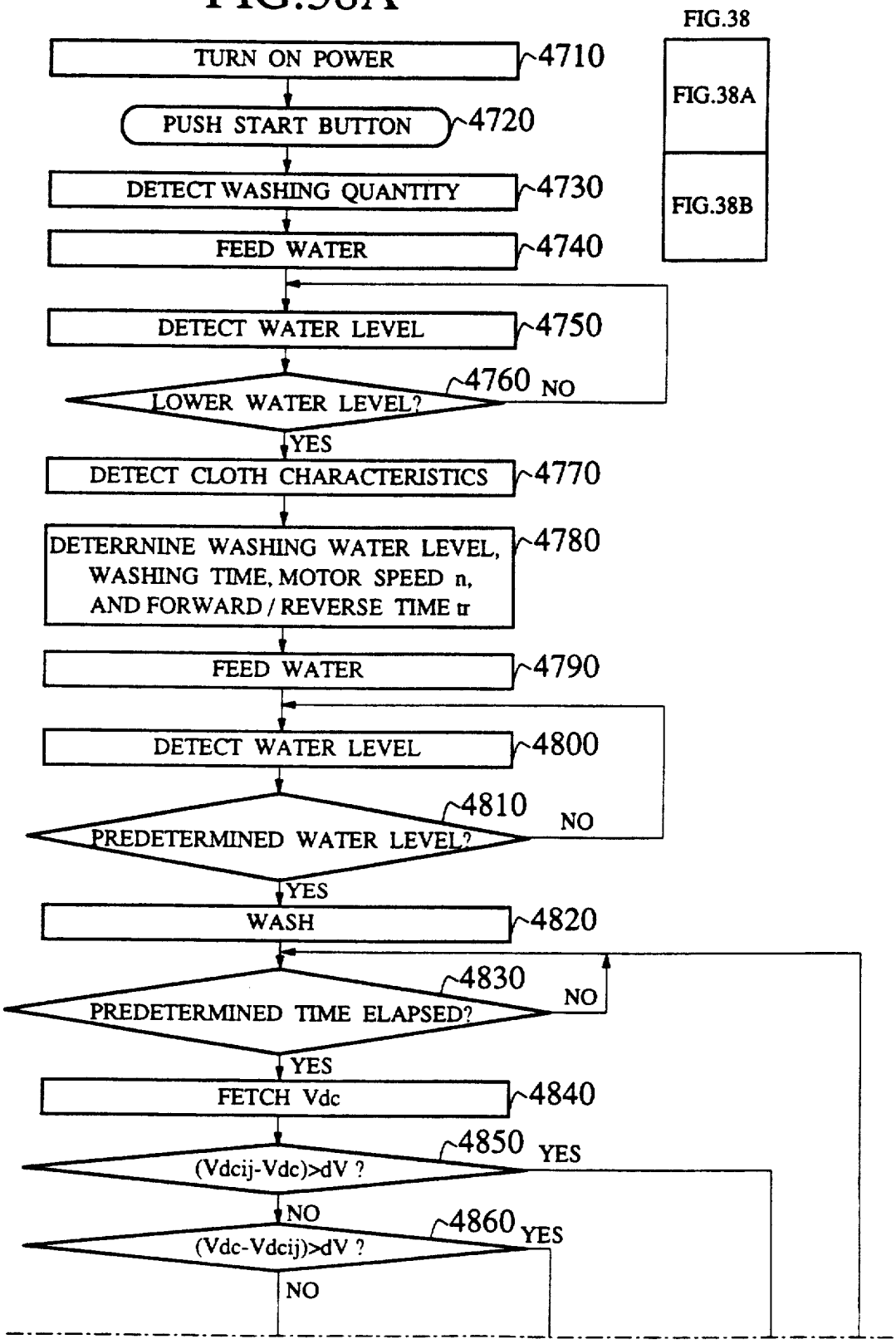
FIGS. 38a-38b a flowchart showing a first damage detection method.
Figure 38B:
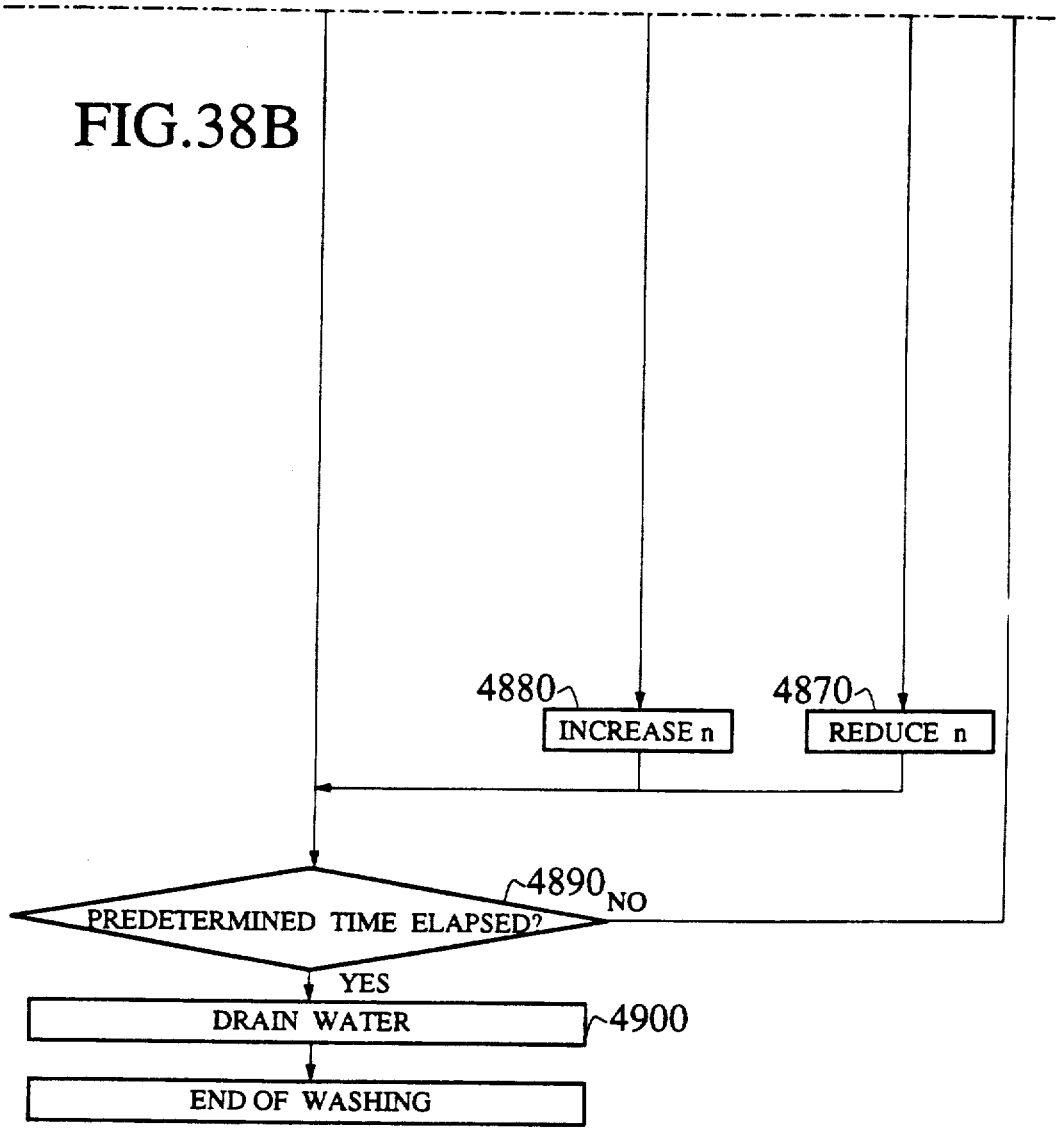

A first damage detection method according to the present invention will be explained with reference to a flowchart of FIG. 38.

Steps 4710 to 4820 detect a washing quantity, a water level, and cloth characteristics, determines a final water level LWo and a water flow according to a revolution speed n of the motor 5 and a forward/reverse period tr, feeds water up to the level LWo, and washes washing. These steps are the same as those explained above.

Step 4820 starts washing. Step 4830 checks to see whether or not the predetermined period elapsed. In step 4840, the microcomputer 26 fetches a voltage Vdc corresponding to the load torque of the washing through the resistor 28, filter 30, and A/D converter 29.

Table 11 shows voltages Vdcij that are obtainable when the washing are washed under optimum conditions with no damage to the washing, for each combination of a washing quantity and cloth characteristics. This table is stored in a memory of the microcomputer 26 in advance.

TABLE 11

| | Soft → Standard → Hard | | | | |
|---|---|---|---|---|---|
| Small qty. | Vdc11 | Vdc12 | Vdc13 | Vdc14 | Vdc15 |
| | Vdc21 | Vdc22 | Vdc23 | Vdc24 | Vdc25 |
| Medium qty. | Vdc31 | Vdc32 | Vdc33 | Vdc34 | Vdc35 |
| | Vdc41 | Vdc42 | Vdc43 | Vdc44 | Vdc45 |
| Large qty. | Vdc51 | Vdc52 | Vdc53 | Vdc54 | Vdc55 |

The washing are washed with the pulsator 4 that is turned at the constant speed n. Under this state, load torque on the motor 5 increases as the washing quantity increases and decreases as the washing quantity decreases. The load torque also increases as the cloth characteristics change from "soft" toward "hard" and decreases as they change from "hard" toward "soft."

There is optimum load torque for each combination of the cloth characteristics and washing quantity. As mentioned before, the load torque can be expressed as a voltage, an inverter current, ON-duty ratio, etc. Table 11 shows the load torque as voltages. This table indicates that there is an optimum voltage Vdc for each combination of the cloth characteristics and washing quantity. Accordingly, the step 4840 detects a voltage Vdc and checks a deviation of the voltage from an optimum voltage according to the Table 11.

Step 4850 reads an optimum voltage Vdcij for the detected washing quantity and cloth characteristics from the Table 11 stored in the memory of the microcomputer 26 and compares it with the voltage Vdc obtained in the step 4840 and with a differential voltage dV, as follows:

$$Vdcij - Vdc > dV$$

If the difference is greater than the dV, i.e., if the optimum voltage Vdcij is too large with respect to the detected voltage Vdc, it is determined that the washing quantity and cloth characteristics have not been correctly detected. For example, it is determined that the detected cloth characteristics are biased toward "hard." Accordingly, step 4870 reduces the revolution speed n.

Being biased toward "hard" means that the washing, which are actually "soft," are being washed with a stronger flow, i.e., at higher speed. In this case, the washing must be damaged. To prevent this, the speed n is reduced.

If the step 4850 determines that the difference is around the differential voltage dV, step 4860 checks to see whether the differential between the detected voltage Vdc and the optimum voltage Vdcij is greater than the differential voltage dV, as follows:

$$Vdc - Vdcij > dV$$

If the difference is greater than the dV, the optimum voltage Vdcij obtained from the detected washing quantity and cloth characteristics is too small to the detected voltage Vdc. This means that the detected washing quantity and cloth characteristics are incorrect. For example, the detected cloth characteristics are biased toward "soft." Then, step 4880 increases the revolution speed n.

In this way, it is checked to see whether or not the voltage difference "Vdci(i−j)−Vdc" is within the differential voltage dV. If it is out of the differential voltage dV, the revolution speed n is controlled to provide an optimum flow for the washing.

$$-dV < Vdci(j-1) - Vdc < dV$$

After the steps 4870 and 4880 control the revolution speed n, step 4890 determines whether or not the washing period has elapsed. If not, the flow returns to the step 4830 to repeat the above steps after the predetermined interval. In this way, a water flow is optimized every time. After the washing period, step 4900 drains water.

A second damage detection method according to the present invention will be explained.

To detect damage, this method employs a period tw in which the motor 5 reaches a target speed n, instead of the voltage employed by the first damage detection method. The second method employs Table 12.

TABLE 12

| | Soft → Standard → Hard | | | | |
|---|---|---|---|---|---|
| Small qty. | tω11 | tω12 | tω13 | tω14 | tω15 |
| | tω21 | tω22 | tω23 | tω24 | tω25 |
| Medium qty. | tω31 | tω32 | tω33 | tω34 | tω35 |
| | tω41 | tω42 | tω43 | tω44 | tω45 |
| Large qty. | tω51 | tω52 | tω53 | tω54 | tω55 |

Figure 39A:
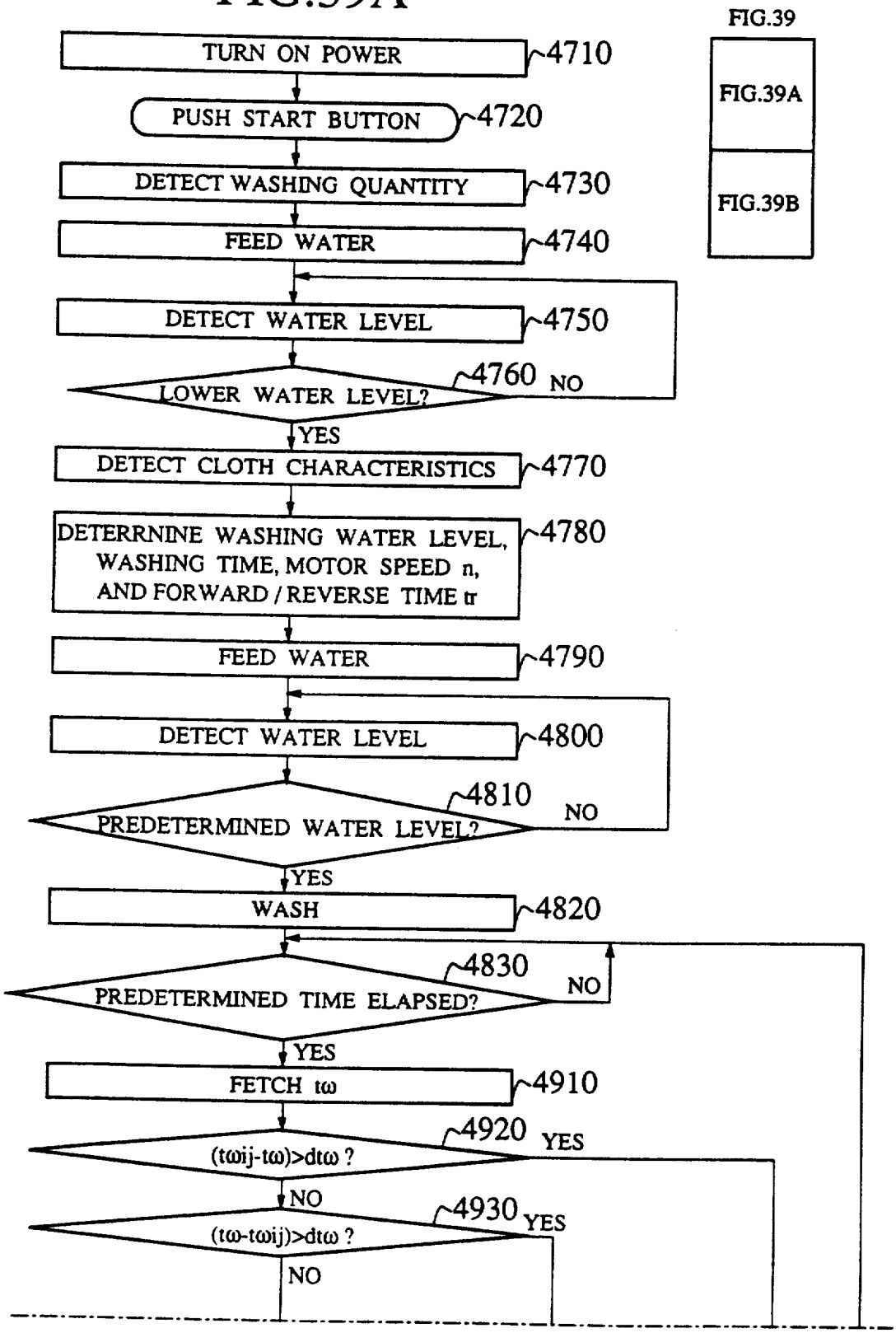
FIGS. 39a-39b is a flowchart showing a second damage detection method.
Figure 39B:
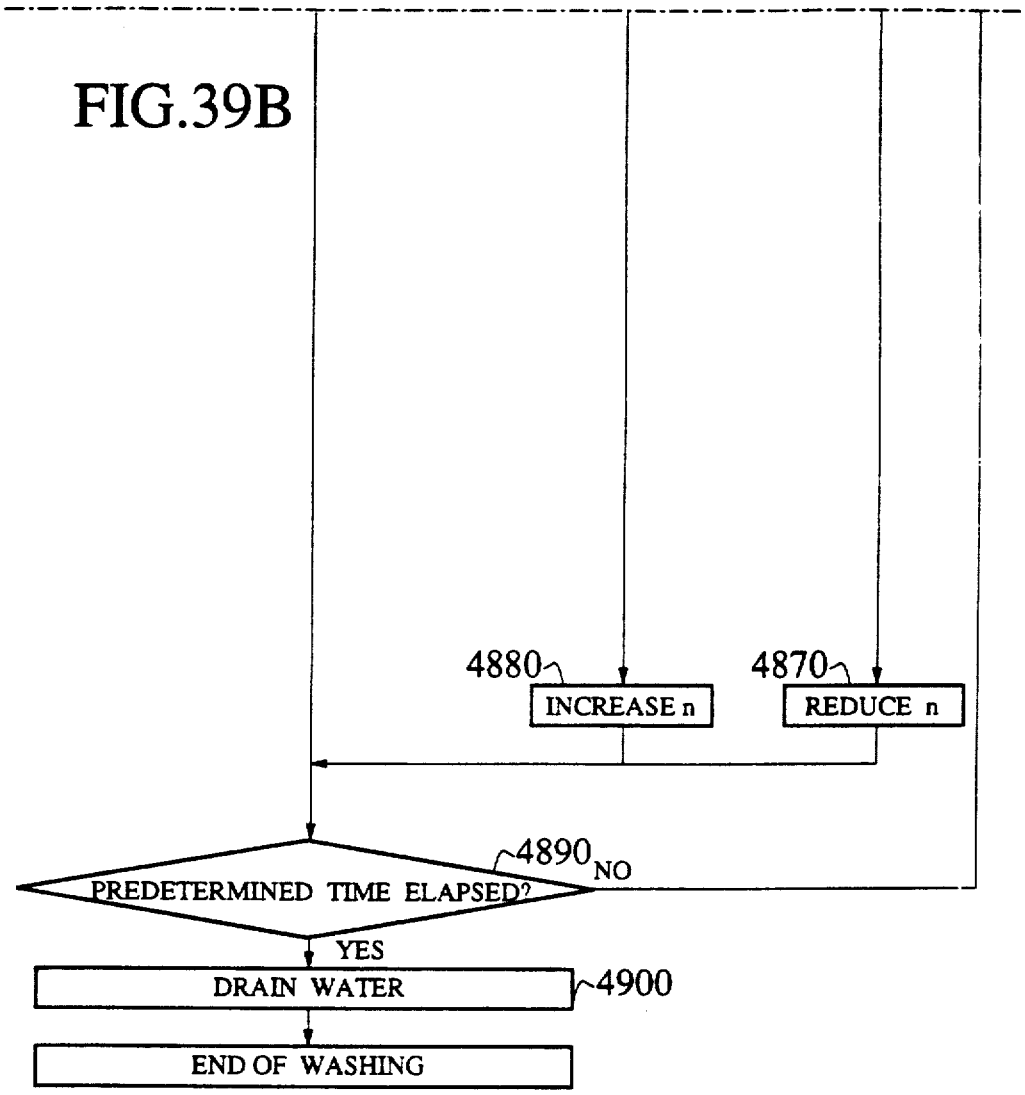

FIG. 39 is a flowchart showing the second method. This method employs time tω, tωij, and dtω instead of the voltages Vdc, Vdcij, and dV of the first method of FIG. 38. Other details of the second method are the same as the first method.

A third damage detection method according to the present invention will be explained.

This method employs a change dw in the revolution speed of the motor 5 in a period from the start to a given time point, instead of the voltage of the first method. The third method employs Table 13.

TABLE 13

| | Soft → Standard → Hard | | | | |
|---|---|---|---|---|---|
| Small qty. | dω11 | dω12 | dω13 | dω14 | dω15 |
| | dω21 | dω22 | dω23 | dω24 | dω25 |
| Medium qty. | dω31 | dω32 | dω33 | dω34 | dω35 |
| | dω41 | dω42 | dω43 | dω44 | dω45 |
| Large qty. | dω51 | dω52 | dω53 | dω54 | dω55 |

Figure 40A:
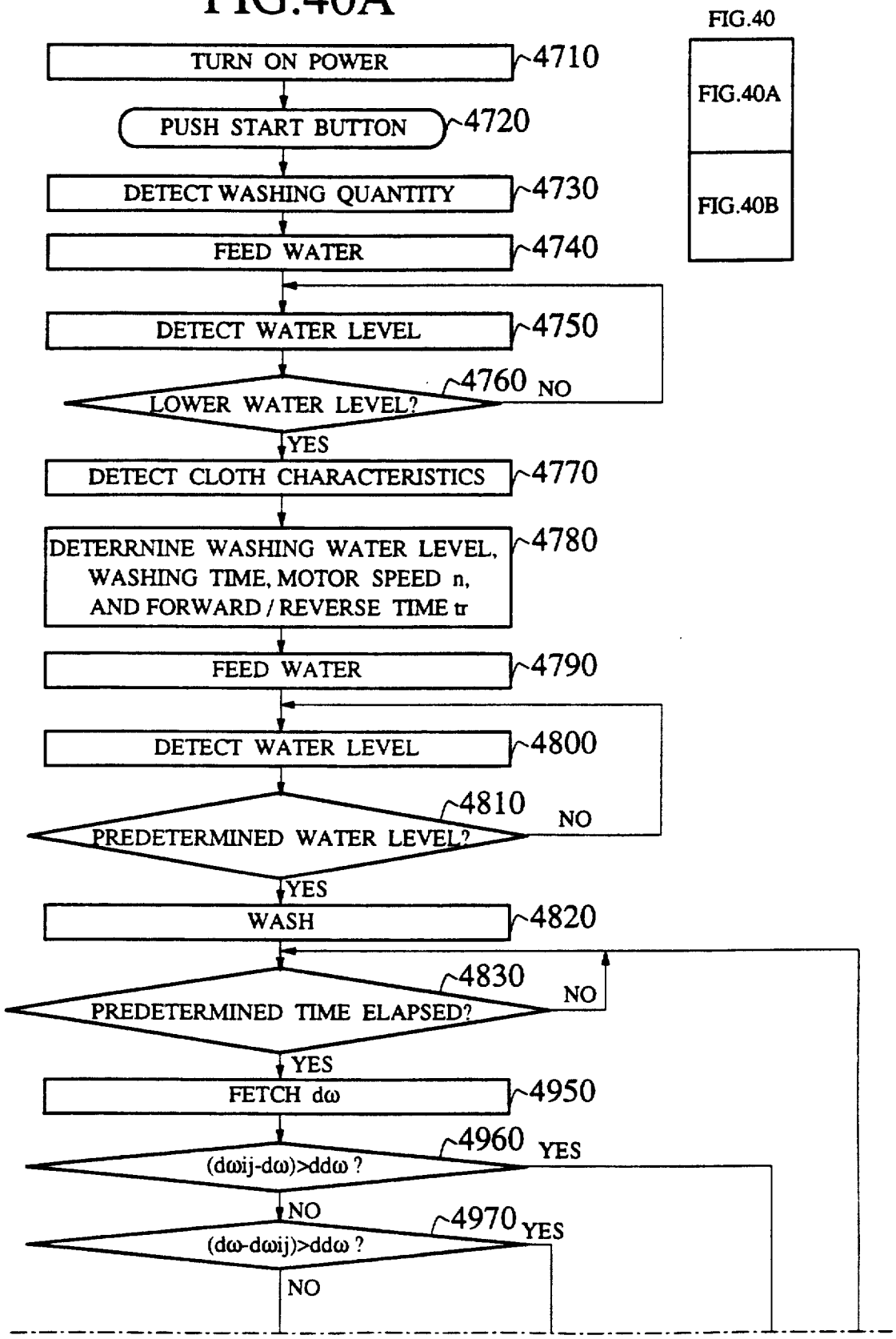
FIGS. 40a-40b is a flowchart showing a third damage detection method.
Figure 40B:
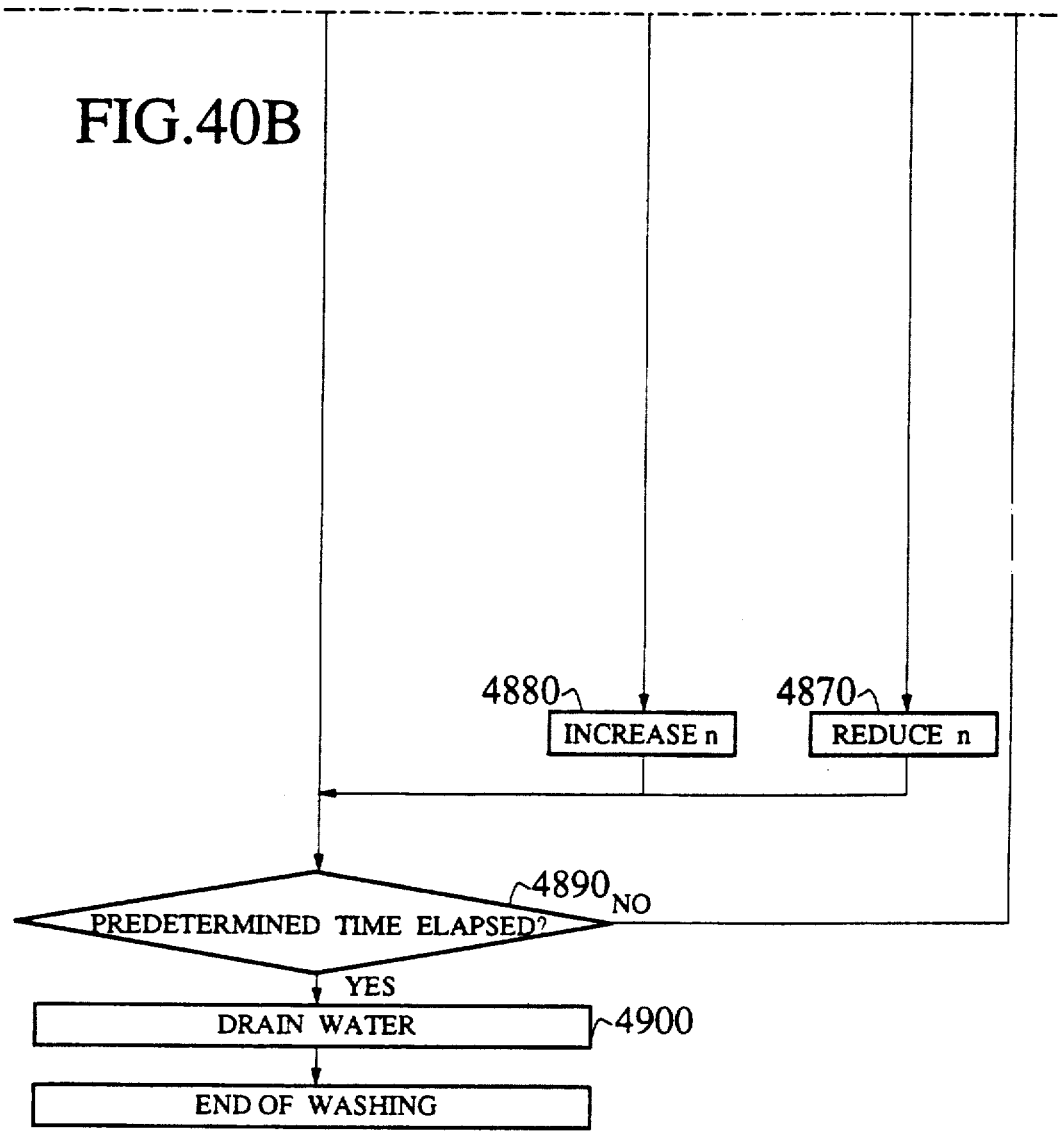

FIG. 40 is a flowchart showing the third method. This method employs speed changes dω, dωij, and ddω instead of the voltages Vdc, Vdcij, and dV of the first method of FIG. 38. Other details of the third method are the same as the first method.

Referring again to FIG. 12*a*, the steps 380 and 390 thus complete the damage detection and flow change operations. Step 400 sees if the washing period set in the step 310 has elapsed. If YES, step 410 drains water.

In this case, it is necessary to detect if the water in the spin basket 3 and washing tub 2 has been completely drained. Thereafter, a spin-dry operation is carried out. After the step 410 of FIG. 12*a*, the flow goes to step 420 of FIG. 12*b* to detect a water level during the draining.

Step 430 checks to see whether or not water has reached the bottom of the spin basket 3.

When the draining starts, the spin basket 3 is continuously or intermittently turned at slow speed in a forward or reverse direction while detecting the load torque of the motor 5. When water is drained below the bottom of the spin basket 3, the load torque of the motor 5 suddenly changes. Finding such a sudden change will tell that water has reached the bottom of the spin basket 3.

At this moment, the final water level LWo in the spin basket 3, final water quantity Wo, water level dW of the bottom of the spin basket 3, and water quantity W up to the bottom of the spin basket 3 are all known. Accordingly, the microcomputer 26 computes a period th1 between the opening of the drain valve 86 and a time point when water reaches the bottom of the spin basket 3. Then, a drain speed Sh is obtained as follows:

$$Sh = (Wo - W)/th1$$

Step 440 checks to see whether or not water is drained to the bottom of the spin basket 3 within, for example, three minutes and 30 seconds. If water is not drained to the bottom within the time, the drain valve or hose may be clogging, so that step 450 provides an alarm.

When water is normally drained to the bottom of the spin basket 3, step 460 drains water remaining below the spin basket 3. As explained before, the water quantity W below the bottom of the spin basket 3 is known from the design data of the washing machine. Accordingly, a drain period trh of the remaining water is calculated as follows:

$$trh = (W/Sh) \times Ch$$

where Ch is a correction coefficient. Since the washing in the spin basket 3 contain water at the time of draining, the quantity of water to be drained from the spin basket 3 is smaller than the quantity of water fed into the spin basket 3. Below the bottom of the spin basket 3, however, the water quantity is unchanged in the draining and feeding occasions. Accordingly, the drain speed Sh obtained from a temporal change in a water level in the spin basket 3 is insufficient to calculate the drain period for the water below the bottom of the spin basket 3. This is the reason to correct the drain period with the coefficient Ch. The drain speed is slow below the bottom of the spin basket 3, and this fact is incorporated in the coefficient Ch.

After the water below the spin basket 3 is drained, step 470 starts the first spin-dry process.

During the spin-dry process, the washing may cause vibration if they are biased. If the vibration occurs, the spin basket 3 will not be accelerated to spin-dry the washing. Step 480 detects such an imbalanced state with use of a detector employing, for example, mechanical switches. If the imbalanced state exists, step 500 stops the spin-dry process and restores a balanced state by again feeding water and draining the water. If the imbalanced state is not corrected after three times of the imbalance correction operations, steps 490 and 510 provide an alarm.

If there is no imbalance or after the imbalance is corrected, steps 520 and 530 detect a dry rate and checks to see whether or not the target dry rate set in the step 310 has been attained.

When water contained in the washing decreases due to the spin-drying, the moment of inertia of the spin basket 3 containing the washing decreases. This fact is used to detect a dry rate.

More precisely, a relationship between a change in the moment of inertia and a spin-dry period to get a target dry rate is obtained in advance for each combination of a washing quantity and cloth characteristics, and the relationship is stored in a table in a memory of the microcomputer 26. A spin-dry process to get a target dry rate is carried out for a period retrieved from the table.

The moment of inertia is not directly detected but indirectly detected from first to fourth control variables controlled by the microcomputer 26.

The first control variable is a voltage applied to the motor 5, to maintain the motor 5 at a given speed. Namely, the first control variable is the ON-duty ratio of the PWM signal or an inverter current produced according to a change in the ON-duty ratio, to maintain the given speed.

The second control variable is a revolution speed of the motor 5 when a fixed voltage is applied to the motor 5, i.e., when the ON-duty ratio of the PWM signal is fixed.

The third control variable is a period for bringing the motor 5 to a given speed with a voltage applied to the motor 5 being unchanged, i.e., with the ON-duty ratio of the PWM signal being unchanged.

The fourth control variable is a voltage applied to the motor 5, i.e., the ON-duty ratio of the PWM signal when changing the speed of the motor 5 from one to another.

A first dry rate detection method according to the present invention will be explained.

This method estimates a change in the moment of inertia of the spin basket 3 turning at a speed of n, according to a washing quantity and cloth characteristics detected before a spin-dry operation. Namely, the first method estimates a change in a dried state of washing, to method estimates a change in a dried state of washing, to determine a spin-dry period and control the dry rate of the washing. When the washing quantity is unchanged, soft clothes such as synthetic fabric clothes dry more quickly than stiff clothes such as cotton clothes.

Figure 41:
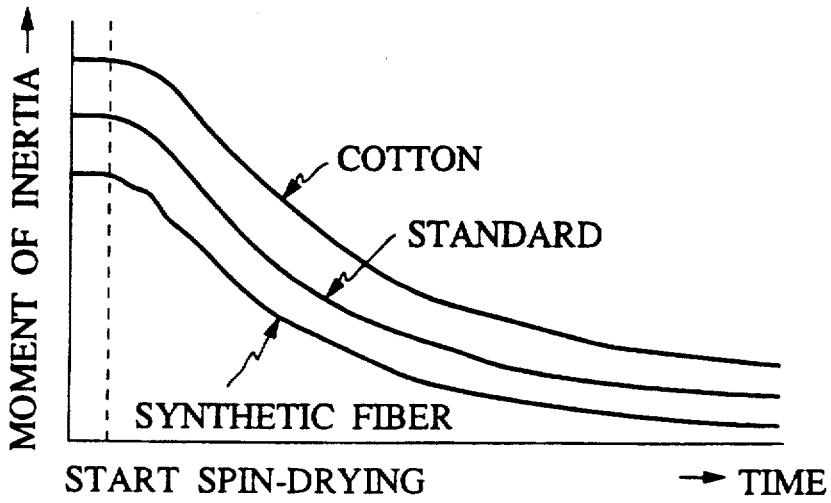
FIG. 41 shows changes in the moment of inertia according to a spin-dry period with different cloth characteristics.

FIG. 41 shows a relationship between a spin-dry period and the moment of inertia for different fabrics.

Figure 42:
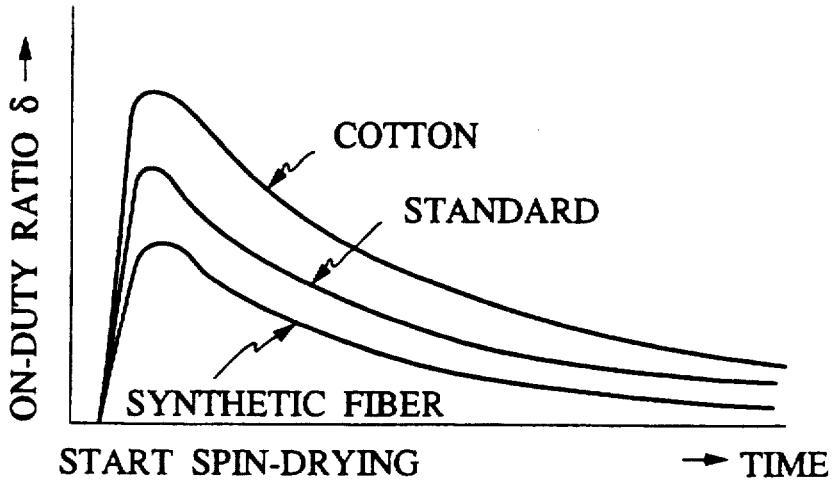
FIG. 42 shows changes in the ON-duty ratio of a PWM signal according to a spin-dry period with different cloth characteristics.

FIG. 42 shows a relationship between a spin-dry period and the ON-duty ratio of the PWM signal that changes according to the moment of inertia for different fabrics.

Figure 43:
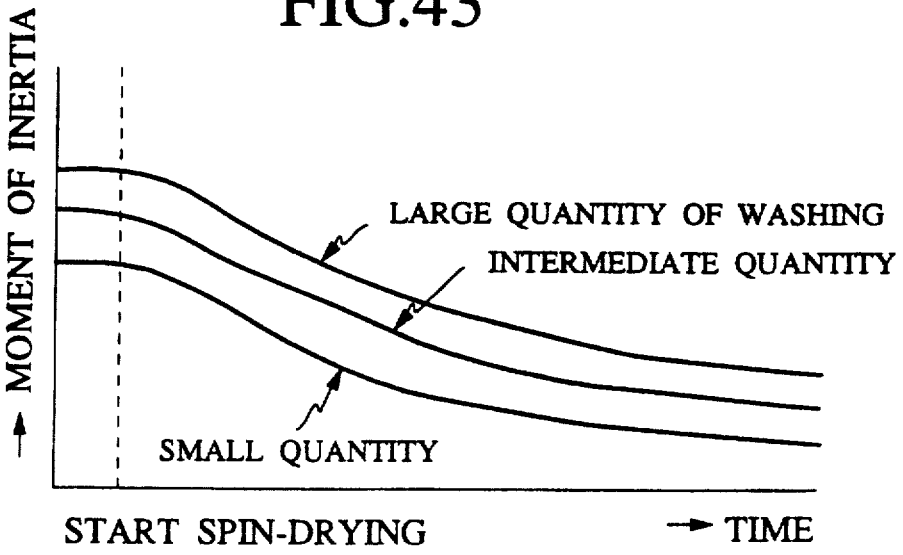
FIG. 43 shows changes in the moment of inertia according to a spin-dry period with different washing quantities.

FIG. 43 shows a relationship between a spin-dry period and the moment of inertia for the same fabric with different washing quantities.

Figure 44:
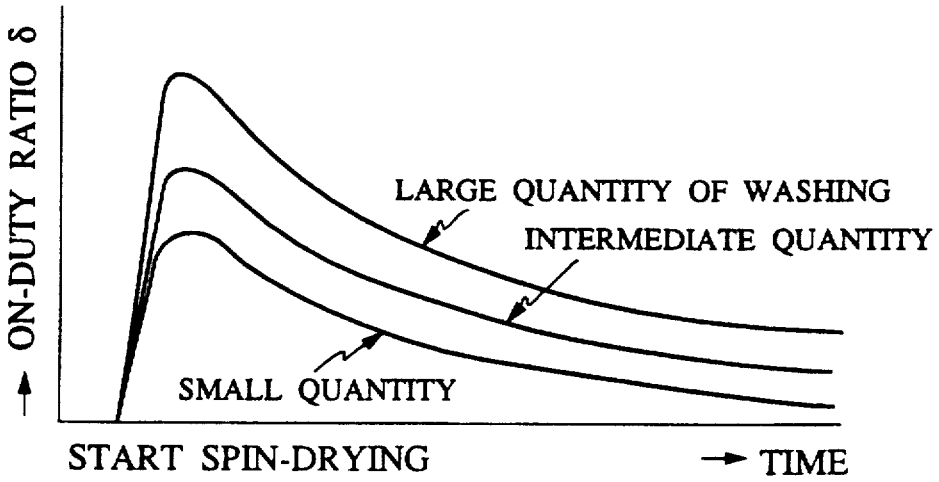
FIG. 44 shows changes in the ON-duty ratio of a PWM signal according to a spin-dry period with different washing quantities.

FIG. 44 shows a relationship between a spin-dry period and the ON-duty ratio of the PWM signal that changes according to the moment of inertia for the same fabric with different washing quantities.

FIGS. 41 to 44 tell that the moment of inertia and the ON-duty ratio of the PWM signal decrease as the spin-dry period extends. These curves of the moment of inertia and of the ON-duty ratio of the PWM signal for different combinations of washing quantities and cloth characteristics are stored in a table in a memory of the microcomputer 26 in advance. By looking up the table, the moment of inertia, i.e., a dried state after given time is known. Namely, according to the washing quantity and cloth characteristics of washing before a spin-dry operation, a dry rate after a spin-dry period t is estimated.

Table 14 shows a relationship between a combination of a washing quantity and cloth characteristics and a period to obtain a given dry rate.

TABLE 14

| | Synthetic fiber | Standard | Cotton |
|---|---|---|---|
| Small qty. | Short | Short | Medium |
| Medium qty. | Short | Short | Medium |
| Large qty. | Short | Medium | Long |

This table indicates that a period to obtain a given dry rate is short when the washing quantity is small and the cloth characteristics are soft such as those of synthetic fiber and that the period is long when the washing quantity is large and the cloth characteristics are hard such as those of cotton.

Figure 45:
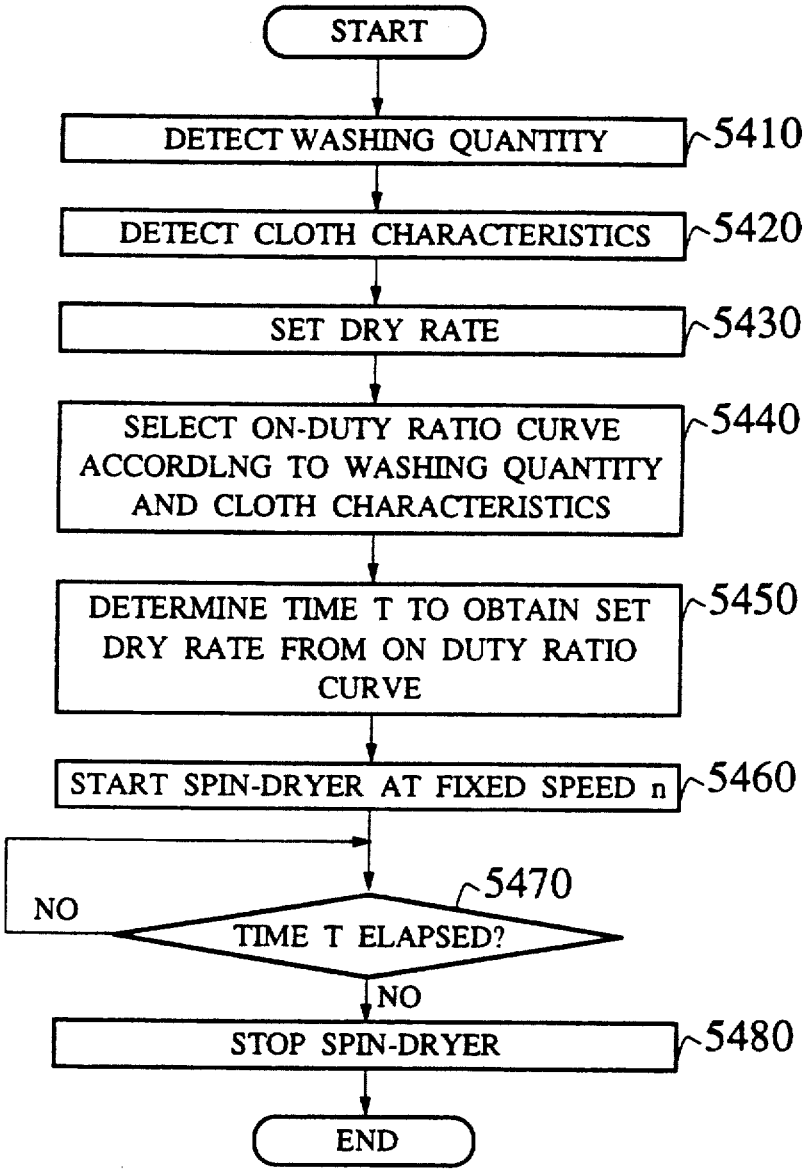
FIG. 45 is a flowchart showing a first dry rate detection method.

The first dry rate detection method will be explained with reference to a flowchart of FIG. 45.

Steps 5410 to 5430 detect a washing quantity and cloth characteristics and determine a dry rate. These steps are the same as those explained before. Step 5440 selects an ON-duty ratio curve of the PWM signal according to the detected washing quantity and cloth characteristics. The selected curve may be one of those shown in FIGS. 41 to 44.

Step 5450 determines a target period t to get the target dry rate according to the selected ON-duty ratio curve and the table. Steps 5460 and 5470 drive the spin basket 3 at a given speed n for the target period t. After the period t, the washing in the spin basket 3 will have the target dry rate, and step 5480 stops the spin basket 3.

A second dry rate detection method according to the present invention will be explained.

This method determines a spin-dry period Δt shorter than a target spin-dry period t, according to a washing quantity and cloth characteristics. When the period Δt elapses, the method finds the moment of inertia to estimate a dried state and correct a remaining spin-dry period. Table 15 shows a relationship between a short spin-dry period, a washing quantity, and cloth characteristics.

TABLE 15

| | Synthetic fiber | Standard | Cotton |
|---|---|---|---|
| Small qty. | Short | Short | Medium |
| Medium qty. | Short | Short | Medium |
| Large qty. | Short | Medium | Long |

The moment of inertia is obtainable as the ON-duty ratio of the PWM signal with the speed of the motor 5 being unchanged, similar to the first control variable.

Figure 46:
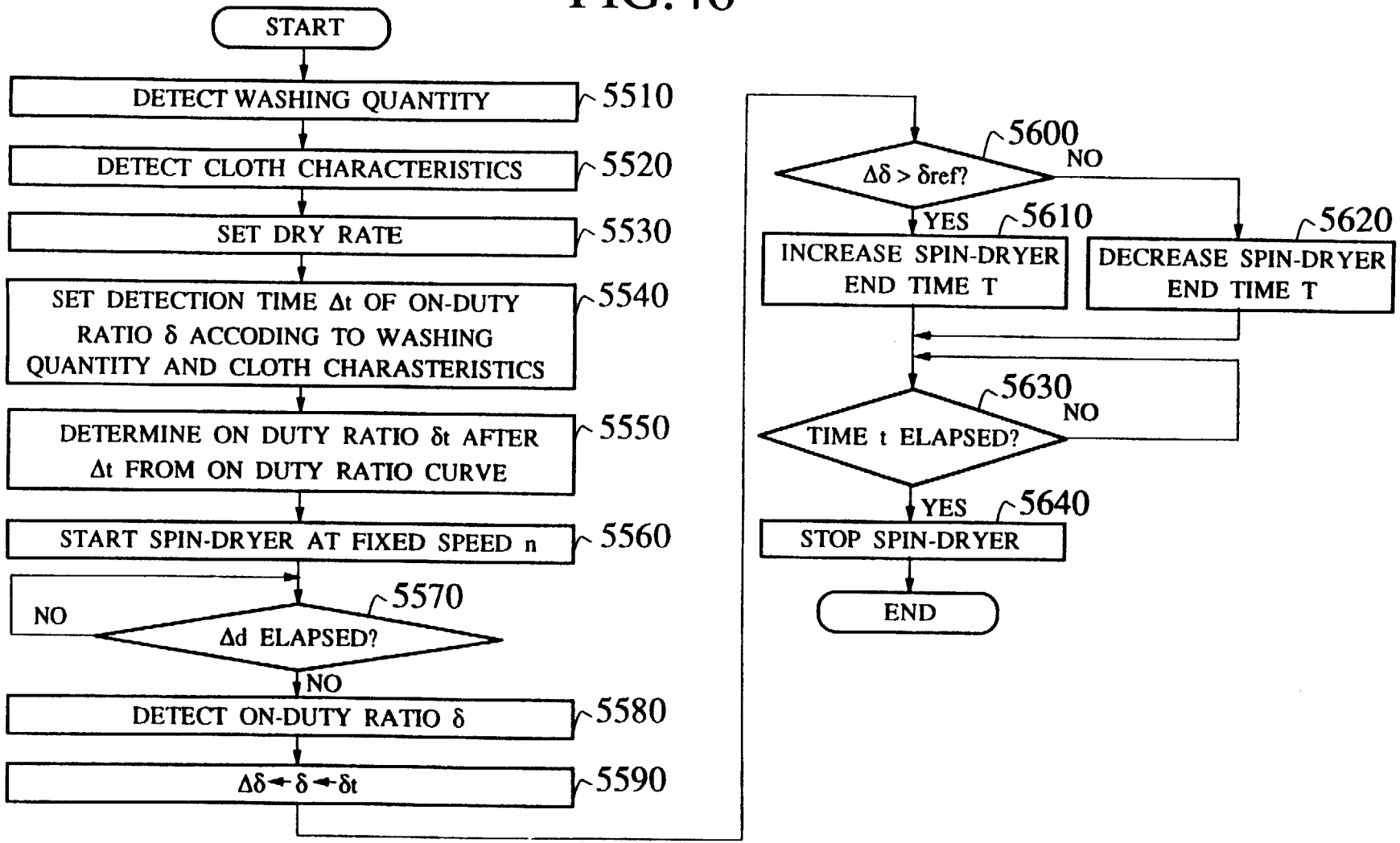
FIG. 46 is a flowchart showing a second dry rate detection method.

The second dry rate detection method will be explained with reference to a flowchart of FIG. 46.

Steps 5510 to 5530 detect a washing quantity and cloth characteristics and determines a dry rate. These steps are the same as those explained before. Step 5540 selects an ON-duty ratio curve of the PWM signal according to the detected washing quantity and cloth characteristics and determines a short spin-dry period Δt. The selected ON-duty ratio curve may be one of those of FIGS. 41 to 44.

Step 5550 determines an ON-duty ratio δt after the period Δt according to the selected ON-duty ratio curve. Steps 5560 and 5570 drive the spin basket 3 at a fixed speed n to spin-dry the washing for the period Δt.

After the period Δt, step 5580 detects an ON-duty ratio δ. Step 5590 calculates a difference Δδ between the ON-duty ratios δ and δt.

Step 5600 determines whether or not the difference Δδ is greater than a reference value δref. If it is greater, the washing contain more water than expected. Accordingly, step 5610 elongates the spin-dry period t. Steps 5630 and 5640 stop the spin basket 3 after the period t. If the step 5600 determines that the difference Δδ is not greater than the reference value δref, step 5620 shortens the spin-dry period t. Steps 5630 and 5640 stop the spin basket 3 after the period t.

A third dry rate detection method according to the present invention will be explained.

This method keeps the ON-duty ratio δ of the PWM signal constant for a given period by a value smaller than a value to $\delta_T$ after a short spin-dry period Δt and corrects a remaining spin-dry period according to a revolution speed n0 of the motor 5 at this moment and a revolution speed nt retrieved from a table.

FIGS. 47*a* and 47*b* show a relationship among the spin-dry period, ON-duty ratio δ, and revolution speed n according to the third dry rate detection method. When the ON-duty ratio δ is fixed after the period Δt by a value smaller than a value to $\delta_T$, the revolution speed decreases. The revolution speed quickly decreases with a low dry rate as indicated with a dotted line in FIG. 47*b* and slowly decreases with a high dry rate as indicated with a continuous line in the figure.

A fourth dry rate detection method according to the present invention will be explained.

This method temporarily stops the motor 5, restarts the motor 5 with the ON-duty ratio δ of the PWM signal being unchanged and finds a dry rate according to a period tc in which the motor 5 achieves a set speed n.

FIG. 48 shows a relationship between a spin-dry period and the revolution speed of the motor 5 according to the fourth method. The motor 5 is once stopped at time t01 and is restarted with a fixed ON-duty ratio. A period tc to get the fixed revolution speed n is measured. The period tc becomes longer when a dry rate is low as indicated with a dotted line and shorter when the dry rate is high as indicated with a continuous line.

A fifth dry rate detection method according to the present invention will be explained.

This method changes the revolution speed of the motor 5 from n to n+Δn and finds a dry rate according to a change Δc in the ON-duty ratio of the PWM signal at this moment.

Figure 49A:
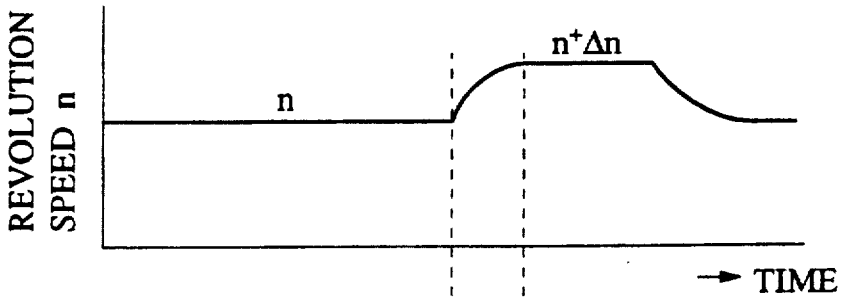
FIG. 49a shows a relationship between a spin-dry period and the revolution speed of the motor according to a fifth dry rate detection method.
Figure 49B:
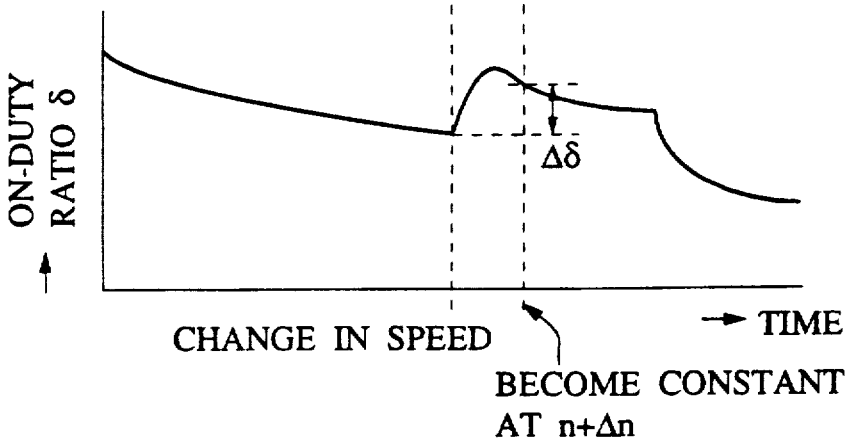
FIG. 49b shows a relationship between a spin-dry period and the ON-duty ratio of a PWM signal according to the fifth dry rate detection method.

FIGS. 49*a* and 49*b* show a relationship among a spin-dry period, the revolution speed of the motor 5, and the ON-duty ratio of the PWM signal according to the fifth method. When the speed of the motor 5 is changed from n to n+Δn as shown in FIG. 49*a*, the ON-duty ratio of the PWM signal is changed by Δδ as shown in FIG. 49*b*. This change Δδ is dependent on a dry rate. Accordingly, the dry rate is detectable according to the change Δδ.

A sixth dry rate detection method according to the present invention will be explained.

This method detects, as a value representing the moment of inertia, an ON-duty ratio δ0 just after the start of spin-drying. The method then measures an ON-duty ratio δt at regular intervals. A ratio δ of the ON-duty ratio δt to the ON-duty ratio δ0 is compared with a reference value δref, to determine an end of the spin-dry operation.

Figure 50:
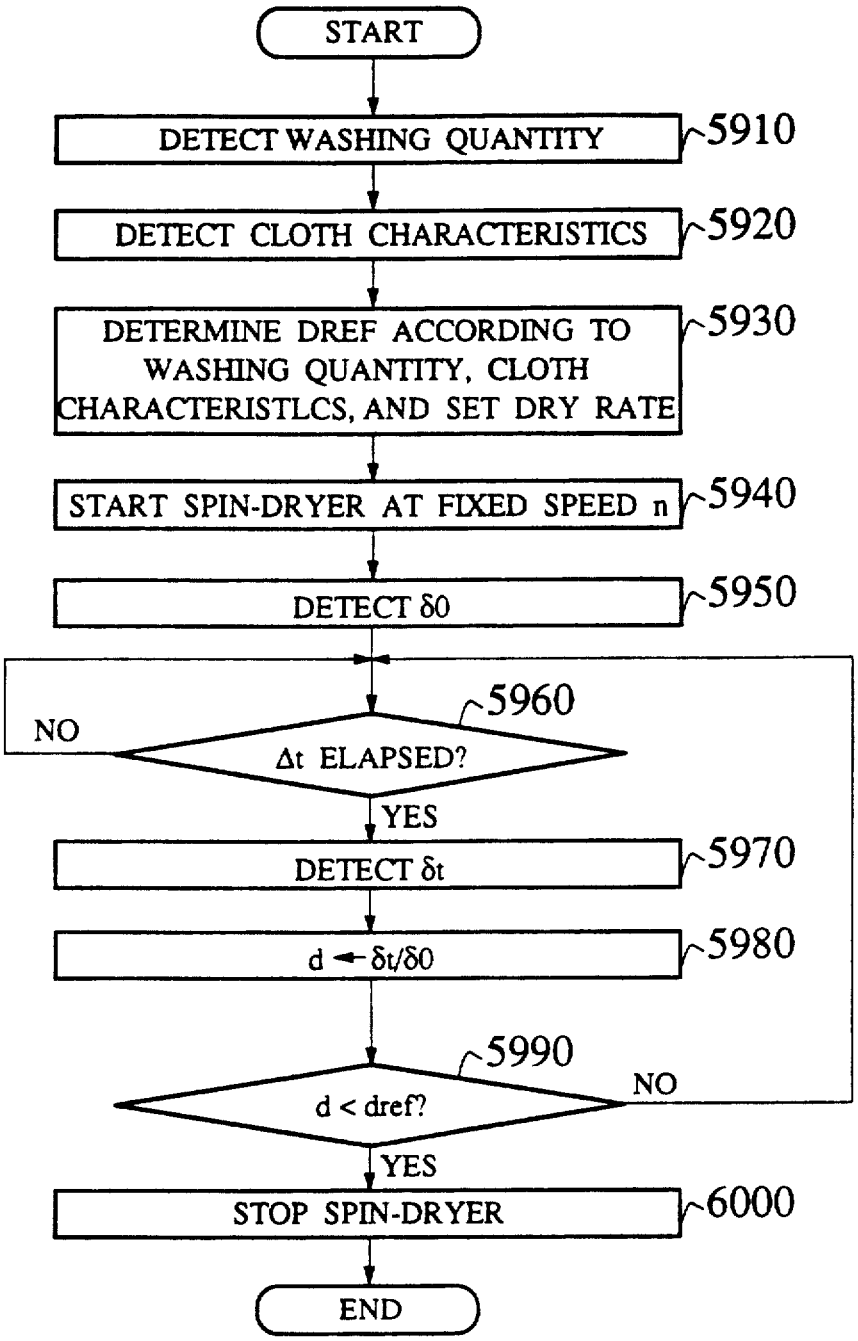
FIG. 50 is a flowchart showing a sixth dry rate detection method.

The sixth dry rate detection method will be explained with reference to a flowchart of FIG. 50.

Steps 5910 and 5920 detect a washing quantity and cloth characteristics. These steps are the same as those explained before. Step 5930 determines a reference value δref from the washing quantity, cloth characteristics, and a target dry rate. Steps 5940 and 5950 drive the spin basket 3 at a fixed speed n and detect an ON-duty ratio δ0 just after the start of the spin basket 3. The ON-duty ration δ0 corresponds to the moment of inertia.

After a short spin-dry period Δt, steps 5960 to 5980 detect an ON-duty ratio δt and calculate a ratio δ of the δt to the δ0. Step 5990 checks to see whether or not the ratio δ is smaller than the reference value δref. If not, the flow returns to the step 5960 to repeat the same steps. When the ratio δ is smaller than the reference value, step 6000 stops the spin basket 3.

Although this method employs the first control variable as a value corresponding to the moment of inertia, another control variable may also be employable.

A seventh dry rate detection method according to the present invention will be explained.

This method makes the microcomputer 26 control the ON-duty ratio of the PWM signal to run the motor 5 at a fixed speed n. Just when the motor 5 reaches the fixed speed n, the method measures an ON-duty ratio δ0. Then, the method measures an ON-duty ratio δt at regular intervals of Δt, and according to a ratio of the δt to the δ0, finds a dry rate, similar to the sixth method.

Figure 51:
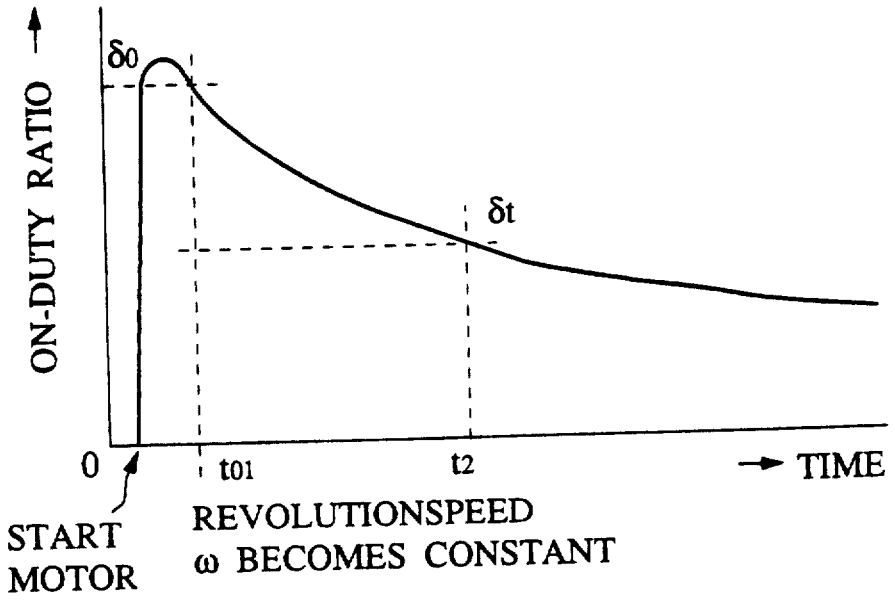
FIG. 51 shows a relationship between a spin-dry period and the ON-duty ratio of a PWM signal according to a seventh dry rate detection method.

FIG. 51 shows a relationship between a spin-dry period and an ON-duty ratio. In the figure, the motor 5 reaches the fixed revolution speed n at time t01. At this time, the ON-duty ratio δ0 is obtained. At time t2 a period Δt after the time t01, the ON-duty ratio δt is obtained. A ratio δ=δt/δ0 is calculated, and a spin-dry operation is continued until the ratio δ becomes smaller than a reference value δref.

The reference value δref is set according to a required dry rate. When the required dry rate is high, a small reference value is selected, and when the required dry rate is low, a large reference value is selected. In this way, various dry rates can be set. An inverter current may be employed instead of the ON-duty ratio δ.

An eighth dry rate detection method according to the present invention will be explained.

This method detects an ON-duty ratio δ0 as a value corresponding to the moment of inertia just after the start of a spin-dry operation. After a period Δt, an ON-duty ratio δt is detected as a value corresponding to the moment of inertia. A ratio δ of the δ0 to the δt is compared with a reference value δref. According to a result of the comparison, an end of the spin-dry operation is determined.

Figure 52:
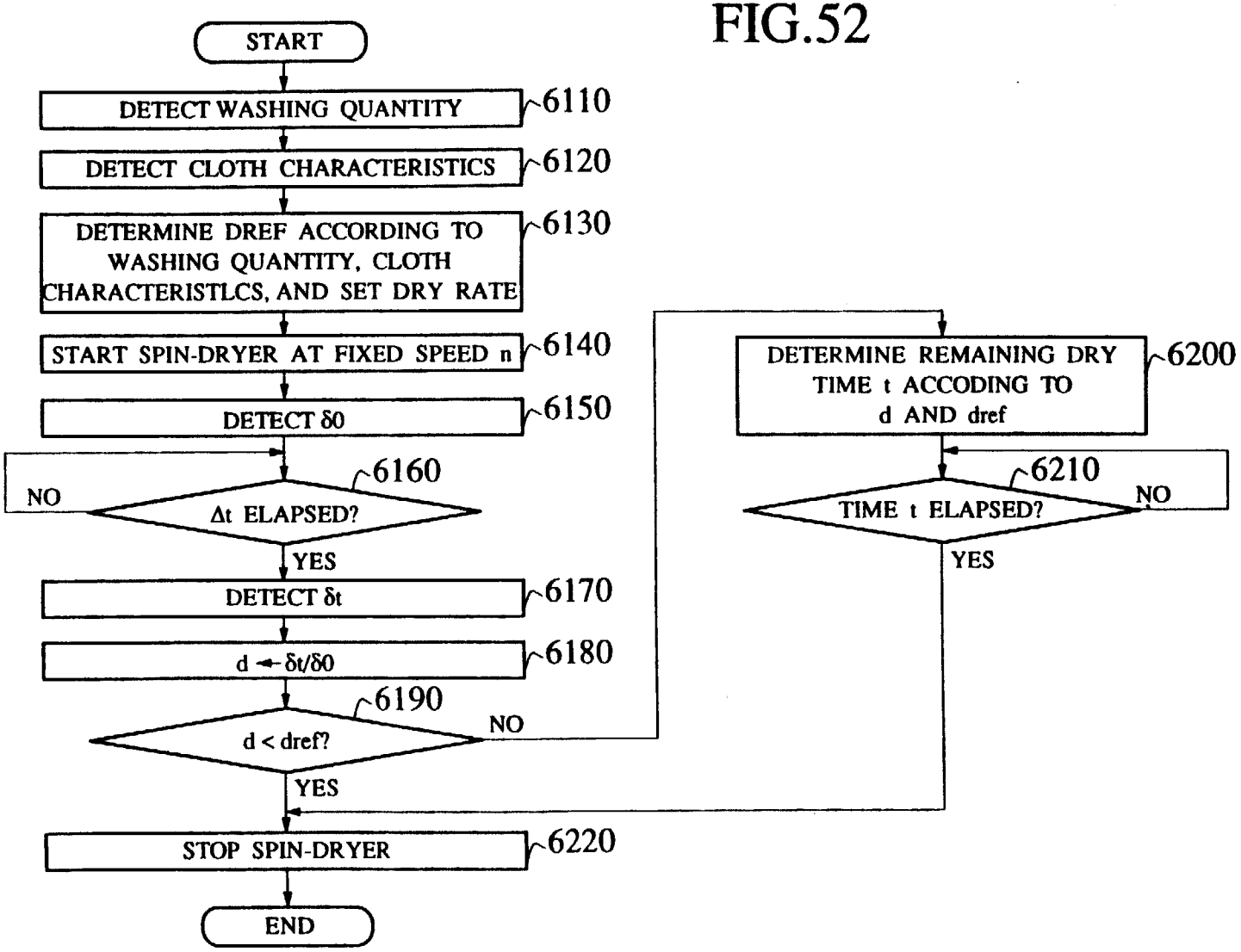
FIG. 52 is a flowchart showing the seventh dry rate detection method.

The eighth dry rate detection method will be explained with reference to a flowchart of FIG. 52.

Steps 6110 and 6120 detect a washing quantity and cloth characteristics. These steps are the same as those explained before. Step 6130 determines a reference value δref according to the washing quantity, cloth characteristics, and a target dry rate. Steps 6140 and 6150 drive the spin basket 3 at a fixed revolution speed n and detect an ON-duty ratio δ0 as the moment of inertia just after the start of the spin basket 3.

A period Δt after the start of the spin basket 3, steps 6160 to 6180 detect an ON-duty ratio δt and calculate a ratio δ of the δt to the δ0. Step 6190 checks to see whether or not the ratio δ is smaller than the reference value δref. If it is not smaller than the reference value, step 6200 determines a remaining spin-dry period t according to the ratio δ and reference value δref. Steps 6210 and 6230 stop the spin basket 3 after the period t.

If the ratio δ is smaller than the reference value δref, step 6220 stops the spin basket 3.

The step 6200 sets the remaining period t to be shorter if the ratio δ is close to the reference value δref and to be longer if it is not so. Similar to the sixth method, the reference value δref may be adjusted according to a required dry rate. In this case, various dry rates are employable to spin-dry the washing.

To detect the moment of inertia just after the start of spin-drying and the amount of inertia after the period Δt, the second to fourth control variables are employable instead of the ON-duty ratio and inverter current.

Still another dry rate detection method according to the present invention will be explained. This method detects a temporal change in the torque of the motor 5 during a spin-dry operation, and retrieves a spin-dry period to attain a target dry rate from a table according to a washing quantity, cloth characteristics, and the change in the torque.

A ninth dry rate detection method according to the present invention will be explained.

When the motor 5 is controlled by a fixed voltage or current and when the quantity of washing is unchanged, load torque becomes larger as the water content of the washing increases to increase the revolution speed of the motor 5. When the water content of the washing is small, the load torque becomes smaller to decrease the revolution speed of the motor 5. Based on these facts, the ninth method detects a dry rate according to a difference Δn between the revolution speed of the motor 5 just after the start and the revolution speed of the motor 5 after a spin-dry operation.

The speed difference Δn is substantially proportional to the quantity of water removed from the washing. Accordingly, the dry rate becomes larger as the speed difference Δn becomes larger, and the dry rate becomes smaller as the speed difference Δn deceases. Accordingly, a dry rate can be estimated from a change in the revolution speed of the motor 5 before and after a spin-dry operation under the same torque. According to the detected dry rate, the method continues the spin-dry operation to an extent of sufficiently drying the washing or preventing wrinkles on the washing.

A tenth dry rate detection method according to the present invention will be explained.

This method detects a dry rate according to the weight of washing measured before starting a washing operation and after a spin-dry operation. This method measures the weight of the washing after the spin-dry operation according to the torque of the motor 5. To measure the torque, the method stops the motor 5, restarts the motor 5 in one direction, and measure the torque of the motor by reversing the direction of the motor 5.

An eleventh dry rate detection method according to the present invention will be explained.

This method detects a dry rate by comparing the weight of washing before a washing operation with the weight of the washing during or after a spin-dry operation. This method measures the weight of the washing during or after the spin-dry operation according to the torque of the motor 5. To measure the torque, this method changes the revolution speed of the motor 5 during or after the spin-dry operation and detects a change in the torque.

A twelfth dry rate detection method according to the present invention will be explained.

This method detects a dry rate according to a change in the moment of inertia while driving the motor 5 under constant torque, i.e., a constant current.

The torque T and angular acceleration $\beta$ of the motor 5 are expressed as $T=I\beta$ where the I is the moment of an object to be rotated. When the torque T is fixed, the angular acceleration $\beta$ becomes smaller as the moment I increases and the angular acceleration $\beta$ becomes larger as the moment I decreases. Namely, as the moment I increases, the angular acceleration $\beta$ becomes smaller and a period t to reach a given angular speed $\omega$ becomes longer.

Accordingly, a moment Ie of washing that have been spin-dried is smaller than a moment Is of the washing before the spin-dry operation. A change in the moment is proportional to the quantity of water removed from the washing. Namely, when a difference between the Ie and the Is is large, the quantity of removed water is large, i.e., a dry rate is large.

The motor 5 is started under fixed torque, i.e., a fixed current, and a period needed to reach a set revolution speed is measured before and after a spin-dry operation. According to a change in the measured period, a dry rate can be predicted.

A thirteenth dry rate detection method according to the present invention will be explained.

This method detects a dry rate according to a difference in the moment of inertia before and after a spin-dry operation. The moment of inertia of washing after a spin-dry operation must be smaller than that before the spin-dry operation. A change in the moment of inertia is proportional to a change in the water content of the washing, i.e., a change in the dry rate. The starting torque of the motor 5 is proportional to a moment. Accordingly, a change in the moment, i.e., a change in the dry rate can be estimated from a difference between the starting torque before a spin-dry operation and the starting torque after the spin-dry operation.

For example, peaks in the starting torque before and after a spin-dry operation of the motor 5 driven at a fixed revolution speed n are compared with each other. If a difference between the peaks is large, a dry rate will be large. If the rate of the starting torque before the spin-dry operation to the starting torque after the spin-dry operation is large, the dry rate will be small.

A fourteenth dry rate detection method according to the present invention will be explained.

This method detects a dry rate according to a difference between the torque of the motor 5 before a spin-dry operation and that after the spin-dry operation with the motor 5 being driven at a fixed revolution speed. When the motor 5 is driven at the fixed speed, the torque before the spin-dry operation is larger than that after the spin-dry operation. A change in the torque becomes larger as the quantity of removed water increases. Namely, a dry rate is large if the change in the torque is large and the dry rate is small if the change in the torque is small. In this way, a dry rate is predictable according to a change in torque before and after a spin-dry operation with the motor 5 being driven at a fixed revolution speed.

A fifteenth dry rate detection method according to the present invention will be explained.

This method finds a difference dI in the moment of inertia at given intervals, determines a remaining spin-dry period according to the difference dI, a washing quantity, and cloth characteristics, and achieves a target dry rate.

More precisely, this method compares the difference dI with a reference value dI1. If the difference is smaller than the reference value, the method retrieves a remaining spin-dry period taij from Table 16 according to the washing quantity and cloth characteristics. The method then continues the spin-dry operation for the retrieved spin-dry period taij. The Table 16 is stored in a memory of the microcomputer 26.

TABLE 16

| | Soft | Standard | Hard |
|---|---|---|---|
| Large qty. | ta11 | ta12 | ta13 |
| Medium qty. | ta21 | ta22 | ta23 |
| Small qty. | ta31 | ta32 | ta33 |

The remaining spin-dry period differs depending on a target dry rate. Generally, a target dry rate at the end of a washing operation and at the end of a first rinse operation is lower than a target dry rate at the end of a second rinse operation. Accordingly, a plurality of tables such as Tables 17 and 18 are prepared and properly used.

TABLE 17

| | Soft | Standard | Hard |
|---|---|---|---|
| Small qty. | tb11 | tb12 | tb13 |
| Medium qty. | tb21 | tb22 | tb23 |
| Large qty. | tb31 | tb32 | tb33 |

TABLE 18

| | Soft | Standard | Hard |
|---|---|---|---|
| Small qty. | tc11 | tc12 | tc13 |
| Medium qty. | tc21 | tc22 | tc23 |
| Large qty. | tc31 | tc32 | tc33 |

Table 17 is used when the difference dI is between reference values dI1 and dI2, and Table 18 is used when the difference dI is greater than the reference value dI2. For example, when the washing quantity is small, the cloth characteristics are standard, and the difference dI is between the reference values dI1 and dI2, a spin-dry period tb12 will be selected to attain a target dry rate.

Referring again to FIG. 12*b*, step 540 is carried out after the target dry rate is obtained. The step 540 feeds water, and step 550 detects a water level. Step 560 feeds water up to the final water level LWo determined according to the washing quantity and cloth characteristics.

Step 570 starts the first rinse process. Similar to the washing process, steps 580 to 620 detects entanglement, disentangles, detects damage, and protects the washing. The rinse process is continued for a set period with an optimum water flow. Step 630 drains water after the first rinse operation.

Referring to FIG. 12*c*, steps 640 to 680 continue the draining while detecting a water level, similar to the steps 410 to 460.

Step 690 starts the second spin-dry process. Steps 700 to 750 continue the second spin-dry process to obtain a target dry rate while detecting an imbalanced state and correcting the imbalance, similar to the first spin-dry process.

When the target dry rate is obtained, step 760 feeds water for the second rinse process. Step 770 detects a water level, and step 780 feeds water to the final water level LWo determined according to the washing quantity and cloth characteristics.

Step 790 starts the second rinse process. Steps 800 to 840 continue the second rinse process for a set period with an optimum water flow while detecting entanglement, disentangling, detecting damage, and protecting the washing, similar to the washing and first rinse processes. Step 850 drains water.

Figure 12D:
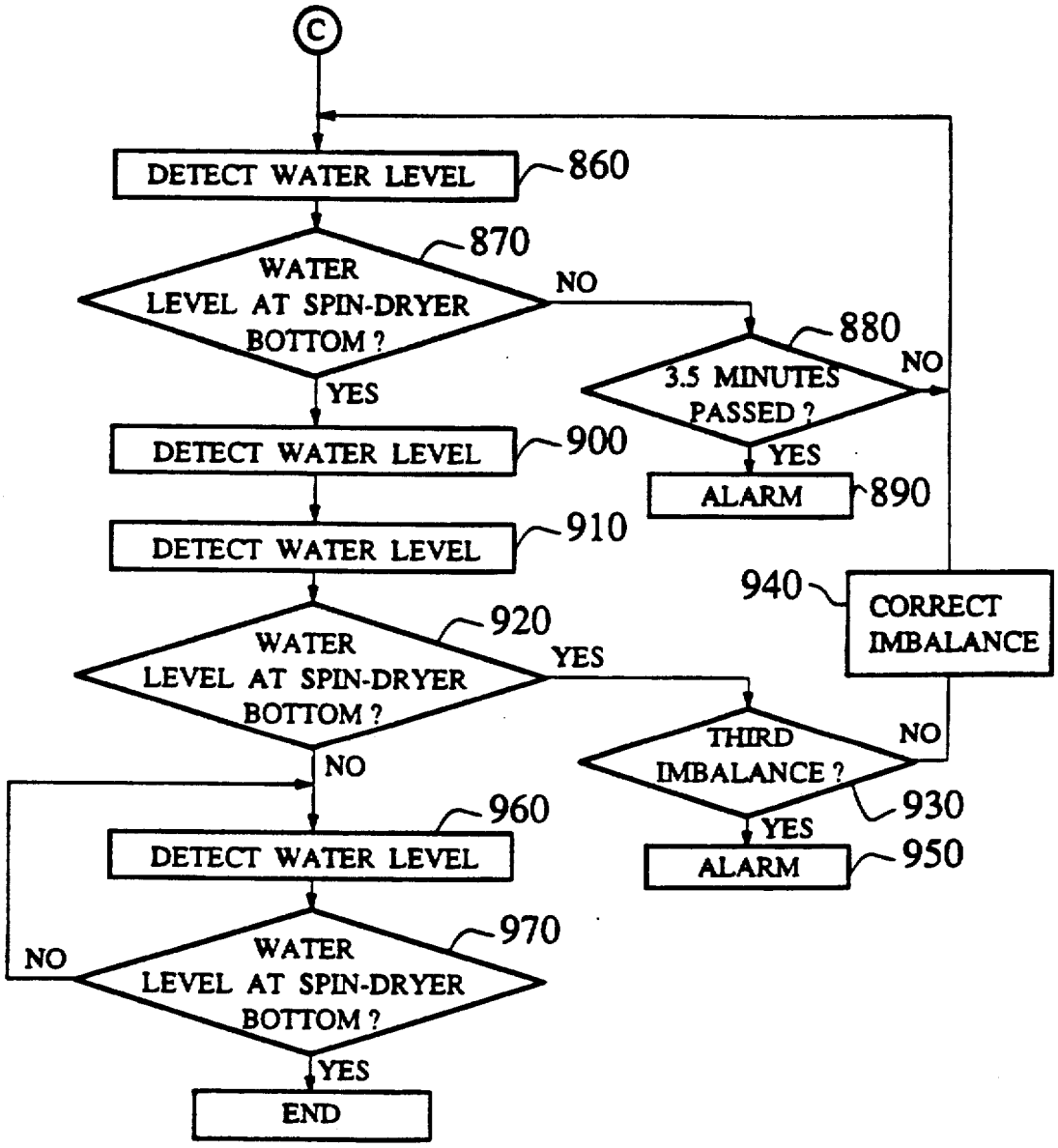

In FIG. 12*d*, steps 860 to 900 continue the draining while detecting a water level, like the steps 410 to 460.

Step 910 starts the finish spin-dry process. Steps 920 to 970 continue the final spin-dry process to obtain a target dry rate while detecting an imbalanced state and correcting the imbalance, similar to the first and second spin-dry processes. Then, all the processes will complete.

In summary, the present invention detects load torque by turning a spin basket in forward and reverse directions, finds a difference between the two pieces of load torque, determines that washing in the spin basket are entangling with one another if the difference is greater than a reference value, and disentangles the washing. Alternatively, the present invention drives the spin basket at a predetermined speed, detects load torque, finds a change in the load torque, determines that the washing are entangling with one another if the change is greater than a predetermined value, and disentangles the washing. In this way, the present invention properly detects entanglement, disentangles the washing, to completely wash and rinse the washing with no entanglement.

Various modifications will become possible for those skilled in the art after receiving the teachings of the present disclosure without departing from the scope thereof.

What is claimed is:

1. A washing machine comprising:

entanglement detection means for detecting forward load torque while water flow producing means is being drived in a forward direction during one of washing and rinsing operations as well as reverse load torque while the water flow producing means is being turned in a reverse direction, calculating a difference between the forward load torque and the reverse load torque, and determining that the washing are entangling with one another if the difference is greater than a reference value; and disentangle means for disentangling the washing if said entanglement detection means determines that the washing are entangling.

2. The washing machine according to claim 1, wherein said entanglement detection means detect the condition and direction of entanglement according to a difference ($\Delta$Tmax) between maximum torque (Tmax(CW)) produced by a motor while the motor is turning the water flow producing means in the forward direction and maximum torque (Tmax(CCW)) produced by the motor while the motor is turning the water flow producing means in the reverse direction.

3. The washing machine according to claim 1, wherein said entanglement detection means detects the condition and direction of entanglement according to a difference ($\Delta$Imax) between a maximum inverter current (Imax(CW)) flowing to a motor while the motor is turning the water flow producing means in the forward direction and a maximum inverter current (Imax(CCW)) flowing to the motor while the motor is turning the water flow producing means in the reverse direction.

4. The washing machine according to claim 1, wherein said entanglement detection means detects the condition and direction of entanglement according to a difference (ΔTave) between the average (Tave(CW)) of torque produced by a motor while the motor is turning the water flow producing means in the forward direction and the average (Tave(CCW)) of torque produced by the motor while the motor is turning the water flow producing means in the reverse direction.

5. The washing machine according to claim 1, wherein said entanglement detection means detects condition and direction of entanglement according to a difference (ΔIave) between the average (Iave(CW)) of currents flowing to a motor while the motor is turning the water flow producing means in the forward direction and the average (Iave(CCW)) of currents flowing to the motor while the motor is turning the water flow producing means in the reverse direction.

6. The washing machine according to claim 1, wherein said entanglement detection means detects the condition of entanglement according to a peak-to-peak value (Δδp−p) of temporally changing ON-duty ratios of a PWM signal for a period during which a motor is turning the water flow producing means in one of the forward and reverse directions, the peak-to-peak value (Δδp−p) serving as a value corresponding to a peak-to-peak value (ΔTp−p) of temporally changing torque (T) of the motor.

7. The washing machine according to claim 1, wherein said entanglement detection means detects the conditions of entanglement according to each difference (ΔTexti=|Texti−Texti−1|) among extreme values (Text0, Text1, . . . , Texti) of temporally changing torque (T) of a motor for a period during which the motor is turning the water flow producing means in one of the forward and reverse directions.

8. The washing machine according to claim 1, wherein said entanglement detection means detects the condition of entanglement according to fluctuations in maximum values (Tmax) of the torque of a motor measured when the motor turns the water flow producing means in forward and reverse directions.

9. The washing machine according to claim 1, further comprising:

damage detection and prevention means for detecting and preventing damage to the washing during washing and rinsing operations.

10. The washing machine according to claim 9, wherein the damage detection and prevention means determines whether or not the washing are being washed at a revolution speed optimum for the quantity and characteristics of the washing, and if the speed is not optimum for the washing, adjusts the speed to change a water flow to prevent damage to the washing.

11. The washing machine according to claim 1, further comprising:

dry rate detection means for detecting a dry rate of the washing.

12. The washing machine according to claim 11, wherein the dry rate detection means estimates a change in the dried state of the washing, i.e., a change in the moment of inertia during a spin-dry operation carried out at a fixed revolution speed (n), according to the quantity and characteristics of the washing detected before the spin-dry operation, determines a spin-dry period according to the estimated change, and controls a dry rate of the washing according to the determined spin-dry period.

13. A washing machine comprising:

a washing tub for holding washing water;

a spin basket disposed inside said washing tub;

means for producing a water flow in said spin basket;

a motor for driving at least said water flow producing means;

detection means for detecting maximum load torque (Tmax(CW)) of said motor while said motor is driving said water flow producing means in a forward direction to wash or rinse washing as well as maximum load torque (Tmax(CCW)) of said motor while said motor is turning said water flow producing means in a reverse direction;

calculation means for calculating a difference (ΔTmax) between the maximum load torque (Tmax(CW)) and the maximum load torque (Tmax(CCW));

entanglement detection means for determining that the washing are entangling with one another if the difference (ΔTmax) is greater than a reference value; and disentangle means for disentangling the washing after the entanglement detection means determines that there is entanglement.

14. A washing machine comprising:

a washing tub for holding washing water;

a spin basket disposed inside said washing tub;

means for producing a water flow in said spin basket;

a motor for driving at least said water flow producing means;

load torque detection means for detecting load torque of said motor when said motor is driving said water flow producing means at a fixed speed during washing or rinsing;

means for detecting a peak-to-peak value (ΔTp−p) of the temporally changing torque of said motor detected by said load torque detection means for a period through which said motor turns said water flow producing means in one of the forward and reverse directions;

entanglement detection means for detecting entanglement of washing according to the peak-to-peak value (ΔTp−p); and disentangle means for disentangling the washing after said entanglement detection means finds entanglement.

* * * * *